US008864457B2

(12) United States Patent
Malandra et al.

(10) Patent No.: US 8,864,457 B2
(45) Date of Patent: Oct. 21, 2014

(54) GAS TURBINE WITH OPTIMIZED AIRFOIL ELEMENT ANGLES

(75) Inventors: Anthony J. Malandra, Orlando, FL (US); Ching-Pang Lee, Cincinnati, OH (US); Barry J. Brown, Jupiter, FL (US); Eric Munoz, Miami Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 166 days.

(21) Appl. No.: 13/589,264

(22) Filed: Aug. 20, 2012

(65) Prior Publication Data

US 2013/0089415 A1 Apr. 11, 2013

Related U.S. Application Data

(60) Provisional application No. 61/543,850, filed on Oct. 6, 2011.

(51) Int. Cl.

*F01D 25/30* (2006.01)
*F01D 9/04* (2006.01)
*F01D 5/14* (2006.01)

(52) U.S. Cl.

CPC ..... *F01D 5/141* (2013.01); *F05D 2220/3213* (2013.01); *F05D 2250/74* (2013.01); *F01D 9/041* (2013.01)

USPC ..... 415/191; 415/211.2

(58) Field of Classification Search

CPC ..... F01D 5/14; F01D 5/141; F01D 5/142; F01D 5/143; F01D 5/148; F01D 9/01; F01D 9/041; F04D 29/544

USPC ..... 415/191, 211.2; 416/241 R

See application file for complete search history.

(56) References Cited

U.S. PATENT DOCUMENTS

| | | | | |
|---|---|---|---|---|
| 4,900,230 | A | 2/1990 | Patel | |
| 5,352,092 | A * | 10/1994 | Ferleger et al. | 416/223 A |
| 5,980,209 | A | 11/1999 | Barry et al. | |
| 6,779,977 | B2 | 8/2004 | Lagrange et al. | |
| 7,229,248 | B2 | 6/2007 | Ito et al. | |
| 7,568,889 | B2 | 8/2009 | Mohan et al. | |
| 7,618,240 | B2 | 11/2009 | Saltman et al. | |
| 7,625,184 | B2 | 12/2009 | Jay et al. | |
| 7,632,072 | B2 | 12/2009 | Sheffield | |
| 7,632,075 | B2 | 12/2009 | Liang et al. | |
| 7,648,334 | B2 | 1/2010 | Hurst et al. | |
| 7,648,340 | B2 | 1/2010 | Sadler et al. | |
| 7,722,329 | B2 | 5/2010 | Clarke | |
| 7,731,483 | B2 | 6/2010 | DeLong et al. | |
| 7,837,445 | B2 | 11/2010 | Benjamin et al. | |

(Continued)

FOREIGN PATENT DOCUMENTS

EP 2317077 A2 5/2011

*Primary Examiner* — Ned Landrum
*Assistant Examiner* — Su Htay

(57) ABSTRACT

A turbine airfoil assembly for installation in a gas turbine engine. The airfoil assembly includes an endwall and an airfoil extending radially outwardly from the endwall. The airfoil includes pressure and suction sidewalls defining chordally spaced apart leading and trailing edges of the airfoil. An airfoil mean line is defined located centrally between the pressure and suction sidewalls. An angle between the mean line and a line parallel to the engine axis at the leading and trailing edges defines gas flow entry angles, α, and exit angles, β. Airfoil inlet and exit angles are substantially in accordance with pairs of inlet angle values, α, and exit angle values, β, set forth in one of Tables 1, 3, 5 and 7.

18 Claims, 9 Drawing Sheets

(56) References Cited

U.S. PATENT DOCUMENTS

| | | | | |
|---|---|---|---|---|
| 7,988,420 | B2 | 8/2011 | Arness et al. | |
| 8,147,207 | B2 | 4/2012 | Orosa et al. | |
| 2005/0220625 | A1* | 10/2005 | Chandraker | 416/223 R |
| 2008/0118362 | A1* | 5/2008 | Hu et al. | 416/223 A |
| 2008/0226454 | A1* | 9/2008 | Decker et al. | 416/203 |
| 2009/0274554 | A1 | 11/2009 | Guemmer | |
| 2011/0076150 | A1 | 3/2011 | Grafitti et al. | |
| 2011/0150659 | A1 | 6/2011 | Micheli et al. | |
| 2011/0150660 | A1* | 6/2011 | Micheli et al. | 416/223 R |

* cited by examiner

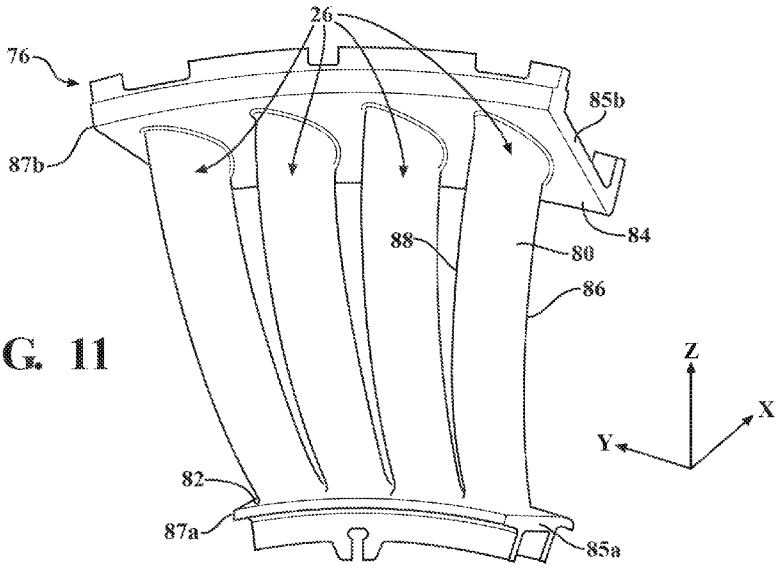
FIG. 11
FIG. 12
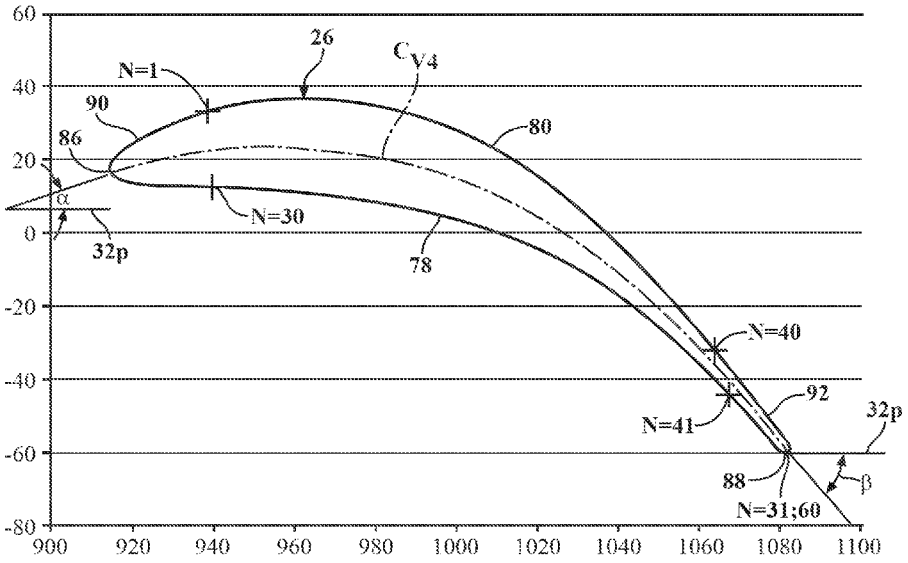

GAS TURBINE WITH OPTIMIZED AIRFOIL ELEMENT ANGLES

CROSS REFERENCE TO RELATED APPLICATION

This application claims the benefit of U.S. Provisional Patent Application Ser. No. 61/543,850, filed Oct. 6, 2011, entitled "GAS TURBINE WITH OPTIMIZED AIRFOIL ELEMENT ANGLES", the entire disclosure of which is incorporated by reference herein.

FIELD OF THE INVENTION

The present invention relates to a turbine vanes and blades for a gas turbine stage and, more particularly, to third and fourth stage turbine vane and blade airfoil configurations.

BACKGROUND OF THE INVENTION

In a turbomachine, such as a gas turbine engine, air is pressurized in a compressor then mixed with fuel and burned in a combustor to generate hot combustion gases. The hot combustion gases are expanded within the turbine section where energy is extracted to power the compressor and to produce useful work, such as turning a generator to produce electricity. The hot combustion gas travels through a series of turbine stages. A turbine stage may include a row of stationary vanes followed by a row of rotating turbine blades, where the turbine blades extract energy from the hot combustion gas for powering the compressor, and may additionally provide an output power.

The overall work output from the turbine is distributed into all of the stages. The stationary vanes are provided to accelerate the flow and turn the flow to feed into the downstream rotating blades to generate torque to drive the upstream compressor. The flow turning in each rotating blade creates a reaction force on the blade to produce the torque. The work transformation from the gas flow to the rotor disk is directly related to the engine efficiency, and the distribution of the work split for each stage may be controlled by the vane and blade design for each stage.

SUMMARY OF THE INVENTION

In accordance with an aspect of the invention, a turbine airfoil assembly is provided for installation in a gas turbine engine having a longitudinal axis. The turbine airfoil assembly includes an endwall for defining an inner boundary for an axially extending hot working gas path, and an airfoil extending radially outwardly from the endwall. The airfoil has an outer wall comprising a pressure sidewall and a suction sidewall joined together at chordally spaced apart leading and trailing edges of the airfoil. An airfoil mean line is defined extending chordally and located centrally between the pressure and suction sidewalls. Airfoil inlet and exit angles are defined at the airfoil leading and trailing edges that are substantially in accordance with pairs of inlet angle values, $\alpha$, and exit angle values, $\beta$, set forth in one of Tables 1, 3, 5 and 7. The inlet and exit angle values are generally defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis, and wherein each pair of inlet and exit angle values is defined with respect to a distance from the endwall corresponding to a Z value that is a percentage of the total span of the airfoil from the endwall. A predetermined difference between each pair of the airfoil inlet and exit angles is defined by a delta value, $\Delta$, in the Table, and a difference between any pair of the airfoil inlet and exit angles varies from the delta values, $\Delta$, in the Table by at most 5%.

In accordance with another aspect of the invention, third and fourth stage vane and blade airfoil assemblies are provided in a gas turbine engine having a longitudinal axis. Each airfoil assembly includes an endwall for defining an inner boundary for an axially extending hot working gas path, and an airfoil extending radially outwardly from the endwall. The airfoil has an outer wall comprising a pressure sidewall and a suction sidewall joined together at chordally spaced apart leading and trailing edges of the airfoil. An airfoil mean line is defined extending chordally and located centrally between the pressure and suction sidewalls. Airfoil inlet and exit angles are defined at the airfoil leading and trailing edges that are substantially in accordance with pairs of inlet angle values, $\alpha$, and exit angle values, $\beta$. The inlet and exit angle values are generally defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis. Each pair of inlet and exit angle values is defined with respect to a distance from the endwall corresponding to a Z value that is a percentage of the total span of the airfoil from the endwall, wherein:

a) the pairs of inlet angle values, $\alpha$, and exit angle values, $\beta$, for the third stage vane are as set forth in Table 1;
b) the pairs of inlet angle values, $\alpha$, and exit angle values, $\beta$, for the third stage blade are as set forth in Table 3;
c) the pairs of inlet angle values, $\alpha$, and exit angle values, $\beta$, for the fourth stage vane are as set forth in Table 5;
d) the pairs of inlet angle values, $\alpha$, and exit angle values, $\beta$, for the fourth stage blade are as set forth in Table 7; and wherein a predetermined difference between each pair of the airfoil inlet and exit angles is defined by a delta value, $\Delta$, in the Table, and a difference between any pair of the airfoil inlet and exit angles varies from the delta values, $\Delta$, in a respective Table by at most 5%.

In accordance with a further aspect of the invention, a turbine airfoil assembly is provided for installation in a gas turbine engine having a longitudinal axis. The turbine airfoil assembly includes an endwall for defining an inner boundary for an axially extending hot working gas path, and an airfoil extending radially outwardly from the endwall. The airfoil has an outer wall comprising a pressure sidewall and a suction sidewall joined together at chordally spaced apart leading and trailing edges of the airfoil. An airfoil mean line is defined extending chordally and located centrally between the pressure and suction sidewalls. Airfoil exit angles are defined at the airfoil trailing edge that are substantially in accordance with exit angle values, $\beta$, set forth in one of Tables 1, 3, 5 and 7, where the exit angle values are generally defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis. Each exit angle value is defined with respect to a distance from the endwall corresponding to a Z value that is a percentage of the total span of the airfoil from the endwall, and wherein each airfoil exit angle is within about 1% of a respective value set forth in the Table.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 11 is a perspective view of the vane assembly of FIG. 10;

FIG. 12 is a cross sectional plan view of an airfoil of the vane assembly of FIG. 10;

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
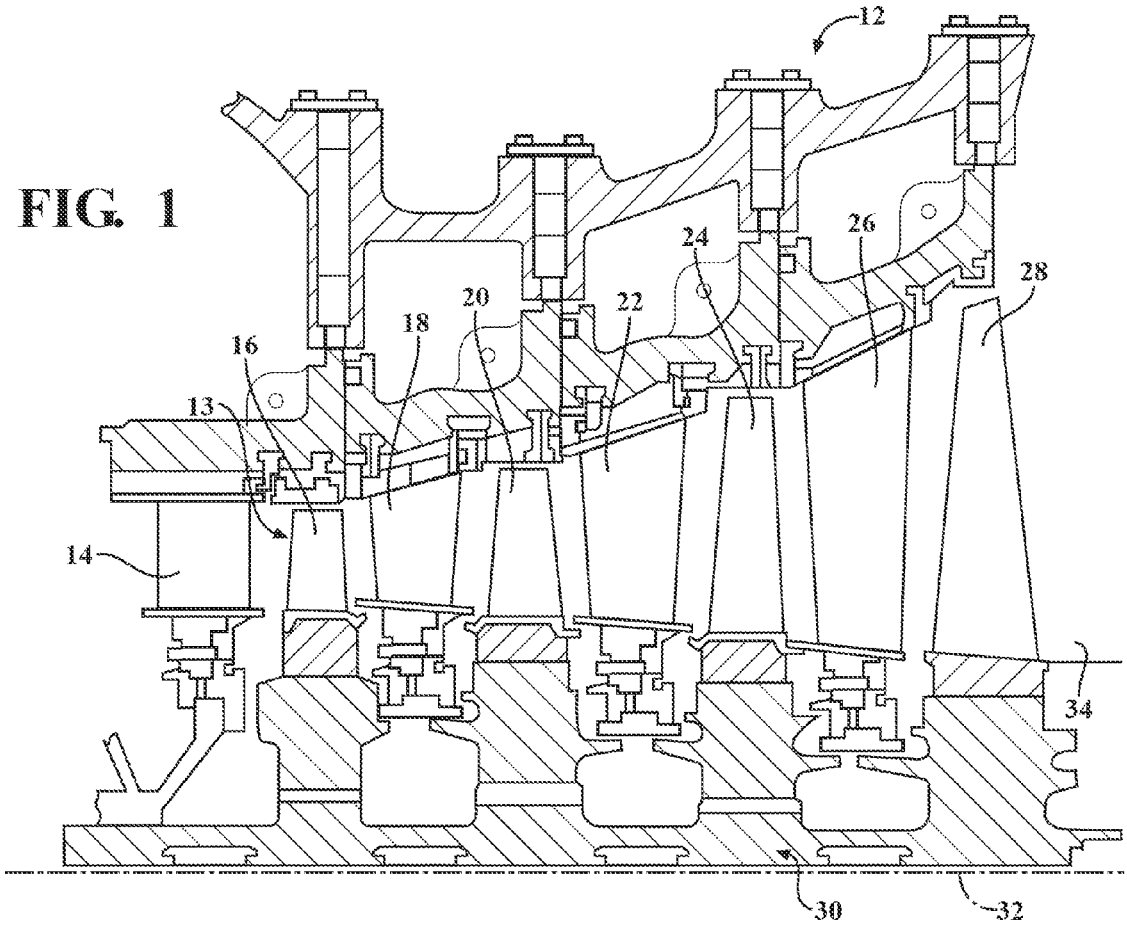
FIG. 1 is a cross sectional view of a turbine section for a gas turbine engine.
Figure 2:
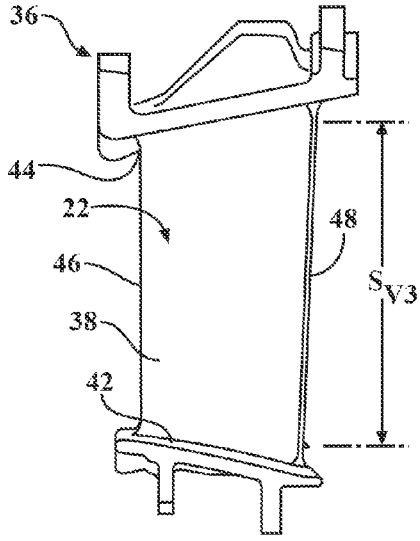
FIG. 2 is a side elevational view of a third stage vane assembly formed in accordance with aspects of the present invention.
Figure 3:
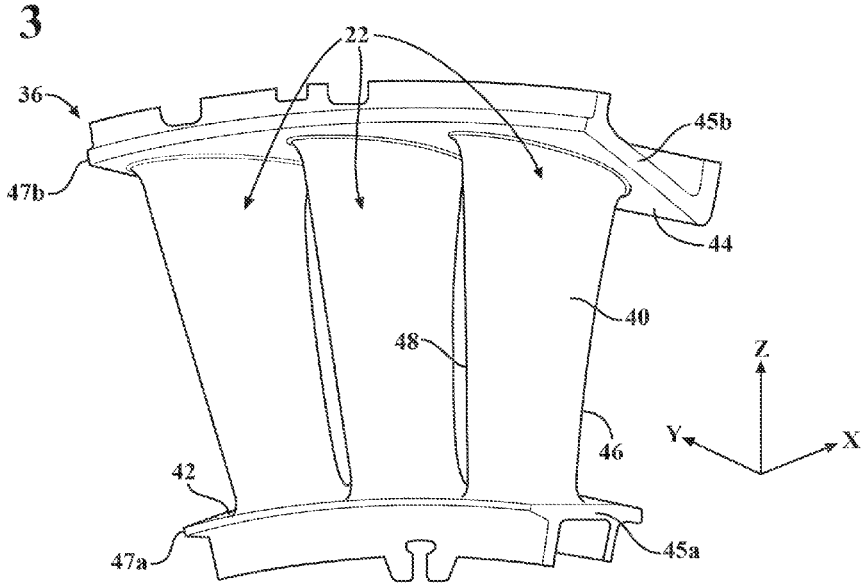
FIG. 3 is a perspective view of the vane assembly of FIG. 2.

Referring to FIG. 1, a turbine section 12 for a gas turbine engine is illustrated. The turbine section 12 comprises alternating rows of stationary vanes and rotating blades extending radially into an axial flow path 13 extending through the turbine section 12. In particular, the turbine section 12 includes a first stage formed by a first row of stationary vanes 14 and a first row of rotating blades 16, a second stage formed by a second row of stationary vanes 18 and a second row of rotating blades 20, a third stage formed by a third row of stationary vanes 22 and a third row of rotating blades 24, and a fourth stage formed by a fourth row of stationary vanes 26 and a fourth row of rotating blades 28.

During operation of the gas turbine engine, a compressor (not shown) of the engine supplies compressed air to a combustor (not shown) where the air is mixed with a fuel, and the mixture is ignited creating combustion products comprising a hot working gas defining a working fluid. The working fluid travels through the stages of the turbine section 12 where it expands and causes the blades 16, 20, 24, 28 to rotate. The overall work output from the turbine section 12 is distributed into all of the stages, where the stationary vanes 14, 18, 22, 26 are provided for accelerating the gas flow and turn the gas flow to feed into the respective downstream blades 16, 20, 24, 28 to generate torque on a rotor 30 supporting the blades 16, 20, 24, 28, producing a rotational output about a longitudinal axis 32 of the engine, such as to drive the upstream compressor.

The flow turning occurring at each rotating blade 16, 20, 24, 28 creates a reaction force on the blade 16, 20, 24, 28 to produce the output torque. The work split between the stages may be controlled by the angular changes in flow direction effected by each of the vanes 14, 18, 22, 26 and respective blades 16, 20, 24, 28, which work split has an effect on the efficiency of the engine. In accordance with an aspect of the invention, a design for the third and fourth stage vanes 22, 26 and blades 24, 28 is provided to optimize or improve the flow angle changes through the third and fourth stages. Specifically, the design of the third and fourth stage vanes 22, 26 and blades 24, 28, as described below, provide a radial variation in inlet and exit flow angles to produce optimized flow profiles into an exhaust diffuser 34 downstream from the turbine section 12. Optimized flow profiles through the third and fourth stages of the turbine section 12 may facilitate a reduction in the average Mach number for flows exiting the fourth stage vanes 26, with an associated improvement in engine efficiency, since flow loss tends to be proportional to the square of the Mach number.

Figure 4:
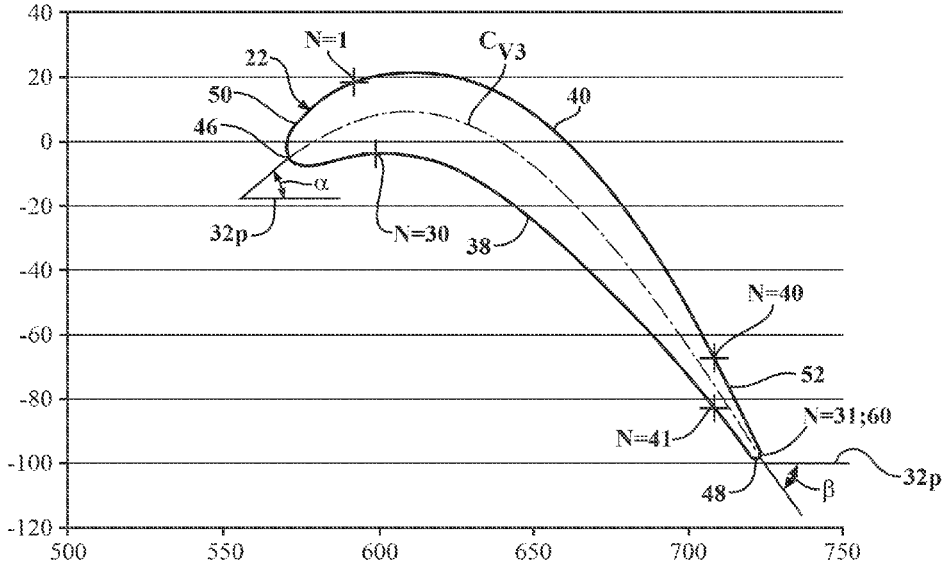
FIG. 4 is a cross sectional plan view of an airfoil of the vane assembly of FIG. 2.
Figure 5:
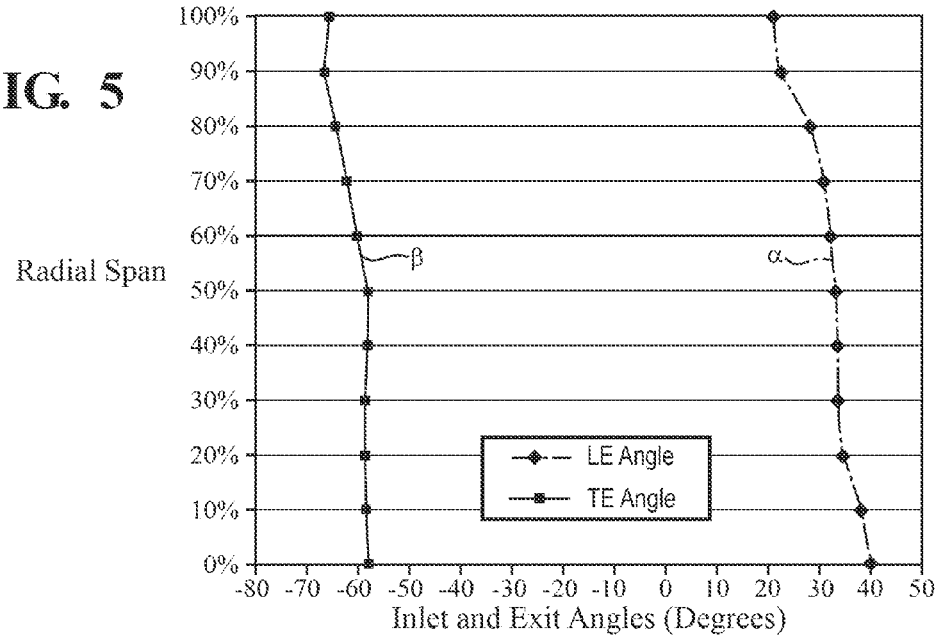
FIG. 5 is a graphical illustration of entry and exit angles defined along the span of an airfoil for the vane assembly of FIG. 2.
Figure 6:
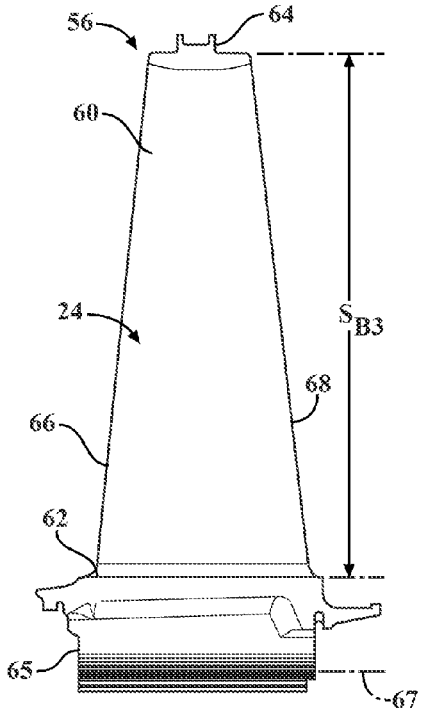
FIG. 6 is a side elevational view of a third stage blade assembly formed in accordance with aspects of the present invention.
Figure 7:
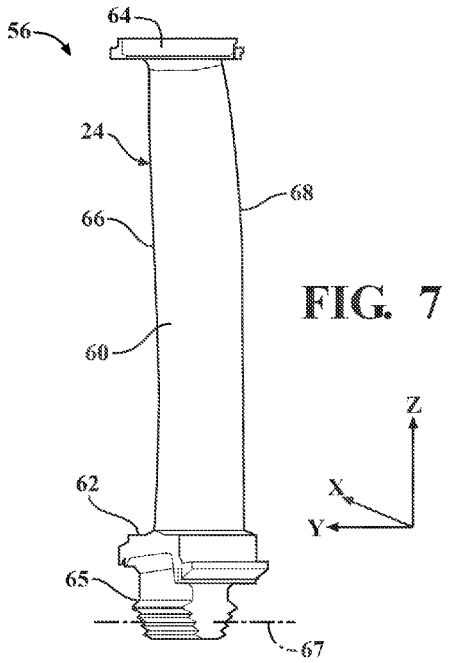
FIG. 7 is a perspective view of the blade assembly of FIG. 6.

Referring to FIGS. 2-5, a configuration for the third stage vane 22 is described. In particular, referring initially to FIGS. 2 and 3, a third stage vane airfoil structure 36 is shown including three of the airfoils or vanes 22 adapted to be supported to extend radially across the flow path 13. Referring additionally to FIG. 4, the vanes 22 each include an outer wall comprising a generally concave pressure sidewall 38, and include an opposing generally convex suction sidewall 40. The sidewalls 38, 40 extend radially between an inner diameter endwall 42 and an outer diameter endwall 44, and extend generally axially in a chordal direction between a leading edge 46 and a trailing edge 48 of each of the vanes 22. The endwalls 42, 44 are located at opposing ends of the vanes 22 and are positioned at locations where they form a boundary, i.e., inner and outer boundaries, defining a portion of the flow path 13 for the working fluid. Opposing radially inner matefaces 45*a*, 47*a* and radially outer matefaces 45*b*, 47*b* are defined by the respective inner and outer diameter endwalls 42, 44 of the airfoil structure 36.

FIG. 4 illustrates a cross section of one of the vanes 22 at a radial location of about 50% of the span, $S_{V3}$ (FIG. 2), along the Z axis of a Cartesian coordinate system that has orthogonally related X, Y and Z axes (FIG. 3), where the Z axis extends perpendicular to a plane normal to a radius from the longitudinal axis 32 of the engine i.e., normal to a plane containing the X and Y axes, and generally parallel to the span, $S_{V3}$, of the airfoil for the vane 22. It should be noted that the matefaces 45*a*, 47*a* and 45*b*, 47*b* are shown herein as extending at an angle relative to the direction of the longitudinal axis 32.

The cross section of FIG. 4 lies in the X-Y plane. As seen in FIG. 4, the vane 22 defines an airfoil mean line, $C_{V3}$, comprising a chordally extending line at a central or mean location between the pressure and suction sidewalls 38, 40. At the leading edge 46, a blade metal angle of each of the surfaces of the pressure and suction sides 38, 40 adjacent to the leading edge 46 is provided for directing incoming flow to the vane 22 and defines an airfoil leading edge (LE) or inlet angle, α. The airfoil inlet angle, α, is defined as an angle between a line $32_P$ parallel to the longitudinal axis 32 and an extension of the airfoil mean line, $C_{V3}$, at the leading edge 46, i.e., tangential to the line $C_{V3}$ at the airfoil leading edge 46.

At the trailing edge 48, a blade metal angle of the surfaces of the pressure and suction sides 38, 40 adjacent to the trailing edge 48 is provided for directing flow exiting from the vane 22 and defines an airfoil trailing edge (TE) or exit angle, β. The airfoil exit angle, β, is defined as an angle between a line $32_P$ parallel to the longitudinal axis 32 and an extension of the airfoil mean line, $C_{V3}$, at the trailing edge 48, i.e., tangential to the line $C_{V3}$ at the airfoil trailing edge 48.

The inlet angles, α, and exit angles, β, for the airfoil of the vane 22 are as described in Table 1 below. The Z coordinate locations are presented as a percentage of the total span of the vane 22. The values for the inlet angles, α, and exit angles, β, are defined at selected Z locations spaced at 10% increments along the span of the vane 22, where 0% is located adjacent to the inner endwall 42 and 100% is located adjacent to the outer endwall 44. The inlet angles, α, and exit angles, β, are further graphically illustrated in FIG. 5.

TABLE 1

| Z - Span % | α - LE Angle | β - TE Angle | Δ - Delta Value |
|---|---|---|---|
| 0 | 40.10 | −57.86 | 97.96 |
| 10 | 38.16 | −58.12 | 96.28 |
| 20 | 35.01 | −58.48 | 93.49 |
| 30 | 33.66 | −58.31 | 91.97 |
| 40 | 33.58 | −58.00 | 91.58 |
| 50 | 33.51 | −57.91 | 91.42 |
| 60 | 32.35 | −60.01 | 92.36 |
| 70 | 31.01 | −62.12 | 93.13 |
| 80 | 28.28 | −64.26 | 92.54 |
| 90 | 22.61 | −66.44 | 89.05 |
| 100 | 21.00 | −65.34 | 86.34 |

Table 1 further describes a predetermined difference between each pair of the airfoil inlet and exit angles, at any given span location, as defined by a delta value, Δ, presented as the absolute value of the difference between the leading edge or inlet angle, α, and the trailing edge or exit angle, β. The delta value, Δ, is representative of an amount of flow turning that occurs from the inlet to the exit of the third stage vane 22. The inlet angle, α, is selected with reference to the flow direction coming from the second row blades 20, and the exit angle, β, is preferably selected to provide a predetermined direction of flow into the third stage blades 24.

It should be noted that the difference between any pair of airfoil inlet and exit angles, α, β, at any given span location, $S_{V3}$, may vary from the delta value, Δ, listed in Table 1 due to various conditions, such as manufacturing tolerances or other conditions. In particular, the difference between the airfoil inlet and exit angles, α, β, at any given span location, $S_{V3}$, may generally vary from the delta value, Δ, listed in Table 1 by at most 5%. More preferably, the difference between the airfoil inlet and exit angles, α, β, at any given span location, $S_{V3}$, may vary from the delta value, Δ, listed in Table 1 by at most 3%. Most preferably, the difference between the airfoil inlet and exit angles, α, β, at any given span location, $S_{V3}$, may vary from the delta value, Δ, listed in Table 1 by at most 1%. In other words, the amount of flow turning may vary slightly from the given predetermined delta value, Δ, within a percentage range of, for example, 5% to 1%. However, an optimal configuration for the airfoil of the vane 22 is believed to be provided by a configuration having a minimal variation from the given predetermined delta values, Δ.

Portions of sections of the airfoil for the vane 22 are described below in Table 2 (end of specification), generally located at the noted selected Z or spanwise locations described above for Table 1. It may be noted that the description provided by Table 2 comprises an exemplary, non-limiting description of leading edge and trailing edge airfoil sections forming the inlet and exit angles α, β.

The portions of the airfoil for the vane 22 described in Table 2 are provided with reference to a Cartesian coordinate system, as discussed above, that has orthogonally related X, Y and Z axes (FIG. 3) with the Z axis extending perpendicular to a plane normal to a radius from the centerline of the turbine rotor, i.e., normal to a plane containing the X and Y values, and generally parallel to the span, $S_{V3}$, of the airfoil for the vane 22. The Z coordinate values in Table 2 have an origin or zero value at a radial location coinciding with the X, Y plane at the radially innermost aerodynamic section of the airfoil for the vane 22, i.e., adjacent the inner endwall 42, and are presented as a percentage of the total span of the vane 22. The X axis lies parallel to the longitudinal axis 32, and the Y axis extends in the circumferential direction of the engine. Exemplary profiles for leading edge sections and trailing edge sections of the airfoil for the vane 22 are defined by the X and Y coordinate values, located at point locations, N, at selected locations in the Z direction normal to the X, Y plane. Each leading edge and trailing edge profile section at each selected radial Z location is determined by connecting the X and Y values at the point locations, N, with smooth, continuous arcs. Similarly, the surface profiles at the various surface locations between the distances Z are connected smoothly to one another to form the leading edge section and trailing edge section of the airfoil.

The leading edge section 50 at each Z location is described by successive data points N=1 to N=30 defining the leading edge section 50 as extending from the suction sidewall 40, around the leading edge 46, and along a portion of the pressure sidewall 38.

The trailing edge section 52 at each Z location is described in two parts. In particular, a first part of the trailing edge section 52 is described along the suction sidewall 40 by data points N=31 to N=40, and a second part of the trailing edge section 52 is described along the pressure sidewall 38 by data points N=41 to N=60. It may be noted that the data points N=31 and N=60 have the same X and Y coordinate values for continuity in presenting the data in Table 2, and are both located at or near the trailing edge 48 of the vane 22.

Figure 8:
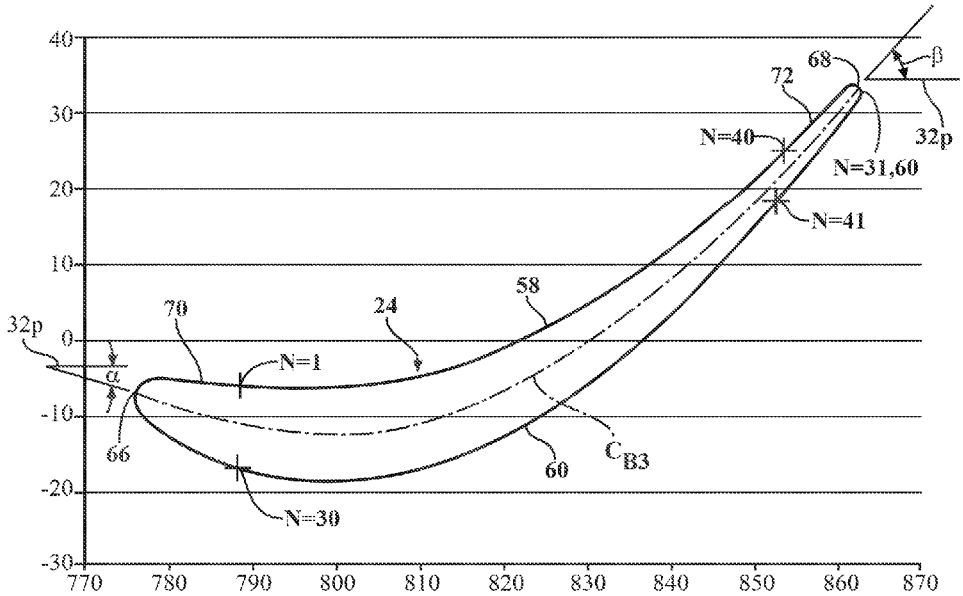
FIG. 8 is a cross sectional plan view of an airfoil of the blade assembly of FIG. 6.
Figure 9:
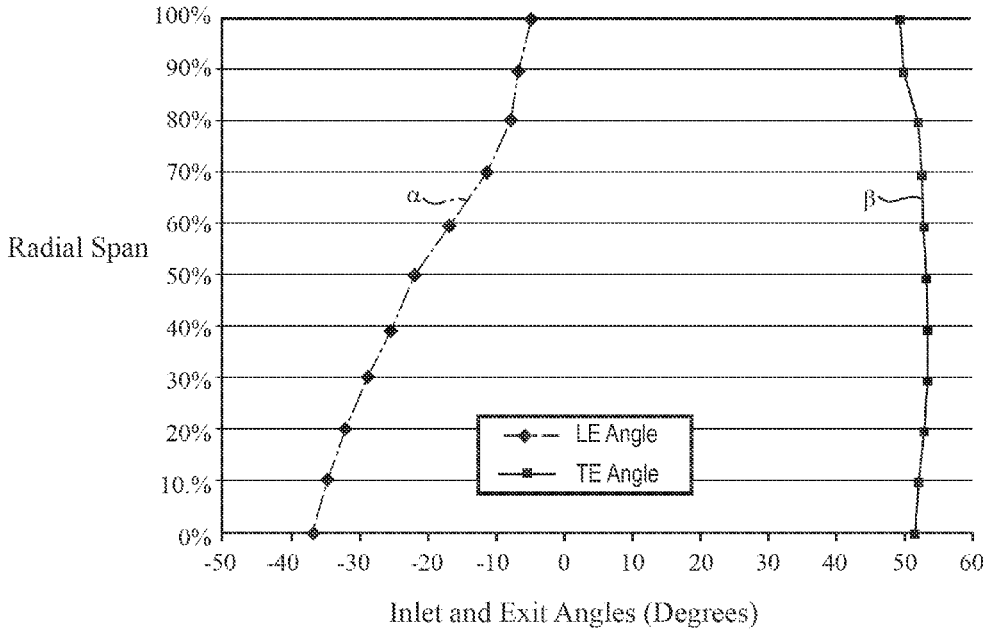
FIG. 9 is a graphical illustration of entry and exit angles defined along the span of an airfoil for the blade assembly of FIG. 6.
Figure 10:
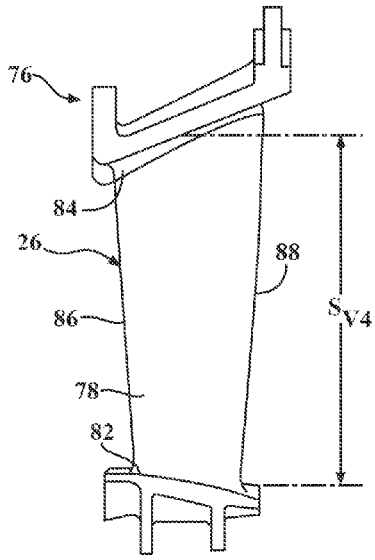
FIG. 10 is a side elevational view of a fourth stage vane assembly formed in accordance with aspects of the present invention.
Figure 13:
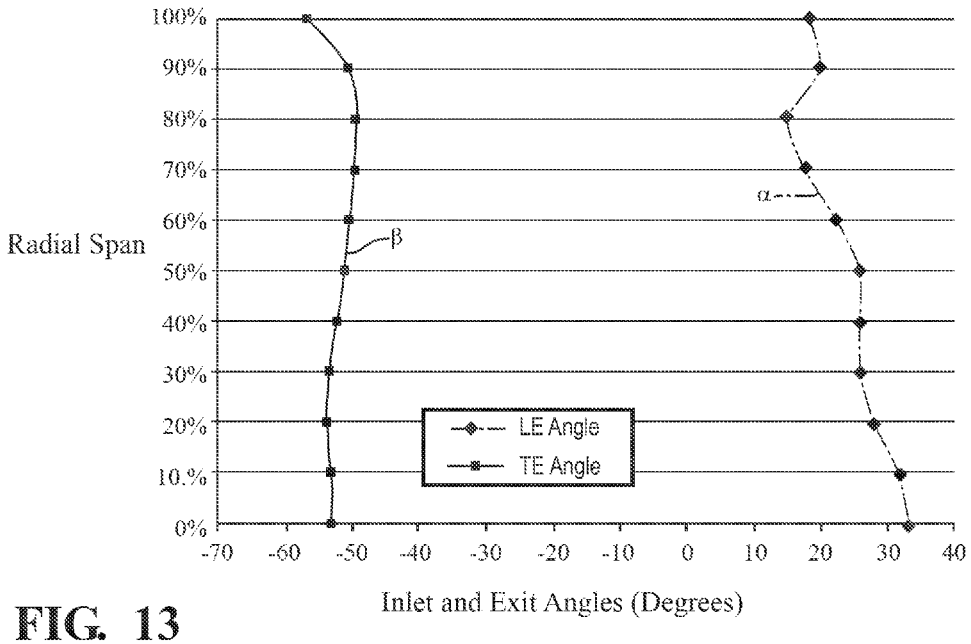
FIG. 13 is a graphical illustration of entry and exit angles defined along the span of an airfoil for the vane assembly of FIG. 10.
Figure 14:
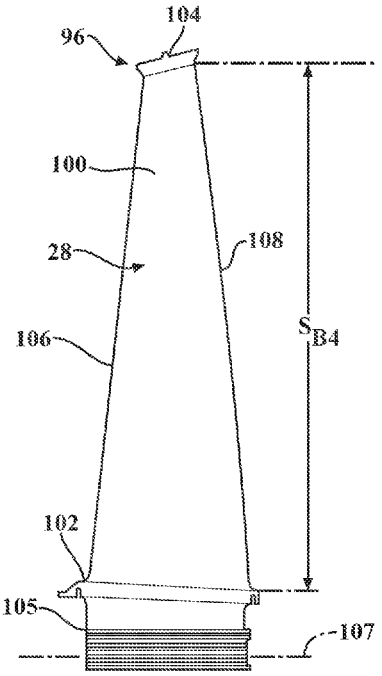
FIG. 14 is a side elevational view of a fourth stage blade assembly formed in accordance with aspects of the present invention.
Figure 15:
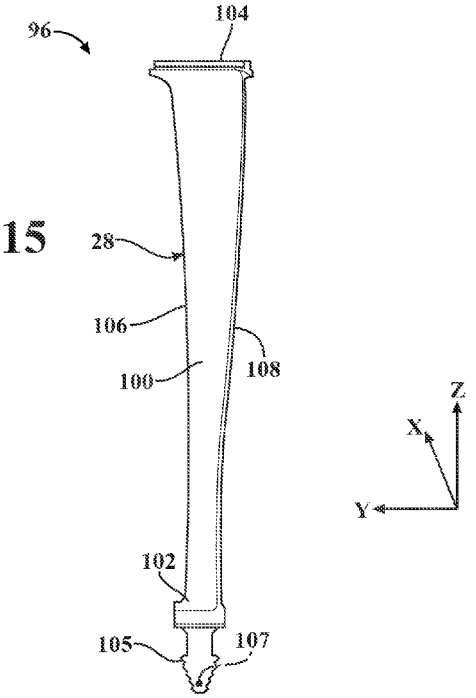
FIG. 15 is a perspective view of the blade assembly of FIG. 14.

Referring to FIGS. 6-9, a configuration for the third stage blade 24 is described. In particular, referring initially to FIGS. 6 and 7, a third stage blade airfoil structure 56 is shown including one of the airfoils or blades 24 adapted to be supported to extend radially across the flow path 13. Referring additionally to FIG. 8, the blades 24 each include an outer wall comprising a generally concave pressure sidewall 58, and include an opposing generally convex suction sidewall 60. The sidewalls 58, 60 extend radially outwardly from an inner diameter endwall 62 to a blade tip 64, and extend generally axially in a chordal direction between a leading edge 66 and a trailing edge 68 of each of the blades 24. A blade root is defined by a dovetail 65 extending radially inwardly from the endwall 62 for mounting the blade 24 to the rotor 30. The endwall 62 is positioned at a location where it forms a boundary, i.e., an inner boundary, defining a portion of the flow path 13 for the working fluid.

FIG. 8 illustrates a cross section of the blade 24 at a radial location of about 50% of the span, $S_{B3}$ (FIG. 6), along the Z axis of a Cartesian coordinate system that has orthogonally related X, Y and Z axes (FIG. 7), where the Z axis extends perpendicular to a plane normal to a radius from the longitudinal axis 32 of the engine i.e., normal to a plane containing the X and Y axes, and generally parallel to the span, $S_{B3}$, of the airfoil for the blade 24. It should be noted that a central lengthwise axis 67 of the dovetail 65 is shown herein as extending at an angle relative to the direction of the longitudinal axis 32.

The cross section of FIG. 8 lies in the X-Y plane. As seen in FIG. 8, the blade 24 defines an airfoil mean line, $C_{B3}$, comprising a chordally extending line at a central or mean location between the pressure and suction sidewalls 58, 60. At the leading edge 66, a blade metal angle of each of the surfaces of the pressure and suction sides 58, 60 adjacent to the leading edge 66 is provided for directing incoming flow to the blade 24 and defines an airfoil leading edge (LE) or inlet angle, α. The airfoil inlet angle, α, is defined as an angle between a line $\mathbf{32}_P$ parallel to the longitudinal axis 32 and an extension of the airfoil mean line, $C_{B3}$, at the leading edge 66, i.e., tangential to the line $C_{B3}$ at the airfoil leading edge 66.

At the trailing edge 68, a blade metal angle of the surfaces of the pressure and suction sides 58, 60 adjacent to the trailing edge 68 is provided for directing flow exiting from the blade 24 and defines an airfoil trailing edge (TE) or exit angle, β. The airfoil exit angle, α, is defined as an angle between a line $\mathbf{32}_P$ parallel to the longitudinal axis 32 and an extension of the airfoil mean line, $C_{B3}$, at the trailing edge 68, i.e., tangential to the line $C_{B3}$ at the airfoil trailing edge 68.

The inlet angles, α, and exit angles, β, for the airfoil of the blade 24 are as described in Table 3 below. The Z coordinate locations are presented as a percentage of the total span of the blade 24. The values for the inlet angles, α, and exit angles, β, are defined at selected locations spaced at 10% increments along the span of the blade 24, where 0% is located adjacent to the inner endwall 62 and 100% is located adjacent to the blade tip 64. The inlet angles, α, and exit angles, β, are further graphically illustrated in FIG. 9.

TABLE 3

| Z - Span % | α - LE Angle | β - TE Angle | Δ - Delta Value |
|---|---|---|---|
| 0 | −36.65 | 51.98 | 88.63 |
| 10 | −34.53 | 52.57 | 87.10 |
| 20 | −31.93 | 53.34 | 85.27 |
| 30 | −28.72 | 53.68 | 82.40 |
| 40 | −25.24 | 53.61 | 78.85 |
| 50 | −21.76 | 53.54 | 75.30 |
| 60 | −16.64 | 53.26 | 69.90 |
| 70 | −11.48 | 52.88 | 64.36 |
| 80 | −7.86 | 52.46 | 60.32 |
| 90 | −6.65 | 50.34 | 56.99 |
| 100 | −4.56 | 49.84 | 54.40 |

Table 3 further describes a predetermined difference between each pair of the airfoil inlet and exit angles, at any given span location, as defined by a delta value, Δ, presented as the absolute value of the difference between the leading edge or inlet angle, α, and the trailing edge or exit angle, β. The delta value, Δ, is representative of a change of direction of the flow between the leading edge 66 and trailing edge 68, where it may be understood that the amount of work extracted from the working gas is related to the difference between the inlet angle, α, and exit angle, β, of the flow. For example, increasing the delta value, Δ, may increase the amount of work extracted from the flow.

It should be noted that the difference between any pair of airfoil inlet and exit angles, α, β, at any given span location, $S_{B3}$, may vary from the delta value, Δ, listed in Table 3 due to various conditions, such as manufacturing tolerances or other conditions. In particular, the difference between the airfoil inlet and exit angles, α, β, at any given span location, $S_{B3}$, may generally vary from the delta value, Δ, listed in Table 3 by at most 5%. More preferably, the difference between the airfoil inlet and exit angles, α, β, at any given span location, $S_{B3}$, may vary from the delta value, Δ, listed in Table 3 by at most 3%. Most preferably, the difference between the airfoil inlet and exit angles, α, β, at any given span location, $S_{B3}$, may vary from the delta value, Δ, listed in Table 3 by at most 1%. In other words, the amount of flow turning may vary slightly from the given predetermined delta value, Δ, within a percentage range of, for example, 5% to 1%. However, an optimal configuration for the airfoil of the blade 24 is believed to be provided by a configuration having a minimal variation from the given predetermined delta values, Δ.

Portions of sections of the airfoil for the blade 24 are described below in Table 4 (end of specification), generally located at the noted selected Z or spanwise locations described above for Table 3. It may be noted that the description provided by Table 4 comprises an exemplary, non-limiting description of leading edge and trailing edge airfoil sections forming the inlet and exit angles α, β.

The portions of the airfoil for the blade 24 described in Table 4 are provided with reference to a Cartesian coordinate system, as discussed above, that has orthogonally related X, Y and Z axes (FIG. 7) with the Z axis extending perpendicular to a plane normal to a radius from the centerline of the turbine rotor, i.e., normal to a plane containing the X and Y values, and generally parallel to the span, $S_{B3}$, of the airfoil for the blade 24. The Z coordinate values in Table 4 have an origin or zero value at a radial location coinciding with the X, Y plane at the radially innermost aerodynamic section of the airfoil for the blade 24, i.e., adjacent the inner endwall 62, and are presented as a percentage of the total span of the blade 24. The X axis lies parallel to the longitudinal axis 32, and the Y axis extends in the circumferential direction of the engine. Exemplary profiles for leading edge sections and trailing edge sections of the airfoil for the blade 24 are defined by the X and Y coordinate values, located at point locations, N, at selected locations in the Z direction normal to the X, Y plane. Each leading edge and trailing edge profile section at each selected radial Z location is determined by connecting the X and Y values at the point locations, N, with smooth, continuous arcs. Similarly, the surface profiles at the various surface locations between the distances Z are connected smoothly to one another to form the leading edge section and trailing edge section of the airfoil.

The leading edge section 70 at each Z location is described by successive data points N=1 to N=30 defining the leading edge section 70 as extending from the pressure sidewall 58, around the leading edge 66, and along a portion of the suction sidewall 60.

The trailing edge section 72 at each Z location is described in two parts. In particular, a first part of the trailing edge section 72 is described along the pressure sidewall 58 by data points N=31 to N=40, and a second part of the trailing edge section 52 is described along the suction sidewall 60 by data points N=41 to N=60. It may be noted that the data points N=31 and N=60 have the same X and Y coordinate values for continuity in presenting the data in Table 4, and are both located at or near the trailing edge 68 of the blade 24.

Referring to FIGS. 10-13, a configuration for the fourth stage vane 26 is described. In particular, referring initially to FIGS. 10 and 11, a fourth stage vane airfoil structure 76 is shown including four of the airfoils or vanes 26 adapted to be supported to extend radially across the flow path 13. Referring additionally to FIG. 12, the vanes 26 each include an outer wall comprising a generally concave pressure sidewall 78, and include an opposing generally convex suction sidewall 80. The sidewalls 78, 80 extend radially between an inner diameter endwall 82 and an outer diameter endwall 84, and extend generally axially in a chordal direction between a leading edge 86 and a trailing edge 88 of each of the vanes 26. The endwalls 82, 84 are located at opposing ends of the vanes 26 and are positioned at locations where they form a boundary, i.e., inner and outer boundaries, defining a portion of the flow path 13 for the working fluid. Opposing radially inner matefaces 85*a*, 87*a* and radially outer matefaces 85*b*, 87*b* are defined by the respective inner and outer diameter endwalls 82, 84 of the airfoil structure 76.

FIG. 12 illustrates a cross section of one of the vanes 26 at a radial location of about 50% of the span, $S_{V4}$ (FIG. 10), along the Z axis of a Cartesian coordinate system that has orthogonally related X, Y and Z axes (FIG. 11), where the Z axis extends perpendicular to a plane normal to a radius from the longitudinal axis 32 of the engine i.e., normal to a plane containing the X and Y axes, and generally parallel to the span, $S_{V4}$, of the airfoil for the vane 26. It should be noted that the matefaces 85*a*, 87*a* and 85*b*, 87*b* are shown herein as extending at an angle relative to the direction of the longitudinal axis 32.

The cross section of FIG. 12 lies in the X-Y plane. As seen in FIG. 12, the vane 26 defines an airfoil mean line, $C_{V4}$, comprising a chordally extending line at a central or mean location between the pressure and suction sidewalls 78, 80. At the leading edge 86, a blade metal angle of each of the surfaces of the pressure and suction sides 78, 80 adjacent to the leading edge 86 is provided for directing incoming flow to the vane 26 and defines an airfoil leading edge (LE) or inlet angle, α. The airfoil inlet angle, α, is defined as an angle between a line $32_P$ parallel to the longitudinal axis 32 and an extension of the airfoil mean line, $C_{V4}$, at the leading edge 86, i.e., tangential to the line $C_{V4}$ at the airfoil leading edge 86.

At the trailing edge 88, a blade metal angle of the surfaces of the pressure and suction sides 78, 80 adjacent to the trailing edge 88 is provided for directing flow exiting from the vane 26 and defines an airfoil trailing edge (TE) or exit angle, β. The airfoil exit angle, β, is defined as an angle between a line $32_P$ parallel to the longitudinal axis 32 and an extension of the airfoil mean line, $C_{V4}$, at the trailing edge 88, i.e., tangential to the line $C_{V4}$ at the airfoil trailing edge 88.

The inlet angles, α, and exit angles, β, for the airfoil of the vane 26 are as described in Table 5 below. The Z coordinate locations are presented as a percentage of the total span of the vane 26. The values for the inlet angles, α, and exit angles, β, are defined at selected locations spaced at 10% increments along the span of the vane 26, where 0% is located adjacent to the inner endwall 82 and 100% is located adjacent to the outer endwall 84. The inlet angles, α, and exit angles, β, are further graphically illustrated in FIG. 13.

TABLE 5

| Z - Span % | α - LE Angle | β - TE Angle | Δ - Delta Value |
|---|---|---|---|
| 0 | 33.41 | −53.19 | 86.60 |
| 10 | 31.92 | −53.03 | 84.95 |
| 20 | 28.03 | −53.51 | 81.54 |
| 30 | 26.00 | −53.25 | 79.25 |
| 40 | 26.01 | −52.10 | 78.11 |
| 50 | 26.02 | −50.95 | 76.97 |
| 60 | 22.61 | −50.09 | 72.70 |
| 70 | 17.99 | −49.26 | 67.25 |
| 80 | 15.22 | −49.04 | 64.26 |
| 90 | 20.19 | −50.28 | 70.47 |
| 100 | 18.51 | −56.65 | 75.16 |

Table 5 further describes a predetermined difference between each pair of the airfoil inlet and exit angles, at any given span location, as defined by a delta value, Δ, presented as the absolute value of the difference between the leading edge or inlet angle, α, and the trailing edge or exit angle, β. The delta value, Δ, is representative of an amount of flow turning that occurs from the inlet to the exit of the fourth stage vane 26. The inlet angle, α, is selected with reference to the flow direction coming from the third row blades 24, and the exit angle, β, is preferably selected to provide a predetermined direction of flow into the fourth stage blades 28.

It should be noted that the difference between any pair of airfoil inlet and exit angles, α, β, at any given span location, $S_{V4}$, may vary from the delta value, Δ, listed in Table 5 due to various conditions, such as manufacturing tolerances or other conditions. In particular, the difference between the airfoil inlet and exit angles, α, β, at any given span location, $S_{V4}$, may generally vary from the delta value, Δ, listed in Table 5 by at most 5%. More preferably, the difference between the airfoil inlet and exit angles, α, β, at any given span location, $S_{V4}$, may vary from the delta value, Δ, listed in Table 5 by at most 3%. Most preferably, the difference between the airfoil inlet and exit angles, α, β, at any given span location, $S_{V4}$, may vary from the delta value, Δ, listed in Table 5 by at most 1%. In other words, the amount of flow turning may vary slightly from the given predetermined delta value, Δ, within a percentage range of, for example, 5% to 1%. However, an optimal configuration for the airfoil of the vane 26 is believed to be provided by a configuration having a minimal variation from the given predetermined delta values, Δ.

Portions of sections of the airfoil for the vane 26 are described below in Table 6 (end of specification), generally located at the noted selected Z or spanwise locations described above for Table 5. It may be noted that the description provided by Table 6 comprises an exemplary, non-limiting description of leading edge and trailing edge airfoil sections forming the inlet and exit angles α, β.

The portions of the airfoil for the vane 26 described in Table 6 are provided with reference to a Cartesian coordinate system, as discussed above, that has orthogonally related X, Y and Z axes (FIG. 11) with the Z axis extending perpendicular to a plane normal to a radius from the centerline of the turbine rotor, i.e., normal to a plane containing the X and Y values, and generally parallel to the span, $S_{V4}$, of the airfoil for the vane 26. The Z coordinate values in Table 6 have an origin or zero value at a radial location coinciding with the X, Y plane at the radially innermost aerodynamic section of the airfoil for the vane 26, i.e., adjacent the inner endwall 82, and are presented as a percentage of the total span of the vane 26, and are presented as a percentage of the total span of the blade 28. The X axis lies parallel to the longitudinal axis 32, and the Y axis extends in the circumferential direction of the engine. Exemplary profiles for leading edge sections and trailing edge sections of the airfoil for the vane 26 are defined by the X and Y coordinate values, located at point locations, N, at selected locations in the Z direction normal to the X, Y plane. Each leading edge and trailing edge profile section at each selected radial Z location is determined by connecting the X and Y values at the point locations, N, with smooth, continuous arcs. Similarly, the surface profiles at the various surface locations between the distances Z are connected smoothly to one another to form the leading edge section and trailing edge section of the airfoil.

The leading edge section 90 at each Z location is described by successive data points N=1 to N=30 defining the leading edge section 90 as extending from the suction sidewall 80, around the leading edge 86, and along a portion of the pressure sidewall 78.

The trailing edge section 92 at each Z location is described in two parts. In particular, a first part of the trailing edge section 92 is described along the suction sidewall 80 by data points N=31 to N=40, and a second part of the trailing edge section 92 is described along the pressure sidewall 78 by data points N=41 to N=60. It may be noted that the data points N=31 and N=60 have the same X and Y coordinate values for continuity in presenting the data in Table 6, and are both located at or near the trailing edge 88 of the vane 26.

Figure 16:
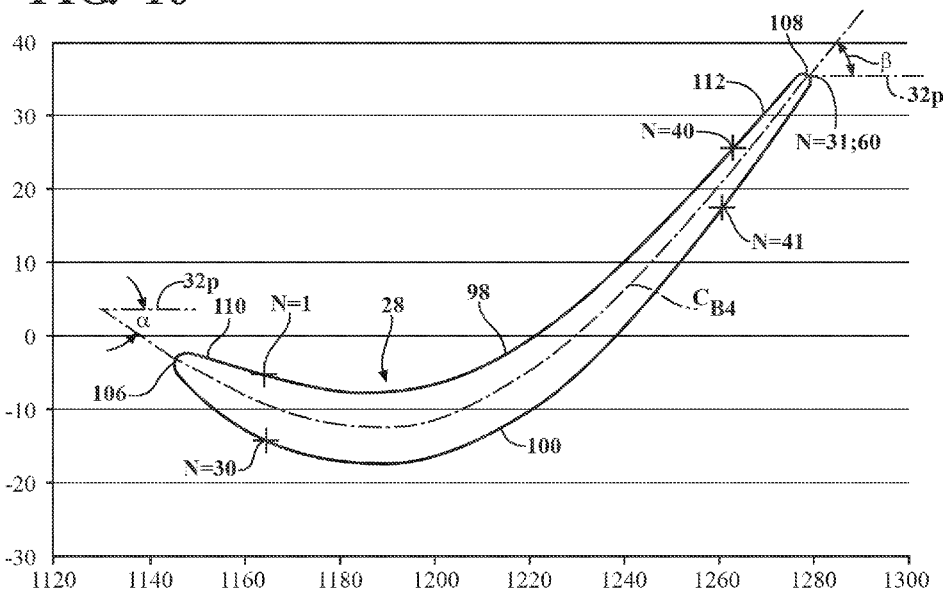
FIG. 16 is a cross sectional plan view of an airfoil of the blade assembly of FIG. 14.
Figure 17:
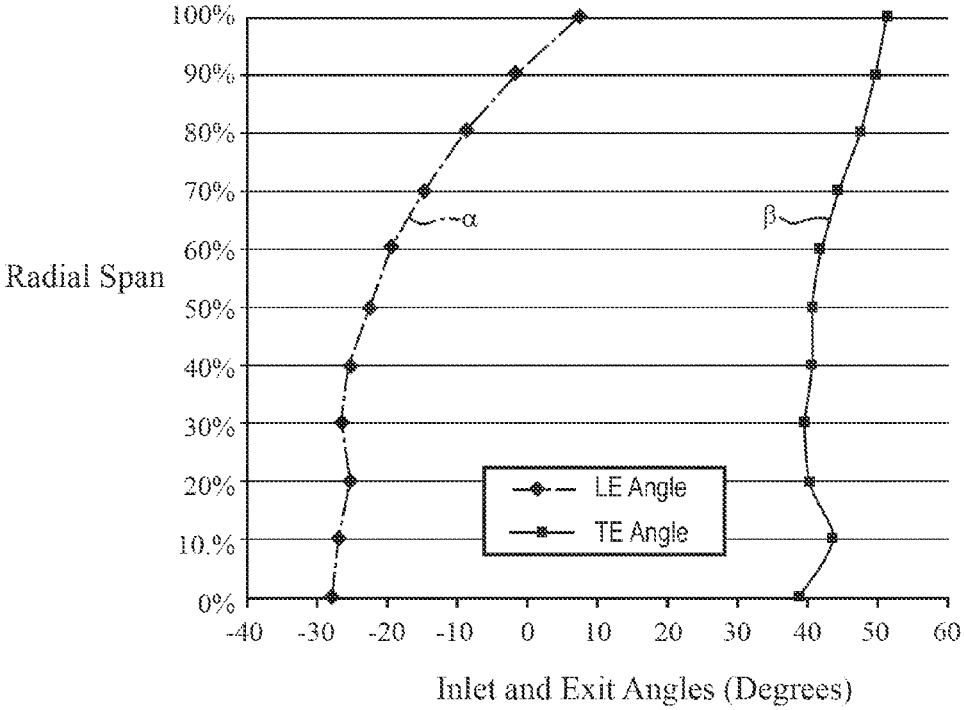
FIG. 17 is a graphical illustration of entry and exit angles defined along the span of an airfoil for the blade assembly of FIG. 14.

Referring to FIGS. 14-17, a configuration for the fourth stage blade 28 is described. In particular, referring initially to FIGS. 14 and 15, a fourth stage blade airfoil structure 96 is shown including one of the airfoils or blades 28 adapted to be supported to extend radially across the flow path 13. Referring additionally to FIG. 16, the blades 28 each include an outer wall comprising a generally concave pressure sidewall 98, and include an opposing generally convex suction sidewall 100. The sidewalls 98, 100 extend radially outwardly from an inner diameter endwall 102 to a blade tip 104, and extend generally axially in a chordal direction between a leading edge 106 and a trailing edge 108 of each of the blades 28. A blade root is defined by a dovetail 105 extending radially inwardly from the endwall 102 for mounting the blade 28 to the rotor 30. The endwall 102 is positioned at a location where it forms a boundary, i.e., an inner boundary, defining a portion of the flow path 13 for the working fluid.

FIG. 16 illustrates a cross section of the blade 28 at a radial location of about 50% of the span, $S_{B4}$ (FIG. 14), along the Z axis of a Cartesian coordinate system that has orthogonally related X, Y and Z axes (FIG. 15), where the Z axis extends perpendicular to a plane normal to a radius from the longitudinal axis 32 of the engine i.e., normal to a plane containing the X and Y axes, and generally parallel to the span, $S_{B4}$, of the airfoil for the blade 28. It should be noted that a central lengthwise axis 107 of the dovetail 105 is shown herein as extending at an angle relative to the direction of the longitudinal axis 32.

The cross section of FIG. 16 lies in the X-Y plane. As seen in FIG. 16, the blade 28 defines an airfoil mean line, $C_{B4}$, comprising a chordally extending line at a central or mean location between the pressure and suction sidewalls 98, 100. At the leading edge 106, a blade metal angle of each of the surfaces of the pressure and suction sides 98, 100 adjacent to the leading edge 106 is provided for directing incoming flow to the blade 28 and defines an airfoil leading edge (LE) or inlet angle, α. The airfoil inlet angle, α, is defined as an angle between a line $32_P$ parallel to the longitudinal axis 32 and an extension of the airfoil mean line, $C_{B4}$, at the leading edge 106, i.e., tangential to the line $C_{B4}$ at the airfoil leading edge 106.

At the trailing edge 108, a blade metal angle of the surfaces of the pressure and suction sides 98, 100 adjacent to the trailing edge 108 is provided for directing flow exiting from the blade 28 and defines an airfoil trailing edge (TE) or exit angle, β. The airfoil exit angle, β, is defined as an angle between a line $32_P$ parallel to the longitudinal axis 32 and an extension of the airfoil mean line, $C_{B4}$, at the trailing edge 108, i.e., tangential to the line $C_{B4}$ at the airfoil trailing edge 108.

The inlet angles, α, and exit angles, β, for the airfoil of the blade 28 are as described in Table 7 below. The Z coordinate locations are presented as a percentage of the total span of the blade 28. The values for the inlet angles, α, and exit angles, β, are defined at selected locations spaced at 10% increments along the span of the blade 28, where 0% is located adjacent to the inner endwall 102 and 100% is located adjacent to the blade tip 104. The inlet angles, α, and exit angles, β, are further graphically illustrated in FIG. 17.

TABLE 7

| Z - Span % | α - LE Angle | β - TE Angle | Δ - Delta Value |
|---|---|---|---|
| 0 | −28.00 | 39.00 | 67.00 |
| 10 | −27.15 | 43.66 | 70.81 |
| 20 | −25.18 | 40.17 | 65.35 |
| 30 | −26.54 | 39.65 | 66.19 |
| 40 | −25.46 | 40.56 | 66.02 |
| 50 | −22.80 | 40.83 | 63.63 |
| 60 | −19.17 | 41.93 | 61.10 |
| 70 | −14.48 | 44.50 | 58.98 |
| 80 | −8.66 | 47.56 | 56.22 |
| 90 | −1.59 | 49.68 | 51.27 |
| 100 | 7.88 | 51.42 | 43.54 |

Table 7 further describes a predetermined difference between each pair of the airfoil inlet and exit angles, at any given span location, as defined by a delta value, Δ, presented as the absolute value of the difference between the leading edge or inlet angle, α, and the trailing edge or exit angle, β. The delta value, Δ, is representative of a change of direction of the flow between the leading edge 106 and trailing edge 108, where it may be understood that the amount of work extracted from the working gas is related to the difference between the inlet angle, α, and exit angle, β, of the flow. For example, increasing the delta value, Δ, may increase the amount of work extracted from the flow.

It should be noted that the difference between any pair of airfoil inlet and exit angles, α, β, at any given span location, $S_{B4}$, may vary from the delta value, Δ, listed in Table 7 due to various conditions, such as manufacturing tolerances or other conditions. In particular, the difference between the airfoil inlet and exit angles, α, β, at any given span location, $S_{B4}$, may generally vary from the delta value, Δ, listed in Table 7 by at most 5%. More preferably, the difference between the airfoil inlet and exit angles, α, β, at any given span location, $S_{B4}$, may vary from the delta value, Δ, listed in Table 7 by at most 3%. Most preferably, the difference between the airfoil inlet and exit angles, α, β, at any given span location, $S_{B4}$, may vary from the delta value, Δ, listed in Table 7 by at most 1%. In other words, the amount of flow turning may vary slightly from the given predetermined delta value, Δ, within a percentage range of, for example, 5% to 1%. However, an optimal configuration for the airfoil of the blade 28 is believed to be provided by a configuration having a minimal variation from the given predetermined delta values, Δ.

Portions of sections of the airfoil for the blade 28 are described below in Table 8 (end of specification), generally located at the noted selected Z or spanwise locations described above for Table 7. It may be noted that the description provided by Table 8 comprises an exemplary, non-limiting description of leading edge and trailing edge airfoil sections forming the inlet and exit angles α, β.

The portions of the airfoil for the blade 28 described in Table 8 are provided with reference to a Cartesian coordinate system, as discussed above, that has orthogonally related X, Y and Z axes (FIG. 7) with the Z axis extending perpendicular to a plane normal to a radius from the centerline of the turbine rotor, i.e., normal to a plane containing the X and Y values, and generally parallel to the span, $S_{B4}$, of the airfoil for the blade 28. The Z coordinate values in Table 8 have an origin or zero value at a radial location coinciding with the X, Y plane at the radially innermost aerodynamic section of the airfoil for the blade 28, i.e., adjacent the inner endwall 102. The X axis lies parallel to the longitudinal axis 32, and the Y axis extends in the circumferential direction of the engine. Exemplary profiles for leading edge sections and trailing edge sections of the airfoil for the blade 28 are defined by the X and Y coordinate values, located at point locations, N, at selected locations in the Z direction normal to the X, Y plane. Each leading edge and trailing edge profile section at each selected radial Z location is determined by connecting the X and Y values at the point locations, N, with smooth, continuous arcs. Similarly, the surface profiles at the various surface locations between the distances Z are connected smoothly to one another to form the leading edge section and trailing edge section of the airfoil.

The leading edge section 110 at each Z location is described by successive data points N=1 to N=30 defining the leading edge section 106 as extending from the pressure sidewall 98, around the leading edge 106, and along a portion of the suction sidewall 100.

The trailing edge section 112 at each Z location is described in two parts. In particular, a first part of the trailing edge section 112 is described along the pressure sidewall 98 by data points N=31 to N=40, and a second part of the trailing edge section 112 is described along the suction sidewall 100 by data points N=41 to N=60. It may be noted that the data points N=31 and N=60 have the same X and Y coordinate values for continuity in presenting the data in Table 8, and are both located at or near the trailing edge 108 of the blade 28.

Tables 2, 4, 6 and 8

The tabular values given in Tables 2, 4, 6 and 8 below are in millimeters and represent leading edge section and trailing edge section profiles at ambient, non-operating or non-hot conditions and are for an uncoated airfoil. The sign convention assigns a positive value to the value Z, and positive and negative values for the X and Y coordinate values are determined relative to an origin of the coordinate system, as is typical of a Cartesian coordinate system.

The values presented in Tables 2, 4, 6 and 8 are generated and shown for determining the leading edge and trailing edge profile sections of the airfoil for the vane 22, blade 24, vane 26, and blade 28, respectively. Further, there are typical manufacturing tolerances as well as coatings which are typically accounted for in the actual profile of the airfoil for the vane 22, blade 24, vane 26, and blade 28. Accordingly, the values for the airfoil section profiles given in Tables 2, 4, 6 and 8 correspond to nominal dimensional values for uncoated airfoils. It will therefore be appreciated that typical manufacturing tolerances, i.e., plus or minus values and coating thicknesses, are additive to the X and Y values given in Tables 2, 4, 6 and 8 below. Accordingly, a distance of approximately ±1% of a maximum airfoil height, in a direction normal to any surface location along the leading edge and trailing edge profile sections of the airfoils, defines an airfoil profile envelope for the leading edge and trailing edge profile sections of the airfoils described herein.

The coordinate values given in Tables 2, 4, 6 and 8 below in millimeters provide an exemplary, non-limiting, preferred nominal profile envelope for the leading and trailing edge profile sections of the respective third stage vane 22, third stage blade 24, fourth stage vane 26 and fourth stage blade 28. Further, the average Z value at 100% span for each of the airfoils may be approximately the following values: third stage vane 22=1145 mm; third stage blade 24=1191.7 mm; fourth stage vane 26=1268.5 mm; and fourth stage blade 28=1366.9 mm.

TABLE 2

| N | X | Y |
|---|---|---|
| Third Stage Vane LE and TE at Z = 0% | | |
| 1 | 596.2648 | 26.9033 |
| 2 | 590.7822 | 24.6028 |
| 3 | 586.0492 | 22.0131 |
| 4 | 583.2977 | 20.2043 |
| 5 | 579.7508 | 17.4640 |
| 6 | 577.7539 | 15.6668 |
| 7 | 575.2701 | 13.0861 |
| 8 | 573.4066 | 10.6876 |
| 9 | 572.5051 | 9.2178 |
| 10 | 571.6058 | 7.2832 |
| 11 | 571.2641 | 6.2166 |
| 12 | 571.0638 | 5.1478 |
| 13 | 571.0189 | 4.1549 |
| 14 | 571.1202 | 3.1517 |
| 15 | 571.3854 | 2.1680 |
| 16 | 571.8811 | 1.1281 |
| 17 | 572.4909 | 0.3042 |
| 18 | 573.2425 | −0.3922 |
| 19 | 574.1054 | −0.9375 |
| 20 | 575.1667 | −1.3640 |
| 21 | 576.1508 | −1.5788 |
| 22 | 577.1388 | −1.6479 |
| 23 | 578.1001 | −1.5879 |
| 24 | 579.5191 | −1.3215 |
| 25 | 581.3417 | −0.8171 |
| 26 | 582.7806 | −0.3762 |
| 27 | 585.2828 | 0.4041 |
| 28 | 588.2156 | 1.2934 |
| 29 | 590.4211 | 1.9273 |
| 30 | 594.1185 | 2.8908 |
| 31 | 713.5055 | −69.7089 |
| 32 | 712.6509 | −68.1276 |
| 33 | 711.5355 | −66.0592 |
| 34 | 710.6472 | −64.4097 |
| 35 | 709.0968 | −61.5306 |
| 36 | 707.2812 | −58.1682 |
| 37 | 705.9196 | −55.6607 |
| 38 | 703.6408 | −51.5063 |
| 39 | 701.9556 | −48.4797 |
| 40 | 699.1598 | −43.5661 |
| 41 | 699.2449 | −57.1262 |
| 42 | 701.0559 | −59.1821 |
| 43 | 703.4869 | −62.0163 |
| 44 | 704.9191 | −63.7368 |
| 45 | 706.7917 | −66.0574 |
| 46 | 708.3448 | −68.0553 |
| 47 | 709.2102 | −69.2011 |
| 48 | 710.2644 | −70.6310 |
| 49 | 710.8103 | −71.3872 |
| 50 | 711.1004 | −71.6938 |
| 51 | 711.4806 | −71.9307 |
| 52 | 711.9202 | −72.0576 |
| 53 | 712.3720 | −72.0517 |
| 54 | 712.7844 | −71.9303 |
| 55 | 713.1268 | −71.7171 |
| 56 | 713.4173 | −71.4008 |
| 57 | 713.6213 | −70.9985 |
| 58 | 713.7002 | −70.5486 |

TABLE 2-continued

| N | X | Y |
|---|---|---|
| 59 | 713.6540 | −70.1037 |
| 60 | 713.5055 | −69.7089 |
| Third Stage Vane LE and TE at Z = 10% | | |
| 1 | 597.2343 | 24.5387 |
| 2 | 591.5963 | 22.6658 |
| 3 | 586.6911 | 20.4113 |
| 4 | 583.8246 | 18.7786 |
| 5 | 580.1131 | 16.2419 |
| 6 | 578.0164 | 14.5469 |
| 7 | 575.4018 | 12.0809 |
| 8 | 573.4201 | 9.7664 |
| 9 | 572.4429 | 8.3406 |
| 10 | 571.4446 | 6.4512 |
| 11 | 571.0533 | 5.4001 |
| 12 | 570.8069 | 4.3438 |
| 13 | 570.7188 | 3.3566 |
| 14 | 570.7758 | 2.3531 |
| 15 | 570.9968 | 1.3619 |
| 16 | 571.4449 | 0.3051 |
| 17 | 572.016 | −0.5418 |
| 18 | 572.7337 | −1.2678 |
| 19 | 573.569 | −1.8485 |
| 20 | 574.607 | −2.3197 |
| 21 | 575.5778 | −2.5769 |
| 22 | 576.559 | −2.6895 |
| 23 | 577.5197 | −2.6724 |
| 24 | 578.9671 | −2.4791 |
| 25 | 580.8411 | −2.0969 |
| 26 | 582.3269 | −1.7505 |
| 27 | 584.9152 | −1.1314 |
| 28 | 587.9494 | −0.4578 |
| 29 | 590.2269 | −0.0031 |
| 30 | 594.0284 | 0.6467 |
| 31 | 715.6596 | −74.8040 |
| 32 | 714.8119 | −73.2064 |
| 33 | 713.6936 | −71.1230 |
| 34 | 712.7944 | −69.4660 |
| 35 | 711.2109 | −66.5815 |
| 36 | 709.3402 | −63.2217 |
| 37 | 707.9302 | −60.7201 |
| 38 | 705.5636 | −56.5796 |
| 39 | 703.8134 | −53.5639 |
| 40 | 700.9182 | −48.6641 |
| 41 | 701.1117 | −62.0388 |
| 42 | 702.9780 | −64.1043 |
| 43 | 705.4785 | −66.9583 |
| 44 | 706.9490 | −68.6942 |
| 45 | 708.8679 | −71.0396 |
| 46 | 710.4553 | −73.0627 |
| 47 | 711.3362 | −74.2258 |
| 48 | 712.4026 | −75.6821 |
| 49 | 712.9507 | −76.4550 |
| 50 | 713.2384 | −76.7658 |
| 51 | 713.6166 | −77.0076 |
| 52 | 714.0550 | −77.1399 |
| 53 | 714.5067 | −77.1391 |
| 54 | 714.9199 | −77.0222 |
| 55 | 715.2641 | −76.8124 |
| 56 | 715.5571 | −76.4988 |
| 57 | 715.7644 | −76.0978 |
| 58 | 715.8471 | −75.6479 |
| 59 | 715.8047 | −75.2015 |
| 60 | 715.6596 | −74.8040 |
| Third Stage Vane LE and TE at Z = 20% | | |
| 1 | 598.5124 | 22.2312 |
| 2 | 592.6984 | 20.8232 |
| 3 | 587.6047 | 18.9181 |
| 4 | 584.6177 | 17.4581 |
| 5 | 580.7434 | 15.1052 |
| 6 | 578.5546 | 13.4933 |
| 7 | 575.8266 | 11.1118 |
| 8 | 573.733 | 8.8645 |
| 9 | 572.6702 | 7.4835 |
| 10 | 571.541 | 5.6490 |
| 11 | 571.0753 | 4.6193 |
| 12 | 570.7591 | 3.5804 |

TABLE 2-continued

| N | X | Y |
|---|---|---|
| 13 | 570.6054 | 2.6009 |
| 14 | 570.5954 | 1.5960 |
| 15 | 570.7498 | 0.5932 |
| 16 | 571.1264 | −0.4897 |
| 17 | 571.6398 | −1.3710 |
| 18 | 572.3077 | −2.1413 |
| 19 | 573.1029 | −2.7744 |
| 20 | 574.1082 | −3.3113 |
| 21 | 575.0609 | −3.6304 |
| 22 | 576.0342 | −3.8058 |
| 23 | 576.996 | −3.8503 |
| 24 | 578.4802 | −3.7459 |
| 25 | 580.4073 | −3.4663 |
| 26 | 581.9323 | −3.1719 |
| 27 | 584.5865 | −2.6182 |
| 28 | 587.7041 | −2.0581 |
| 29 | 590.0463 | −1.7260 |
| 30 | 593.9526 | −1.3373 |
| 31 | 717.7578 | −80.2348 |
| 32 | 716.9089 | −78.6221 |
| 33 | 715.7833 | −76.5219 |
| 34 | 714.8744 | −74.8538 |
| 35 | 713.2661 | −71.9543 |
| 36 | 711.3574 | −68.5824 |
| 37 | 709.9148 | −66.0746 |
| 38 | 707.4902 | −61.9268 |
| 39 | 705.6975 | −58.9061 |
| 40 | 702.7394 | −53.9957 |
| 41 | 703.0133 | −67.2639 |
| 42 | 704.9154 | −69.3534 |
| 43 | 707.4592 | −72.2454 |
| 44 | 708.9537 | −74.0062 |
| 45 | 710.9035 | −76.3857 |
| 46 | 712.5166 | −78.4382 |
| 47 | 713.4109 | −79.6188 |
| 48 | 714.4913 | −81.0984 |
| 49 | 715.0453 | −81.8847 |
| 50 | 715.3312 | −82.1956 |
| 51 | 715.7078 | −82.4377 |
| 52 | 716.1450 | −82.5702 |
| 53 | 716.5960 | −82.5697 |
| 54 | 717.0091 | −82.4529 |
| 55 | 717.3537 | −82.2432 |
| 56 | 717.6477 | −81.9297 |
| 57 | 717.8564 | −81.5289 |
| 58 | 717.9410 | −81.0790 |
| 59 | 717.9008 | −80.6325 |
| 60 | 717.7578 | −80.2348 |
| Third Stage Vane LE and TE at Z = 30% | | |
| 1 | 593.5317 | 19.6581 |
| 2 | 588.2588 | 17.8480 |
| 3 | 585.1682 | 16.4125 |
| 4 | 581.1687 | 14.0515 |
| 5 | 578.9158 | 12.4143 |
| 6 | 576.1160 | 9.9817 |
| 7 | 573.9552 | 7.6922 |
| 8 | 572.8399 | 6.2954 |
| 9 | 571.6248 | 4.4478 |
| 10 | 571.1059 | 3.4099 |
| 11 | 570.7472 | 2.3784 |
| 12 | 570.5540 | 1.4007 |
| 13 | 570.5044 | 0.3924 |
| 14 | 570.6200 | −0.6194 |
| 15 | 570.9558 | −1.7191 |
| 16 | 571.4372 | −2.6210 |
| 17 | 572.0782 | −3.4166 |
| 18 | 572.8525 | −4.0785 |
| 19 | 573.8416 | −4.6507 |
| 20 | 574.7862 | −5.0025 |
| 21 | 575.7567 | −5.2106 |
| 22 | 576.7206 | −5.2870 |
| 23 | 578.2466 | −5.2236 |
| 24 | 580.2287 | −4.9708 |
| 25 | 581.7933 | −4.6757 |
| 26 | 584.5088 | −4.0877 |
| 27 | 587.6940 | −3.4762 |
| 28 | 590.0897 | −3.1254 |

TABLE 2-continued

| N | X | Y |
|---|---|---|
| 29 | 594.0979 | −2.7628 |
| 30 | 597.0399 | −2.6675 |
| 31 | 719.7108 | −85.5849 |
| 32 | 718.8380 | −83.9475 |
| 33 | 717.6859 | −81.8126 |
| 34 | 716.7591 | −80.1153 |
| 35 | 715.1257 | −77.1620 |
| 36 | 713.1949 | −73.7243 |
| 37 | 711.7399 | −71.1658 |
| 38 | 709.3008 | −66.9318 |
| 39 | 707.5013 | −63.8469 |
| 40 | 704.5374 | −58.8303 |
| 41 | 704.8449 | −72.3017 |
| 42 | 706.7635 | −74.4470 |
| 43 | 709.3262 | −77.4176 |
| 44 | 710.8320 | −79.2254 |
| 45 | 712.7993 | −81.6655 |
| 46 | 714.4317 | −83.7658 |
| 47 | 715.3397 | −84.9714 |
| 48 | 716.4423 | −86.4782 |
| 49 | 717.0114 | −87.2761 |
| 50 | 717.2987 | −87.5832 |
| 51 | 717.6762 | −87.8199 |
| 52 | 718.1134 | −87.9462 |
| 53 | 718.5638 | −87.9389 |
| 54 | 718.9756 | −87.8160 |
| 55 | 719.3184 | −87.6011 |
| 56 | 719.6101 | −87.2830 |
| 57 | 719.8163 | −86.8787 |
| 58 | 719.8983 | −86.4272 |
| 59 | 719.8557 | −85.9809 |
| 60 | 719.7108 | −85.5849 |
| Third Stage Vane LE and TE at Z = 40% | | |
| 1 | 593.9380 | 19.2543 |
| 2 | 588.5117 | 17.2625 |
| 3 | 585.3394 | 15.7066 |
| 4 | 581.2477 | 13.1695 |
| 5 | 578.9497 | 11.4206 |
| 6 | 576.1016 | 8.8343 |
| 7 | 573.9080 | 6.4149 |
| 8 | 572.7749 | 4.9477 |
| 9 | 571.5321 | 3.0198 |
| 10 | 570.9942 | 1.9430 |
| 11 | 570.6328 | 0.9088 |
| 12 | 570.4378 | −0.0719 |
| 13 | 570.3874 | −1.0836 |
| 14 | 570.5034 | −2.0989 |
| 15 | 570.8411 | −3.2018 |
| 16 | 571.3254 | −4.1057 |
| 17 | 571.9706 | −4.9020 |
| 18 | 572.7496 | −5.5632 |
| 19 | 573.7442 | −6.1331 |
| 20 | 574.6933 | −6.4815 |
| 21 | 575.6677 | −6.6853 |
| 22 | 576.6346 | −6.7569 |
| 23 | 578.2084 | −6.6797 |
| 24 | 580.2517 | −6.3896 |
| 25 | 581.8646 | −6.0654 |
| 26 | 584.6566 | −5.3999 |
| 27 | 587.9148 | −4.6284 |
| 28 | 590.3639 | −4.1393 |
| 29 | 594.4772 | −3.5651 |
| 30 | 597.5047 | −3.3331 |
| 31 | 721.4481 | −90.7790 |
| 32 | 720.5383 | −89.1035 |
| 33 | 719.3499 | −86.9121 |
| 34 | 718.4029 | −85.1649 |
| 35 | 716.7497 | −82.1160 |
| 36 | 714.8152 | −78.5560 |
| 37 | 713.3673 | −75.9007 |
| 38 | 710.9534 | −71.4983 |
| 39 | 709.1786 | −68.2866 |
| 40 | 706.2590 | −63.0597 |
| 41 | 706.4934 | −77.0511 |
| 42 | 708.4131 | −79.2863 |
| 43 | 710.9783 | −82.3767 |
| 44 | 712.4878 | −84.2534 |

TABLE 2-continued

| N | X | Y |
|---|---|---|
| 45 | 714.4659 | −86.7797 |
| 46 | 716.1155 | −88.9463 |
| 47 | 717.0388 | −90.1852 |
| 48 | 718.1700 | −91.7262 |
| 49 | 718.7599 | −92.5378 |
| 50 | 719.0509 | −92.8403 |
| 51 | 719.4314 | −93.0702 |
| 52 | 719.8708 | −93.1876 |
| 53 | 720.3220 | −93.1706 |
| 54 | 720.7333 | −93.0382 |
| 55 | 721.0747 | −92.8147 |
| 56 | 721.3638 | −92.4886 |
| 57 | 721.5665 | −92.0777 |
| 58 | 721.6442 | −91.6220 |
| 59 | 721.5972 | −91.1741 |
| 60 | 721.4481 | −90.7790 |
| Third Stage Vane LE and TE at Z = 50% | | |
| 1 | 594.3024 | 19.1197 |
| 2 | 588.7155 | 16.9904 |
| 3 | 585.4483 | 15.3519 |
| 4 | 581.2305 | 12.6982 |
| 5 | 578.8606 | 10.8749 |
| 6 | 575.9261 | 8.1810 |
| 7 | 573.6765 | 5.6580 |
| 8 | 572.5222 | 4.1262 |
| 9 | 571.2573 | 2.1189 |
| 10 | 570.7121 | 0.9996 |
| 11 | 570.3615 | −0.0352 |
| 12 | 570.1767 | −1.0158 |
| 13 | 570.1368 | −2.0262 |
| 14 | 570.2638 | −3.0392 |
| 15 | 570.6139 | −4.1384 |
| 16 | 571.1089 | −5.0376 |
| 17 | 571.7637 | −5.8278 |
| 18 | 572.5511 | −6.4817 |
| 19 | 573.5533 | −7.0420 |
| 20 | 574.5073 | −7.3814 |
| 21 | 575.4849 | −7.5759 |
| 22 | 576.4530 | −7.6381 |
| 23 | 578.0823 | −7.5356 |
| 24 | 580.1949 | −7.2090 |
| 25 | 581.8648 | −6.8708 |
| 26 | 584.7549 | −6.1733 |
| 27 | 588.1141 | −5.2966 |
| 28 | 590.6317 | −4.6900 |
| 29 | 594.8530 | −3.8997 |
| 30 | 597.9691 | −3.5356 |
| 31 | 722.8869 | −95.9146 |
| 32 | 721.9544 | −94.1905 |
| 33 | 720.7485 | −91.9290 |
| 34 | 719.7960 | −90.1213 |
| 35 | 718.1479 | −86.9585 |
| 36 | 716.2361 | −83.2556 |
| 37 | 714.8128 | −80.4889 |
| 38 | 712.4483 | −75.8955 |
| 39 | 710.7128 | −72.5414 |
| 40 | 707.8551 | −67.0810 |
| 41 | 707.8061 | −81.6850 |
| 42 | 709.7202 | −84.0223 |
| 43 | 712.2856 | −87.2430 |
| 44 | 713.8005 | −89.1925 |
| 45 | 715.7937 | −91.8084 |
| 46 | 717.4650 | −94.0434 |
| 47 | 718.4058 | −95.3170 |
| 48 | 719.5639 | −96.8973 |
| 49 | 720.1698 | −97.7280 |
| 50 | 720.4636 | −98.0311 |
| 51 | 720.8480 | −98.2594 |
| 52 | 721.2918 | −98.3733 |
| 53 | 721.7477 | −98.3508 |
| 54 | 722.1634 | −98.2118 |
| 55 | 722.5084 | −97.9815 |
| 56 | 722.8007 | −97.6477 |
| 57 | 723.0057 | −97.2290 |
| 58 | 723.0845 | −96.7664 |
| 59 | 723.0373 | −96.3131 |
| 60 | 722.8869 | −95.9146 |

TABLE 2-continued

| N | X | Y |
|---|---|---|
| Third Stage Vane LE and TE at Z = 60% | | |
| 1 | 594.9078 | 19.0580 |
| 2 | 589.1302 | 17.0270 |
| 3 | 585.7366 | 15.4427 |
| 4 | 581.3289 | 12.8450 |
| 5 | 578.8413 | 11.0408 |
| 6 | 575.7576 | 8.3491 |
| 7 | 573.4013 | 5.7987 |
| 8 | 572.1995 | 4.2373 |
| 9 | 570.8829 | 2.1860 |
| 10 | 570.3212 | 1.0368 |
| 11 | 569.9754 | 0.0167 |
| 12 | 569.7929 | −0.9506 |
| 13 | 569.7526 | −1.9479 |
| 14 | 569.8770 | −2.9493 |
| 15 | 570.2216 | −4.0384 |
| 16 | 570.7088 | −4.9319 |
| 17 | 571.3534 | −5.7198 |
| 18 | 572.1292 | −6.3751 |
| 19 | 573.1177 | −6.9411 |
| 20 | 574.0599 | −7.2887 |
| 21 | 575.0264 | −7.4938 |
| 22 | 575.9849 | −7.5678 |
| 23 | 577.6755 | −7.4690 |
| 24 | 579.8649 | −7.1459 |
| 25 | 581.5979 | −6.8232 |
| 26 | 584.6030 | −6.1642 |
| 27 | 588.0934 | −5.3088 |
| 28 | 590.6975 | −4.6819 |
| 29 | 595.0270 | −3.8207 |
| 30 | 598.2299 | −3.4549 |
| 31 | 723.9476 | −101.0275 |
| 32 | 723.0299 | −99.2470 |
| 33 | 721.8492 | −96.9093 |
| 34 | 720.9205 | −95.0391 |
| 35 | 719.3185 | −91.7650 |
| 36 | 717.4623 | −87.9307 |
| 37 | 716.0785 | −85.0664 |
| 38 | 713.7743 | −80.3129 |
| 39 | 712.0776 | −76.8438 |
| 40 | 709.2722 | −71.2010 |
| 41 | 708.6668 | −86.2958 |
| 42 | 710.5751 | −88.7275 |
| 43 | 713.1486 | −92.0629 |
| 44 | 714.6765 | −94.0743 |
| 45 | 716.6955 | −96.7657 |
| 46 | 718.3957 | −99.0591 |
| 47 | 719.3549 | −100.3643 |
| 48 | 720.5295 | −101.9881 |
| 49 | 721.1376 | −102.8465 |
| 50 | 721.4303 | −103.1594 |
| 51 | 721.8170 | −103.3971 |
| 52 | 722.2669 | −103.5186 |
| 53 | 722.7321 | −103.5011 |
| 54 | 723.1589 | −103.3641 |
| 55 | 723.5157 | −103.1330 |
| 56 | 723.8211 | −102.7957 |
| 57 | 724.0393 | −102.3707 |
| 58 | 724.1299 | −101.8994 |
| 59 | 724.0919 | −101.4361 |
| 60 | 723.9476 | −101.0275 |
| Third Stage Vane LE and TE at Z = 70% | | |
| 1 | 595.7258 | 19.7156 |
| 2 | 589.7641 | 17.7809 |
| 3 | 586.2549 | 16.2386 |
| 4 | 581.6816 | 13.6722 |
| 5 | 579.0915 | 11.8707 |
| 6 | 575.8712 | 9.1604 |
| 7 | 573.4025 | 6.5727 |
| 8 | 572.1385 | 4.9824 |
| 9 | 570.7384 | 2.894 |
| 10 | 570.1272 | 1.7259 |
| 11 | 569.7694 | 0.7591 |
| 12 | 569.5683 | −0.1626 |
| 13 | 569.5009 | −1.119 |
| 14 | 569.5883 | −2.0863 |

TABLE 2-continued

| N | X | Y |
|---|---|---|
| 15 | 569.8801 | −3.1482 |
| 16 | 570.3121 | −4.0303 |
| 17 | 570.8962 | −4.8207 |
| 18 | 571.6090 | −5.4927 |
| 19 | 572.5272 | −6.0927 |
| 20 | 573.4106 | −6.4816 |
| 21 | 574.3240 | −6.736 |
| 22 | 575.2367 | −6.8647 |
| 23 | 576.9887 | −6.8532 |
| 24 | 579.2676 | −6.568 |
| 25 | 581.0676 | −6.2421 |
| 26 | 584.1857 | −5.5636 |
| 27 | 587.8049 | −4.6869 |
| 28 | 590.4943 | −4.0296 |
| 29 | 594.9371 | −3.1074 |
| 30 | 598.2319 | −2.7433 |
| 31 | 724.7393 | −106.1285 |
| 32 | 723.8659 | −104.2804 |
| 33 | 722.7420 | −101.8556 |
| 34 | 721.8573 | −99.9170 |
| 35 | 720.3277 | −96.5265 |
| 36 | 718.5461 | −92.5613 |
| 37 | 717.2100 | −89.6032 |
| 38 | 714.9715 | −84.7004 |
| 39 | 713.3133 | −81.1269 |
| 40 | 710.5568 | −75.3207 |
| 41 | 709.3112 | −90.7604 |
| 42 | 711.2150 | −93.2892 |
| 43 | 713.7960 | −96.7456 |
| 44 | 715.3344 | −98.8244 |
| 45 | 717.3719 | −101.6019 |
| 46 | 719.0897 | −103.9665 |
| 47 | 720.0577 | −105.3129 |
| 48 | 721.2312 | −106.9961 |
| 49 | 721.8287 | −107.8929 |
| 50 | 722.1137 | −108.2187 |
| 51 | 722.4965 | −108.4710 |
| 52 | 722.9475 | −108.6074 |
| 53 | 723.4190 | −108.6031 |
| 54 | 723.8561 | −108.4766 |
| 55 | 724.2257 | −108.2525 |
| 56 | 724.5471 | −107.9191 |
| 57 | 724.7834 | −107.4942 |
| 58 | 724.8922 | −107.0186 |
| 59 | 724.8705 | −106.5474 |
| 60 | 724.7393 | −106.1285 |
| Third Stage Vane LE and TE at Z = 80% | | |
| 1 | 596.6447 | 21.6899 |
| 2 | 590.5380 | 19.6041 |
| 3 | 586.9611 | 17.9464 |
| 4 | 582.3246 | 15.2076 |
| 5 | 579.7033 | 13.2965 |
| 6 | 576.4329 | 10.4354 |
| 7 | 573.8972 | 7.7273 |
| 8 | 572.5751 | 6.0791 |
| 9 | 571.0717 | 3.9345 |
| 10 | 570.3680 | 2.7552 |
| 11 | 569.9785 | 1.8907 |
| 12 | 569.7341 | 1.0554 |
| 13 | 569.6082 | 0.1747 |
| 14 | 569.6171 | −0.7298 |
| 15 | 569.7977 | −1.7412 |
| 16 | 570.1157 | −2.6023 |
| 17 | 570.5762 | −3.3981 |
| 18 | 571.1609 | −4.1025 |
| 19 | 571.9360 | −4.7678 |
| 20 | 572.6983 | −5.2354 |
| 21 | 573.5009 | −5.5836 |
| 22 | 574.3168 | −5.8178 |
| 23 | 576.1214 | −6.0091 |
| 24 | 578.5001 | −5.7882 |
| 25 | 580.3656 | −5.403 |
| 26 | 583.5725 | −4.5433 |
| 27 | 587.2815 | −3.456 |
| 28 | 590.0336 | −2.6599 |
| 29 | 594.5908 | −1.5464 |
| 30 | 597.9836 | −1.0538 |

TABLE 2-continued

| N | X | Y |
|---|---|---|
| 31 | 725.4432 | −111.1990 |
| 32 | 724.6232 | −109.2665 |
| 33 | 723.5627 | −106.7348 |
| 34 | 722.7238 | −104.7137 |
| 35 | 721.2655 | −101.1836 |
| 36 | 719.5556 | −97.0611 |
| 37 | 718.2664 | −93.9885 |
| 38 | 716.0960 | −88.9000 |
| 39 | 714.4818 | −85.1930 |
| 40 | 711.7898 | −79.1711 |
| 41 | 710.0909 | −94.8710 |
| 42 | 711.9927 | −97.5192 |
| 43 | 714.5682 | −101.1391 |
| 44 | 716.1004 | −103.3171 |
| 45 | 718.1242 | −106.2294 |
| 46 | 719.8236 | −108.7122 |
| 47 | 720.7774 | −110.1278 |
| 48 | 721.9259 | −111.9010 |
| 49 | 722.5053 | −112.8485 |
| 50 | 722.7739 | −113.1806 |
| 51 | 723.1417 | −113.4433 |
| 52 | 723.5812 | −113.5936 |
| 53 | 724.0463 | −113.6054 |
| 54 | 724.4821 | −113.4950 |
| 55 | 724.8553 | −113.2857 |
| 56 | 725.1852 | −112.9665 |
| 57 | 725.4346 | −112.5536 |
| 58 | 725.5601 | −112.0861 |
| 59 | 725.5568 | −111.6185 |
| 60 | 725.4432 | −111.1990 |
| Third Stage Vane LE and TE at Z = 90% | | |
| 1 | 597.4244 | 24.4103 |
| 2 | 591.1925 | 22.0496 |
| 3 | 587.5676 | 20.2064 |
| 4 | 582.9066 | 17.2161 |
| 5 | 580.2828 | 15.1584 |
| 6 | 577.0043 | 12.1108 |
| 7 | 574.4377 | 9.2661 |
| 8 | 573.0772 | 7.5566 |
| 9 | 571.4955 | 5.3547 |
| 10 | 570.7109 | 4.1656 |
| 11 | 570.2944 | 3.3948 |
| 12 | 570.0125 | 2.6384 |
| 13 | 569.8356 | 1.8269 |
| 14 | 569.7753 | 0.9804 |
| 15 | 569.8569 | 0.0171 |
| 16 | 570.0723 | −0.8222 |
| 17 | 570.4209 | −1.6194 |
| 18 | 570.8884 | −2.3496 |
| 19 | 571.5306 | −3.0700 |
| 20 | 572.1788 | −3.6057 |
| 21 | 572.8752 | −4.0366 |
| 22 | 573.5964 | −4.3651 |
| 23 | 575.4333 | −4.7586 |
| 24 | 577.8883 | −4.6116 |
| 25 | 579.8014 | −4.1652 |
| 26 | 583.0600 | −3.0933 |
| 27 | 586.8127 | −1.7441 |
| 28 | 589.6013 | −0.7815 |
| 29 | 594.2568 | 0.5441 |
| 30 | 597.7376 | 1.1898 |
| 31 | 726.1397 | −116.0867 |
| 32 | 725.3656 | −114.0569 |
| 33 | 724.3566 | −111.4022 |
| 34 | 723.5531 | −109.2855 |
| 35 | 722.1483 | −105.5923 |
| 36 | 720.4948 | −101.2819 |
| 37 | 719.2471 | −98.0691 |
| 38 | 717.1460 | −92.7466 |
| 39 | 715.5839 | −88.8669 |
| 40 | 712.9807 | −82.5590 |
| 41 | 711.0878 | −98.4837 |
| 42 | 712.9924 | −101.2744 |
| 43 | 715.5505 | −105.1025 |
| 44 | 717.0600 | −107.4134 |
| 45 | 719.0380 | −110.5120 |
| 46 | 720.6838 | −113.1614 |

TABLE 2-continued

| N | X | Y |
|---|---|---|
| 47 | 721.6019 | −114.6745 |
| 48 | 722.7077 | −116.5661 |
| 49 | 723.2681 | −117.5726 |
| 50 | 723.5139 | −117.9007 |
| 51 | 723.8571 | −118.1656 |
| 52 | 724.2727 | −118.3250 |
| 53 | 724.7177 | −118.3522 |
| 54 | 725.1391 | −118.2611 |
| 55 | 725.5039 | −118.0726 |
| 56 | 725.8310 | −117.7771 |
| 57 | 726.0844 | −117.3888 |
| 58 | 726.2210 | −116.9436 |
| 59 | 726.2340 | −116.4939 |
| 60 | 726.1397 | −116.0867 |
| Third Stage Vane LE and TE at Z = 100% | | |
| 1 | 597.8976 | 27.1052 |
| 2 | 591.5444 | 24.5466 |
| 3 | 587.8646 | 22.5690 |
| 4 | 583.1563 | 19.3954 |
| 5 | 580.5157 | 17.2329 |
| 6 | 577.2226 | 14.0567 |
| 7 | 574.6419 | 11.1188 |
| 8 | 573.2677 | 9.3658 |
| 9 | 571.6590 | 7.1198 |
| 10 | 570.8441 | 5.9163 |
| 11 | 570.4230 | 5.1880 |
| 12 | 570.1311 | 4.4684 |
| 13 | 569.9379 | 3.6902 |
| 14 | 569.8528 | 2.8730 |
| 15 | 569.8961 | 1.9364 |
| 16 | 570.0697 | 1.1126 |
| 17 | 570.3707 | 0.3214 |
| 18 | 570.7866 | −0.4130 |
| 19 | 571.3680 | −1.1497 |
| 20 | 571.9619 | −1.7088 |
| 21 | 572.6060 | −2.1703 |
| 22 | 573.2787 | −2.5356 |
| 23 | 575.1321 | −3.0310 |
| 24 | 577.6269 | −2.9446 |
| 25 | 579.5670 | −2.4783 |
| 26 | 582.8498 | −1.2834 |
| 27 | 586.6199 | 0.2376 |
| 28 | 589.4324 | 1.3076 |
| 29 | 594.1764 | 2.7316 |
| 30 | 597.7334 | 3.4113 |
| 31 | 726.7519 | −120.5058 |
| 32 | 726.0066 | −118.3830 |
| 33 | 725.0298 | −115.6086 |
| 34 | 724.2490 | −113.3979 |
| 35 | 722.8811 | −109.5415 |
| 36 | 721.2734 | −105.0389 |
| 37 | 720.0653 | −101.6797 |
| 38 | 718.0401 | −96.1086 |
| 39 | 716.5412 | −92.0425 |
| 40 | 714.0527 | −85.4224 |
| 41 | 712.0662 | −101.5573 |
| 42 | 713.9726 | −104.4968 |
| 43 | 716.5082 | −108.5452 |
| 44 | 717.9898 | −110.9974 |
| 45 | 719.9139 | −114.2945 |
| 46 | 721.4987 | −117.1210 |
| 47 | 722.3777 | −118.7368 |
| 48 | 723.4428 | −120.7487 |
| 49 | 723.9904 | −121.8115 |
| 50 | 724.2141 | −122.1302 |
| 51 | 724.5318 | −122.3925 |
| 52 | 724.9210 | −122.5575 |
| 53 | 725.3416 | −122.5986 |
| 54 | 725.7432 | −122.5270 |
| 55 | 726.0939 | −122.3615 |
| 56 | 726.4120 | −122.0935 |
| 57 | 726.6628 | −121.7351 |
| 58 | 726.8047 | −121.3190 |
| 59 | 726.8297 | −120.8942 |
| 60 | 726.7519 | −120.5058 |

TABLE 4

| N | X | Y |
|---|---|---|
| Third Stage Blade LE and TE at Z = 0% | | |
| 1 | 777.2090 | −11.2552 |
| 2 | 773.7695 | −9.4742 |
| 3 | 771.7330 | −8.2691 |
| 4 | 769.0597 | −6.4649 |
| 5 | 767.5310 | −5.2796 |
| 6 | 765.6184 | −3.5540 |
| 7 | 764.1601 | −1.9273 |
| 8 | 763.4399 | −0.9198 |
| 9 | 762.7334 | 0.4330 |
| 10 | 762.5082 | 1.1982 |
| 11 | 762.4437 | 1.7103 |
| 12 | 762.4419 | 2.1665 |
| 13 | 762.4964 | 2.6150 |
| 14 | 762.6109 | 3.0473 |
| 15 | 762.8107 | 3.5039 |
| 16 | 763.0494 | 3.8741 |
| 17 | 763.3430 | 4.2023 |
| 18 | 763.6859 | 4.4833 |
| 19 | 764.1201 | 4.7392 |
| 20 | 764.5395 | 4.9111 |
| 21 | 764.9811 | 5.0317 |
| 22 | 765.4356 | 5.1020 |
| 23 | 766.5195 | 5.0931 |
| 24 | 767.9273 | 4.9162 |
| 25 | 769.0422 | 4.7272 |
| 26 | 770.9828 | 4.3631 |
| 27 | 773.2465 | 3.9127 |
| 28 | 774.9361 | 3.5716 |
| 29 | 777.7435 | 3.0106 |
| 30 | 779.7982 | 2.6110 |
| 31 | 877.7744 | 32.2651 |
| 32 | 877.0831 | 31.2042 |
| 33 | 876.1688 | 29.8234 |
| 34 | 875.4316 | 28.7275 |
| 35 | 874.1275 | 26.8254 |
| 36 | 872.5764 | 24.6195 |
| 37 | 871.3995 | 22.9842 |
| 38 | 869.4108 | 20.2911 |
| 39 | 867.9292 | 18.3412 |
| 40 | 865.4576 | 15.1975 |
| 41 | 866.2242 | 24.3089 |
| 42 | 867.7254 | 25.6578 |
| 43 | 869.7366 | 27.5321 |
| 44 | 870.9236 | 28.6744 |
| 45 | 872.4834 | 30.2160 |
| 46 | 873.7882 | 31.5408 |
| 47 | 874.5212 | 32.2988 |
| 48 | 875.4209 | 33.2428 |
| 49 | 875.8900 | 33.7410 |
| 50 | 876.1287 | 33.9343 |
| 51 | 876.4252 | 34.0673 |
| 52 | 876.7536 | 34.1142 |
| 53 | 877.0837 | 34.0685 |
| 54 | 877.3801 | 33.9471 |
| 55 | 877.6167 | 33.7618 |
| 56 | 877.8057 | 33.5031 |
| 57 | 877.9293 | 33.1935 |
| 58 | 877.9626 | 32.8633 |
| 59 | 877.9047 | 32.5434 |
| 60 | 877.7744 | 32.2651 |
| Third Stage Blade LE and TE at Z = 10% | | |
| 1 | 784.7477 | −14.3864 |
| 2 | 781.0620 | −12.8740 |
| 3 | 777.8247 | −11.2550 |
| 4 | 775.9113 | −10.1465 |
| 5 | 773.3969 | −8.4844 |
| 6 | 771.9499 | −7.4006 |
| 7 | 770.1162 | −5.8411 |
| 8 | 768.6683 | −4.3955 |
| 9 | 767.9182 | −3.5054 |
| 10 | 767.1460 | −2.2847 |
| 11 | 766.8941 | −1.5747 |
| 12 | 766.8169 | −1.1671 |
| 13 | 766.7933 | −0.8032 |
| 14 | 766.8159 | −0.4451 |

TABLE 4-continued

| N | X | Y |
|---|---|---|
| 15 | 766.8881 | −0.0995 |
| 16 | 767.0286 | 0.2657 |
| 17 | 767.2045 | 0.5620 |
| 18 | 767.4268 | 0.8247 |
| 19 | 767.6907 | 1.0493 |
| 20 | 768.0293 | 1.2526 |
| 21 | 768.3594 | 1.3878 |
| 22 | 768.7089 | 1.4815 |
| 23 | 769.0702 | 1.5352 |
| 24 | 770.0938 | 1.5420 |
| 25 | 771.4282 | 1.3576 |
| 26 | 772.4837 | 1.1549 |
| 27 | 774.3209 | 0.7794 |
| 28 | 776.4672 | 0.3428 |
| 29 | 778.0726 | 0.0304 |
| 30 | 780.7459 | −0.4555 |
| 31 | 874.9987 | 32.4133 |
| 32 | 874.3507 | 31.4119 |
| 33 | 873.4935 | 30.1084 |
| 34 | 872.8020 | 29.0739 |
| 35 | 871.5776 | 27.2789 |
| 36 | 870.1185 | 25.1988 |
| 37 | 869.0088 | 23.6584 |
| 38 | 867.1279 | 21.1257 |
| 39 | 865.7231 | 19.2945 |
| 40 | 863.3772 | 16.3445 |
| 41 | 864.1151 | 24.6228 |
| 42 | 865.5171 | 25.9445 |
| 43 | 867.3960 | 27.7770 |
| 44 | 868.5050 | 28.8922 |
| 45 | 869.9622 | 30.3955 |
| 46 | 871.1813 | 31.6863 |
| 47 | 871.8659 | 32.4246 |
| 48 | 872.7061 | 33.3437 |
| 49 | 873.1442 | 33.8286 |
| 50 | 873.3737 | 34.0222 |
| 51 | 873.6614 | 34.1576 |
| 52 | 873.9821 | 34.2087 |
| 53 | 874.3061 | 34.1687 |
| 54 | 874.5981 | 34.0538 |
| 55 | 874.8320 | 33.8754 |
| 56 | 875.0199 | 33.6241 |
| 57 | 875.1441 | 33.3221 |
| 58 | 875.1795 | 32.9992 |
| 59 | 875.1248 | 32.6859 |
| 60 | 874.9987 | 32.4133 |
| Third Stage Blade LE and TE at Z = 20% | | |
| 1 | 784.1823 | −13.2656 |
| 2 | 781.0625 | −11.9217 |
| 3 | 779.2094 | −10.9896 |
| 4 | 776.7629 | −9.5732 |
| 5 | 775.3489 | −8.6373 |
| 6 | 773.5560 | −7.2658 |
| 7 | 772.1513 | −5.9595 |
| 8 | 771.4410 | −5.1312 |
| 9 | 770.7720 | −3.9590 |
| 10 | 770.6076 | −3.2728 |
| 11 | 770.5884 | −2.9708 |
| 12 | 770.6004 | −2.7006 |
| 13 | 770.6405 | −2.4327 |
| 14 | 770.7094 | −2.1712 |
| 15 | 770.8210 | −1.8893 |
| 16 | 770.9501 | −1.6540 |
| 17 | 771.1066 | −1.4370 |
| 18 | 771.2882 | −1.2409 |
| 19 | 771.5181 | −1.0474 |
| 20 | 771.7411 | −0.9010 |
| 21 | 771.9775 | −0.7795 |
| 22 | 772.2235 | −0.6836 |
| 23 | 773.1720 | −0.4856 |
| 24 | 774.4469 | −0.4919 |
| 25 | 775.4602 | −0.6003 |
| 26 | 777.2199 | −0.8627 |
| 27 | 779.2713 | −1.2059 |
| 28 | 780.8042 | −1.4612 |
| 29 | 783.3552 | −1.8656 |
| 30 | 785.2253 | −2.1401 |

TABLE 4-continued

| N | X | Y |
|---|---|---|
| 31 | 871.9412 | 32.5122 |
| 32 | 871.3330 | 31.5599 |
| 33 | 870.5276 | 30.3209 |
| 34 | 869.8773 | 29.3382 |
| 35 | 868.7246 | 27.6337 |
| 36 | 867.3499 | 25.6594 |
| 37 | 866.3041 | 24.1977 |
| 38 | 864.5316 | 21.7941 |
| 39 | 863.2084 | 20.0558 |
| 40 | 861.0014 | 17.2531 |
| 41 | 861.7633 | 24.7356 |
| 42 | 863.0497 | 26.0615 |
| 43 | 864.7784 | 27.8909 |
| 44 | 865.8019 | 28.9990 |
| 45 | 867.1509 | 30.4871 |
| 46 | 868.2834 | 31.7596 |
| 47 | 868.9212 | 32.4852 |
| 48 | 869.7057 | 33.3863 |
| 49 | 870.1157 | 33.8607 |
| 50 | 870.3359 | 34.0544 |
| 51 | 870.6145 | 34.1923 |
| 52 | 870.9271 | 34.2482 |
| 53 | 871.2447 | 34.2146 |
| 54 | 871.5320 | 34.1071 |
| 55 | 871.7631 | 33.9365 |
| 56 | 871.9501 | 33.6937 |
| 57 | 872.0751 | 33.4003 |
| 58 | 872.1131 | 33.0855 |
| 59 | 872.0624 | 32.7791 |
| 60 | 871.9412 | 32.5122 |
| Third Stage Blade LE and TE at Z = 30% | | |
| 1 | 785.8363 | −13.8272 |
| 2 | 782.8010 | −12.6386 |
| 3 | 780.9949 | −11.8022 |
| 4 | 778.6096 | −10.5124 |
| 5 | 777.2330 | −9.6461 |
| 6 | 775.4975 | −8.3555 |
| 7 | 774.1616 | −7.1015 |
| 8 | 773.5062 | −6.2939 |
| 9 | 772.9367 | −5.1433 |
| 10 | 772.8357 | −4.4738 |
| 11 | 772.8556 | −4.2377 |
| 12 | 772.8920 | −4.0253 |
| 13 | 772.9447 | −3.8126 |
| 14 | 773.0127 | −3.6015 |
| 15 | 773.1071 | −3.3686 |
| 16 | 773.2070 | −3.1678 |
| 17 | 773.3221 | −2.9750 |
| 18 | 773.4513 | −2.7913 |
| 19 | 773.6115 | −2.5970 |
| 20 | 773.7653 | −2.4365 |
| 21 | 773.9284 | −2.2900 |
| 22 | 774.0996 | −2.1597 |
| 23 | 774.9863 | −1.8069 |
| 24 | 776.2180 | −1.6726 |
| 25 | 777.2034 | −1.7082 |
| 26 | 778.9085 | −1.8893 |
| 27 | 780.8911 | −2.1758 |
| 28 | 782.3701 | −2.4006 |
| 29 | 784.8288 | −2.7606 |
| 30 | 786.6296 | −3.0053 |
| 31 | 868.7737 | 32.5288 |
| 32 | 868.1916 | 31.6164 |
| 33 | 867.4202 | 30.4301 |
| 34 | 866.7970 | 29.4896 |
| 35 | 865.6922 | 27.8589 |
| 36 | 864.3751 | 25.9701 |
| 37 | 863.3741 | 24.5713 |
| 38 | 861.6805 | 22.2695 |
| 39 | 860.4189 | 20.6030 |
| 40 | 858.3195 | 17.9121 |
| 41 | 859.1508 | 24.8207 |
| 42 | 860.3482 | 26.1405 |
| 43 | 861.9617 | 27.9546 |
| 44 | 862.9198 | 29.0498 |
| 45 | 864.1863 | 30.5161 |
| 46 | 865.2531 | 31.7659 |

TABLE 4-continued

| N | X | Y |
|---|---|---|
| 47 | 865.8554 | 32.4770 |
| 48 | 866.5980 | 33.3584 |
| 49 | 866.9867 | 33.8217 |
| 50 | 867.1991 | 34.0135 |
| 51 | 867.4696 | 34.1516 |
| 52 | 867.7744 | 34.2098 |
| 53 | 868.0851 | 34.1805 |
| 54 | 868.3668 | 34.0786 |
| 55 | 868.5937 | 33.9144 |
| 56 | 868.7780 | 33.6792 |
| 57 | 868.9018 | 33.3942 |
| 58 | 868.9402 | 33.0876 |
| 59 | 868.8915 | 32.7890 |
| 60 | 868.7737 | 32.5288 |
| Third Stage Blade LE and TE at Z = 40% | | |
| 1 | 789.7414 | −16.1873 |
| 2 | 786.4276 | −15.1433 |
| 3 | 783.5017 | −13.9623 |
| 4 | 781.7674 | −13.1241 |
| 5 | 779.4876 | −11.8248 |
| 6 | 778.1798 | −10.9490 |
| 7 | 776.5404 | −9.6471 |
| 8 | 775.2909 | −8.3908 |
| 9 | 774.6811 | −7.5910 |
| 10 | 774.1423 | −6.4738 |
| 11 | 774.0330 | −5.8289 |
| 12 | 774.0430 | −5.6148 |
| 13 | 774.0681 | −5.4206 |
| 14 | 774.1076 | −5.2245 |
| 15 | 774.1609 | −5.0284 |
| 16 | 774.2370 | −4.8100 |
| 17 | 774.3191 | −4.6198 |
| 18 | 774.4149 | −4.4351 |
| 19 | 774.5233 | −4.2573 |
| 20 | 774.6588 | −4.0669 |
| 21 | 774.7895 | −3.9079 |
| 22 | 774.9290 | −3.7607 |
| 23 | 775.0760 | −3.6276 |
| 24 | 775.9066 | −3.2248 |
| 25 | 777.0894 | −3.0512 |
| 26 | 778.0432 | −3.0710 |
| 27 | 779.6906 | −3.2372 |
| 28 | 781.6051 | −3.5158 |
| 29 | 783.0332 | −3.7356 |
| 30 | 785.4075 | −4.0771 |
| 31 | 865.6421 | 32.3974 |
| 32 | 865.0705 | 31.5187 |
| 33 | 864.3136 | 30.3761 |
| 34 | 863.7029 | 29.4701 |
| 35 | 862.6216 | 27.8988 |
| 36 | 861.3350 | 26.0780 |
| 37 | 860.3589 | 24.7288 |
| 38 | 858.7113 | 22.5066 |
| 39 | 857.4869 | 20.8960 |
| 40 | 855.4547 | 18.2918 |
| 41 | 856.3580 | 24.9125 |
| 42 | 857.5099 | 26.1950 |
| 43 | 859.0632 | 27.9570 |
| 44 | 859.9862 | 29.0203 |
| 45 | 861.2068 | 30.4436 |
| 46 | 862.2353 | 31.6565 |
| 47 | 862.8162 | 32.3466 |
| 48 | 863.5324 | 33.2019 |
| 49 | 863.9073 | 33.6516 |
| 50 | 864.1139 | 33.8388 |
| 51 | 864.3773 | 33.9739 |
| 52 | 864.6747 | 34.0311 |
| 53 | 864.9779 | 34.0029 |
| 54 | 865.2526 | 33.9039 |
| 55 | 865.4736 | 33.7442 |
| 56 | 865.6526 | 33.5152 |
| 57 | 865.7723 | 33.2377 |
| 58 | 865.8082 | 32.9395 |
| 59 | 865.7589 | 32.6496 |
| 60 | 865.6421 | 32.3974 |

TABLE 4-continued

| N | X | Y |
|---|---|---|
| Third Stage Blade LE and TE at Z = 50% | | |
| 1 | 787.6933 | −16.8435 |
| 2 | 784.9087 | −15.7595 |
| 3 | 783.2613 | −14.9770 |
| 4 | 781.1004 | −13.7522 |
| 5 | 779.8639 | −12.9210 |
| 6 | 778.3156 | −11.6788 |
| 7 | 777.1396 | −10.4701 |
| 8 | 776.5643 | −9.7004 |
| 9 | 776.0287 | −8.6407 |
| 10 | 775.8843 | −8.0319 |
| 11 | 775.8683 | −7.8276 |
| 12 | 775.8699 | −7.6407 |
| 13 | 775.8867 | −7.4511 |
| 14 | 775.9189 | −7.2608 |
| 15 | 775.9737 | −7.0485 |
| 16 | 776.0386 | −6.8636 |
| 17 | 776.1186 | −6.6844 |
| 18 | 776.2127 | −6.5126 |
| 19 | 776.3332 | −6.3300 |
| 20 | 776.4517 | −6.1789 |
| 21 | 776.5792 | −6.0402 |
| 22 | 776.7143 | −5.9153 |
| 23 | 777.4642 | −5.4847 |
| 24 | 778.5662 | −5.2677 |
| 25 | 779.4685 | −5.2605 |
| 26 | 781.0325 | −5.3772 |
| 27 | 782.8546 | −5.5881 |
| 28 | 784.2158 | −5.7575 |
| 29 | 786.4813 | −6.0197 |
| 30 | 788.1420 | −6.1876 |
| 31 | 862.5971 | 31.9946 |
| 32 | 862.0357 | 31.1513 |
| 33 | 861.2948 | 30.0533 |
| 34 | 860.6988 | 29.1816 |
| 35 | 859.6474 | 27.6678 |
| 36 | 858.4014 | 25.9108 |
| 37 | 857.4593 | 24.6070 |
| 38 | 855.8736 | 22.4570 |
| 39 | 854.6983 | 20.8969 |
| 40 | 852.7521 | 18.3717 |
| 41 | 853.6172 | 24.8015 |
| 42 | 854.7338 | 26.0323 |
| 43 | 856.2387 | 27.7251 |
| 44 | 857.1324 | 28.7477 |
| 45 | 858.3136 | 30.1175 |
| 46 | 859.3081 | 31.2859 |
| 47 | 859.8694 | 31.9510 |
| 48 | 860.5611 | 32.7759 |
| 49 | 860.9231 | 33.2098 |
| 50 | 861.1236 | 33.3914 |
| 51 | 861.3796 | 33.5226 |
| 52 | 861.6686 | 33.5780 |
| 53 | 861.9631 | 33.5505 |
| 54 | 862.2296 | 33.4542 |
| 55 | 862.4434 | 33.2990 |
| 56 | 862.6161 | 33.0766 |
| 57 | 862.7306 | 32.8072 |
| 58 | 862.7633 | 32.5182 |
| 59 | 862.7129 | 32.2378 |
| 60 | 862.5971 | 31.9946 |
| Third Stage Blade LE and TE at Z = 60% | | |
| 1 | 790.8423 | −18.5730 |
| 2 | 788.2101 | −17.8389 |
| 3 | 786.6433 | −17.2720 |
| 4 | 784.5773 | −16.3439 |
| 5 | 783.3889 | −15.6927 |
| 6 | 781.8917 | −14.6769 |
| 7 | 780.7523 | −13.6240 |
| 8 | 780.1977 | −12.9247 |
| 9 | 779.6676 | −11.9492 |
| 10 | 779.4981 | −11.3883 |
| 11 | 779.4668 | −11.2049 |
| 12 | 779.4526 | −11.0362 |
| 13 | 779.4517 | −10.8641 |
| 14 | 779.4648 | −10.6905 |

TABLE 4-continued

| N | X | Y |
|---|---|---|
| 15 | 779.4962 | −10.4957 |
| 16 | 779.5390 | −10.3250 |
| 17 | 779.5956 | −10.1585 |
| 18 | 779.6650 | −9.9979 |
| 19 | 779.7569 | −9.8261 |
| 20 | 779.8494 | −9.6828 |
| 21 | 779.9506 | −9.5499 |
| 22 | 780.0593 | −9.4286 |
| 23 | 780.6944 | −8.9372 |
| 24 | 781.6779 | −8.6039 |
| 25 | 782.5046 | −8.5133 |
| 26 | 783.9563 | −8.4823 |
| 27 | 785.6580 | −8.5042 |
| 28 | 786.9328 | −8.5383 |
| 29 | 789.0567 | −8.6106 |
| 30 | 790.6147 | −8.6629 |
| 31 | 859.6988 | 31.1803 |
| 32 | 859.1630 | 30.3822 |
| 33 | 858.4604 | 29.3400 |
| 34 | 857.8984 | 28.5105 |
| 35 | 856.9128 | 27.0657 |
| 36 | 855.7529 | 25.3832 |
| 37 | 854.8803 | 24.1315 |
| 38 | 853.4175 | 22.0633 |
| 39 | 852.3362 | 20.5603 |
| 40 | 850.5486 | 18.1260 |
| 41 | 851.1694 | 24.2588 |
| 42 | 852.2268 | 25.4415 |
| 43 | 853.6514 | 27.0692 |
| 44 | 854.4970 | 28.0527 |
| 45 | 855.6147 | 29.3699 |
| 46 | 856.5561 | 30.4930 |
| 47 | 857.0878 | 31.1320 |
| 48 | 857.7433 | 31.9240 |
| 49 | 858.0865 | 32.3402 |
| 50 | 858.2788 | 32.5171 |
| 51 | 858.5253 | 32.6456 |
| 52 | 858.8041 | 32.7012 |
| 53 | 859.0887 | 32.6764 |
| 54 | 859.3463 | 32.5851 |
| 55 | 859.5528 | 32.4365 |
| 56 | 859.7196 | 32.2227 |
| 57 | 859.8300 | 31.9633 |
| 58 | 859.8610 | 31.6848 |
| 59 | 859.8115 | 31.4145 |
| 60 | 859.6988 | 31.1803 |
| Third Stage Blade LE and TE at Z = 70% | | |
| 1 | 794.6279 | −20.3073 |
| 2 | 792.1465 | −19.9546 |
| 3 | 790.6592 | −19.6128 |
| 4 | 788.6884 | −18.9803 |
| 5 | 787.5497 | −18.5007 |
| 6 | 786.1091 | −17.6965 |
| 7 | 785.0128 | −16.7950 |
| 8 | 784.4829 | −16.1701 |
| 9 | 783.9688 | −15.2853 |
| 10 | 783.7880 | −14.7769 |
| 11 | 783.7521 | −14.6200 |
| 12 | 783.7306 | −14.4750 |
| 13 | 783.7194 | −14.3261 |
| 14 | 783.7189 | −14.1749 |
| 15 | 783.7315 | −14.0038 |
| 16 | 783.7542 | −13.8524 |
| 17 | 783.7880 | −13.7029 |
| 18 | 783.8324 | −13.5569 |
| 19 | 783.8937 | −13.3984 |
| 20 | 783.9576 | −13.2639 |
| 21 | 784.0293 | −13.1367 |
| 22 | 784.1082 | −13.0182 |
| 23 | 784.6332 | −12.4776 |
| 24 | 785.4961 | −12.0322 |
| 25 | 786.2429 | −11.8525 |
| 26 | 787.5752 | −11.6713 |
| 27 | 789.1465 | −11.5185 |
| 28 | 790.3255 | −11.4285 |
| 29 | 792.2897 | −11.3134 |
| 30 | 793.7301 | −11.2407 |

TABLE 4-continued

| N | X | Y |
|---|---|---|
| 31 | 856.7725 | 29.6890 |
| 32 | 856.2726 | 28.9481 |
| 33 | 855.6205 | 27.9783 |
| 34 | 855.1012 | 27.2045 |
| 35 | 854.1954 | 25.8536 |
| 36 | 853.1355 | 24.2759 |
| 37 | 852.3416 | 23.0996 |
| 38 | 851.0151 | 21.1527 |
| 39 | 850.0366 | 19.7362 |
| 40 | 848.4206 | 17.4407 |
| 41 | 848.7470 | 23.1611 |
| 42 | 849.7372 | 24.2776 |
| 43 | 851.0709 | 25.8148 |
| 44 | 851.8624 | 26.7437 |
| 45 | 852.9083 | 27.9881 |
| 46 | 853.7892 | 29.0490 |
| 47 | 854.2866 | 29.6524 |
| 48 | 854.9001 | 30.4003 |
| 49 | 855.2213 | 30.7933 |
| 50 | 855.4060 | 30.9650 |
| 51 | 855.6432 | 31.0906 |
| 52 | 855.9119 | 31.1461 |
| 53 | 856.1863 | 31.1241 |
| 54 | 856.4348 | 31.0378 |
| 55 | 856.6339 | 30.8960 |
| 56 | 856.7946 | 30.6911 |
| 57 | 856.9008 | 30.4421 |
| 58 | 856.9302 | 30.1744 |
| Third Stage Blade LE and TE at Z = 80% | | |
| 1 | 797.3742 | −22.0119 |
| 2 | 795.0547 | −21.7984 |
| 3 | 793.6666 | −21.5141 |
| 4 | 791.8357 | −20.9258 |
| 5 | 790.7847 | −20.4558 |
| 6 | 789.4644 | −19.6619 |
| 7 | 788.4666 | −18.7956 |
| 8 | 787.9833 | −18.2132 |
| 9 | 787.4977 | −17.4074 |
| 10 | 787.3155 | −16.9478 |
| 11 | 787.2792 | −16.8120 |
| 12 | 787.2554 | −16.6858 |
| 13 | 787.2400 | −16.5555 |
| 14 | 787.2334 | −16.4226 |
| 15 | 787.2369 | −16.2712 |
| 16 | 787.2498 | −16.1365 |
| 17 | 787.2721 | −16.0027 |
| 18 | 787.3035 | −15.8711 |
| 19 | 787.3489 | −15.7272 |
| 20 | 787.3975 | −15.6041 |
| 21 | 787.4531 | −15.4870 |
| 22 | 787.5153 | −15.3769 |
| 23 | 787.9728 | −14.8505 |
| 24 | 788.7457 | −14.3844 |
| 25 | 789.4249 | −14.1671 |
| 26 | 790.6472 | −13.9377 |
| 27 | 792.0902 | −13.7702 |
| 28 | 793.1702 | −13.6704 |
| 29 | 794.9655 | −13.4969 |
| 30 | 796.2791 | −13.3484 |
| 31 | 853.4873 | 27.1206 |
| 32 | 853.0153 | 26.4478 |
| 33 | 852.3967 | 25.5696 |
| 34 | 851.9021 | 24.8706 |
| 35 | 851.0358 | 23.6535 |
| 36 | 850.0178 | 22.2361 |
| 37 | 849.2534 | 21.1814 |
| 38 | 847.9754 | 19.4377 |
| 39 | 847.0338 | 18.1693 |
| 40 | 845.4835 | 16.1113 |
| 41 | 845.7746 | 21.4065 |
| 42 | 846.7316 | 22.3922 |
| 43 | 848.0219 | 23.7508 |
| 44 | 848.7869 | 24.5743 |
| 45 | 849.7951 | 25.6818 |
| 46 | 850.6403 | 26.6315 |
| 47 | 851.1153 | 27.1745 |
| 48 | 851.6985 | 27.8505 |

TABLE 4-continued

| N | X | Y |
|---|---|---|
| 49 | 852.0025 | 28.2072 |
| 50 | 852.1855 | 28.3706 |
| 51 | 852.4183 | 28.4888 |
| 52 | 852.6803 | 28.5389 |
| 53 | 852.9461 | 28.5143 |
| 54 | 853.1854 | 28.4279 |
| 55 | 853.3758 | 28.2886 |
| 56 | 853.5277 | 28.0888 |
| 57 | 853.6260 | 27.8470 |
| 58 | 853.6495 | 27.5880 |
| 59 | 853.5976 | 27.3373 |
| 60 | 853.4873 | 27.1206 |
| Third Stage Blade LE and TE at Z = 90% | | |
| 1 | 799.0323 | −22.7321 |
| 2 | 796.9002 | −22.5431 |
| 3 | 795.6267 | −22.2668 |
| 4 | 793.9513 | −21.6829 |
| 5 | 792.9933 | −21.2136 |
| 6 | 791.7914 | −20.4396 |
| 7 | 790.8749 | −19.6352 |
| 8 | 790.4213 | −19.1125 |
| 9 | 789.9501 | −18.3956 |
| 10 | 789.7709 | −17.9819 |
| 11 | 789.7352 | −17.8587 |
| 12 | 789.7113 | −17.7441 |
| 13 | 789.6951 | −17.6259 |
| 14 | 789.6871 | −17.5051 |
| 15 | 789.6880 | −17.3676 |
| 16 | 789.6979 | −17.2451 |
| 17 | 789.7166 | −17.1234 |
| 18 | 789.7437 | −17.0035 |
| 19 | 789.7835 | −16.8724 |
| 20 | 789.8265 | −16.7601 |
| 21 | 789.8762 | −16.6531 |
| 22 | 789.9320 | −16.5524 |
| 23 | 790.3515 | −16.0756 |
| 24 | 791.0636 | −15.6527 |
| 25 | 791.6883 | −15.4382 |
| 26 | 792.8128 | −15.2179 |
| 27 | 794.1389 | −15.0959 |
| 28 | 795.1276 | −15.0273 |
| 29 | 796.7663 | −14.8554 |
| 30 | 797.9610 | −14.6701 |
| 31 | 849.6736 | 23.5436 |
| 32 | 849.2233 | 22.9472 |
| 33 | 848.6255 | 22.1749 |
| 34 | 848.1424 | 21.5650 |
| 35 | 847.2866 | 20.5111 |
| 36 | 846.2697 | 19.2945 |
| 37 | 845.5010 | 18.3946 |
| 38 | 844.2126 | 16.9122 |
| 39 | 843.2652 | 15.8347 |
| 40 | 841.7151 | 14.0821 |
| 41 | 842.1383 | 18.9979 |
| 42 | 843.0821 | 19.8058 |
| 43 | 844.3587 | 20.9200 |
| 44 | 845.1161 | 21.5985 |
| 45 | 846.1110 | 22.5182 |
| 46 | 846.9393 | 23.3161 |
| 47 | 847.4014 | 23.7770 |
| 48 | 847.9644 | 24.3566 |
| 49 | 848.2557 | 24.6652 |
| 50 | 848.4428 | 24.8169 |
| 51 | 848.6763 | 24.9226 |
| 52 | 848.9349 | 24.9610 |
| 53 | 849.1940 | 24.9267 |
| 54 | 849.4248 | 24.8332 |
| 55 | 849.6058 | 24.6902 |
| 56 | 849.7469 | 24.4897 |
| 57 | 849.8341 | 24.2502 |
| 58 | 849.8479 | 23.9963 |
| 59 | 849.7887 | 23.7525 |
| 60 | 849.6736 | 23.5436 |
| Third Stage Blade LE and TE at Z = 100% | | |
| 1 | 800.4316 | −21.0530 |
| 2 | 798.4947 | −21.1569 |

TABLE 4-continued

| N | X | Y |
|---|---|---|
| 3 | 797.3160 | −21.1225 |
| 4 | 795.7258 | −20.9386 |
| 5 | 794.7884 | −20.7404 |
| 6 | 793.5724 | −20.3491 |
| 7 | 792.5986 | −19.8609 |
| 8 | 792.1013 | −19.4918 |
| 9 | 791.5980 | −18.9105 |
| 10 | 791.4213 | −18.5438 |
| 11 | 791.3858 | −18.4257 |
| 12 | 791.3618 | −18.3174 |
| 13 | 791.3451 | −18.2065 |
| 14 | 791.3357 | −18.0940 |
| 15 | 791.3340 | −17.9663 |
| 16 | 791.3403 | −17.8526 |
| 17 | 791.3541 | −17.7394 |
| 18 | 791.3751 | −17.6276 |
| 19 | 791.4072 | −17.5042 |
| 20 | 791.4431 | −17.3976 |
| 21 | 791.4856 | −17.2944 |
| 22 | 791.5346 | −17.1956 |
| 23 | 791.9135 | −16.7505 |
| 24 | 792.5820 | −16.3710 |
| 25 | 793.1639 | −16.1695 |
| 26 | 794.2055 | −15.9198 |
| 27 | 795.4339 | −15.7059 |
| 28 | 796.3509 | −15.5577 |
| 29 | 797.8714 | −15.2815 |
| 30 | 798.9795 | −15.0463 |
| 31 | 845.4099 | 19.9393 |
| 32 | 845.0170 | 19.4184 |
| 33 | 844.4970 | 18.7424 |
| 34 | 844.0779 | 18.2071 |
| 35 | 843.3379 | 17.2797 |
| 36 | 842.4614 | 16.2055 |
| 37 | 841.8005 | 15.4087 |
| 38 | 840.6944 | 14.0929 |
| 39 | 839.8814 | 13.1348 |
| 40 | 838.5505 | 11.5747 |
| 41 | 838.4809 | 16.1266 |
| 42 | 839.3313 | 16.8432 |
| 43 | 840.4855 | 17.8259 |
| 44 | 841.1721 | 18.4215 |
| 45 | 842.0761 | 19.2262 |
| 46 | 842.8305 | 19.9223 |
| 47 | 843.2522 | 20.3239 |
| 48 | 843.7664 | 20.8282 |
| 49 | 844.0328 | 21.0966 |
| 50 | 844.2189 | 21.2404 |
| 51 | 844.4489 | 21.3371 |
| 52 | 844.7018 | 21.3668 |
| 53 | 844.9537 | 21.3249 |
| 54 | 845.1772 | 21.2256 |
| 55 | 845.3520 | 21.0787 |
| 56 | 845.4874 | 20.8765 |
| 57 | 845.5701 | 20.6372 |
| 58 | 845.5817 | 20.3852 |
| 59 | 845.5228 | 20.1447 |
| 60 | 845.4099 | 19.9393 |

TABLE 6

| N | X | Y |
|---|---|---|
| Fourth Stage Vane LE and TE at Z = 0% | | |
| 1 | 955.3360 | 77.1040 |
| 2 | 950.4639 | 75.5440 |
| 3 | 946.2269 | 73.6424 |
| 4 | 943.7587 | 72.2480 |
| 5 | 940.5857 | 70.0540 |
| 6 | 938.8211 | 68.5671 |
| 7 | 936.6871 | 66.3716 |
| 8 | 935.1726 | 64.2880 |
| 9 | 934.5118 | 62.9993 |
| 10 | 934.1500 | 61.2512 |

TABLE 6-continued

| N | X | Y |
|---|---|---|
| 11 | 934.2667 | 60.3062 |
| 12 | 934.3427 | 60.0348 |
| 13 | 934.4296 | 59.7913 |
| 14 | 934.5342 | 59.5485 |
| 15 | 934.6557 | 59.3094 |
| 16 | 934.8117 | 59.0489 |
| 17 | 934.9664 | 58.8284 |
| 18 | 935.1345 | 58.6208 |
| 19 | 935.3141 | 58.4278 |
| 20 | 935.5272 | 58.2297 |
| 21 | 935.7239 | 58.0723 |
| 22 | 935.9248 | 57.9337 |
| 23 | 936.1273 | 57.8152 |
| 24 | 937.2634 | 57.2066 |
| 25 | 938.8294 | 56.5362 |
| 26 | 940.1111 | 56.0886 |
| 27 | 942.3800 | 55.4328 |
| 28 | 945.0569 | 54.8071 |
| 29 | 947.0658 | 54.4131 |
| 30 | 950.4119 | 53.8619 |
| 31 | 1062.9791 | −2.8893 |
| 32 | 1062.0864 | −1.6190 |
| 33 | 1060.9262 | 0.0462 |
| 34 | 1060.0060 | 1.3759 |
| 35 | 1058.4075 | 3.7000 |
| 36 | 1056.5467 | 6.4182 |
| 37 | 1055.1580 | 8.4472 |
| 38 | 1052.8457 | 11.8102 |
| 39 | 1051.1460 | 14.2611 |
| 40 | 1047.2356 | 10.7228 |
| 41 | 1049.9659 | 7.8110 |
| 42 | 1051.6088 | 6.0047 |
| 43 | 1053.8189 | 3.5122 |
| 44 | 1055.1287 | 2.0022 |
| 45 | 1056.8563 | −0.0254 |
| 46 | 1058.3076 | −1.7587 |
| 47 | 1059.1255 | −2.7467 |
| 48 | 1060.1320 | −3.9731 |
| 49 | 1060.6580 | −4.6186 |
| 50 | 1060.9438 | −4.8851 |
| 51 | 1061.3128 | −5.0796 |
| 52 | 1061.7298 | −5.1683 |
| 53 | 1062.1467 | −5.1330 |
| 54 | 1062.5192 | −4.9905 |
| 55 | 1062.8187 | −4.7673 |
| 56 | 1063.0610 | −4.4515 |
| 57 | 1063.2143 | −4.0623 |
| 58 | 1063.2446 | −3.6404 |
| 59 | 1063.1573 | −3.2358 |
| 60 | 1062.9791 | −2.8893 |
| Fourth Stage Vane LE and TE at Z = 10% | | |
| 1 | 953.6903 | 66.8497 |
| 2 | 948.4698 | 65.0659 |
| 3 | 943.9129 | 62.9782 |
| 4 | 941.2399 | 61.4890 |
| 5 | 937.7603 | 59.2011 |
| 6 | 935.7829 | 57.6831 |
| 7 | 933.3091 | 55.4788 |
| 8 | 931.4259 | 53.4073 |
| 9 | 930.5090 | 52.1154 |
| 10 | 929.8061 | 50.3087 |
| 11 | 929.7571 | 49.2924 |
| 12 | 929.8030 | 48.9427 |
| 13 | 929.8731 | 48.6264 |
| 14 | 929.9700 | 48.3094 |
| 15 | 930.0929 | 47.9960 |
| 16 | 930.2614 | 47.6534 |
| 17 | 930.4374 | 47.3627 |
| 18 | 930.6361 | 47.0887 |
| 19 | 930.8546 | 46.8339 |
| 20 | 931.1202 | 46.5732 |
| 21 | 931.3702 | 46.3670 |
| 22 | 931.6294 | 46.1869 |
| 23 | 931.8940 | 46.0348 |
| 24 | 933.1796 | 45.4876 |
| 25 | 934.9350 | 44.9607 |
| 26 | 936.3588 | 44.6280 |

TABLE 6-continued

| N | X | Y |
|---|---|---|
| 27 | 938.8692 | 44.1688 |
| 28 | 941.8246 | 43.7729 |
| 29 | 944.0403 | 43.5526 |
| 30 | 947.7293 | 43.2951 |
| 31 | 1067.4776 | −19.0251 |
| 32 | 1066.5528 | −17.6426 |
| 33 | 1065.3502 | −15.8314 |
| 34 | 1064.3958 | −14.3850 |
| 35 | 1062.7367 | −11.8569 |
| 36 | 1060.8042 | −8.8998 |
| 37 | 1059.3617 | −6.6923 |
| 38 | 1056.9595 | −3.0328 |
| 39 | 1055.1933 | −0.3652 |
| 40 | 1052.2829 | 3.9678 |
| 41 | 1053.7713 | −7.1442 |
| 42 | 1055.4837 | −9.1610 |
| 43 | 1057.8039 | −11.9223 |
| 44 | 1059.1891 | −13.5832 |
| 45 | 1061.0294 | −15.7996 |
| 46 | 1062.5882 | −17.6825 |
| 47 | 1063.4720 | −18.7511 |
| 48 | 1064.5654 | −20.0731 |
| 49 | 1065.1395 | −20.7669 |
| 50 | 1065.4269 | −21.0298 |
| 51 | 1065.7951 | −21.2202 |
| 52 | 1066.2095 | −21.3057 |
| 53 | 1066.6235 | −21.2688 |
| 54 | 1066.9940 | −21.1260 |
| 55 | 1067.2930 | −20.9031 |
| 56 | 1067.5360 | −20.5886 |
| 57 | 1067.6920 | −20.2012 |
| 58 | 1067.7279 | −19.7802 |
| 59 | 1067.6480 | −19.3748 |
| 60 | 1067.4776 | −19.0251 |
| Fourth Stage Vane LE and TE at Z = 20% | | |
| 1 | 946.9009 | 55.6857 |
| 2 | 941.9933 | 53.7221 |
| 3 | 939.0884 | 52.3013 |
| 4 | 935.2734 | 50.0878 |
| 5 | 933.0867 | 48.5977 |
| 6 | 930.3317 | 46.3985 |
| 7 | 928.2152 | 44.2882 |
| 8 | 927.1725 | 42.9541 |
| 9 | 926.2229 | 41.1039 |
| 10 | 925.9860 | 40.0447 |
| 11 | 925.9661 | 39.6233 |
| 12 | 925.9869 | 39.2417 |
| 13 | 926.0439 | 38.8585 |
| 14 | 926.1369 | 38.4786 |
| 15 | 926.2851 | 38.0614 |
| 16 | 926.4558 | 37.7049 |
| 17 | 926.6616 | 37.3663 |
| 18 | 926.8990 | 37.0492 |
| 19 | 927.1992 | 36.7224 |
| 20 | 927.4910 | 36.4618 |
| 21 | 927.8018 | 36.2316 |
| 22 | 928.1270 | 36.0336 |
| 23 | 929.5211 | 35.5650 |
| 24 | 931.4359 | 35.2879 |
| 25 | 932.9751 | 35.1492 |
| 26 | 935.6706 | 34.9706 |
| 27 | 938.8263 | 34.8084 |
| 28 | 941.1843 | 34.7042 |
| 29 | 945.1003 | 34.5477 |
| 30 | 947.9622 | 34.4371 |
| 31 | 1071.1063 | −32.7422 |
| 32 | 1070.1623 | −31.2920 |
| 33 | 1068.9228 | −29.3998 |
| 34 | 1067.9302 | −27.8944 |
| 35 | 1066.1880 | −25.2733 |
| 36 | 1064.1363 | −22.2215 |
| 37 | 1062.5929 | −19.9509 |
| 38 | 1060.0074 | −16.1969 |
| 39 | 1058.0992 | −13.4657 |
| 40 | 1054.9516 | −9.0331 |
| 41 | 1056.7252 | −20.3647 |
| 42 | 1058.5505 | −22.4470 |

TABLE 6-continued

| N | X | Y |
|---|---|---|
| 43 | 1061.0195 | −25.3006 |
| 44 | 1062.4899 | −27.0198 |
| 45 | 1064.4371 | −29.3188 |
| 46 | 1066.0797 | −31.2773 |
| 47 | 1067.0077 | −32.3918 |
| 48 | 1068.1521 | −33.7737 |
| 49 | 1068.7512 | −34.5005 |
| 50 | 1069.0361 | −34.7615 |
| 51 | 1069.4014 | −34.9495 |
| 52 | 1069.8134 | −35.0324 |
| 53 | 1070.2258 | −34.9934 |
| 54 | 1070.5961 | −34.8488 |
| 55 | 1070.8964 | −34.6245 |
| 56 | 1071.1420 | −34.3090 |
| 57 | 1071.3022 | −33.9209 |
| 58 | 1071.3438 | −33.4993 |
| 59 | 1071.2704 | −33.0931 |
| 60 | 1071.1063 | −32.7422 |
| Fourth Stage Vane LE and TE at Z = 30% | | |
| 1 | 945.1332 | 47.4783 |
| 2 | 939.9186 | 45.6563 |
| 3 | 936.8115 | 44.3092 |
| 4 | 932.7094 | 42.1735 |
| 5 | 930.3471 | 40.7147 |
| 6 | 927.3598 | 38.5341 |
| 7 | 925.0543 | 36.4093 |
| 8 | 923.9077 | 35.0555 |
| 9 | 922.7472 | 33.1941 |
| 10 | 922.3474 | 32.1109 |
| 11 | 922.2357 | 31.5961 |
| 12 | 922.1882 | 31.1288 |
| 13 | 922.1929 | 30.6595 |
| 14 | 922.2528 | 30.1954 |
| 15 | 922.3882 | 29.6885 |
| 16 | 922.5702 | 29.2597 |
| 17 | 922.8079 | 28.8580 |
| 18 | 923.0955 | 28.4886 |
| 19 | 923.4715 | 28.1179 |
| 20 | 923.8451 | 27.8324 |
| 21 | 924.2478 | 27.5893 |
| 22 | 924.6720 | 27.3891 |
| 23 | 926.1616 | 27.0167 |
| 24 | 928.1929 | 26.8635 |
| 25 | 929.8183 | 26.8081 |
| 26 | 932.6553 | 26.7379 |
| 27 | 935.9672 | 26.6502 |
| 28 | 938.4376 | 26.5700 |
| 29 | 942.5340 | 26.4016 |
| 30 | 945.5235 | 26.2465 |
| 31 | 1074.5521 | −43.6928 |
| 32 | 1073.5820 | −42.1961 |
| 33 | 1072.3006 | −40.2476 |
| 34 | 1071.2690 | −38.7012 |
| 35 | 1069.4478 | −36.0161 |
| 36 | 1067.2879 | −32.9000 |
| 37 | 1065.6540 | −30.5875 |
| 38 | 1062.9043 | −26.7726 |
| 39 | 1060.8676 | −24.0023 |
| 40 | 1057.5020 | −19.5120 |
| 41 | 1059.6399 | −30.8805 |
| 42 | 1061.5541 | −33.0237 |
| 43 | 1064.1389 | −35.9651 |
| 44 | 1065.6757 | −37.7396 |
| 45 | 1067.7082 | −40.1146 |
| 46 | 1069.4202 | −42.1393 |
| 47 | 1070.3866 | −43.2915 |
| 48 | 1071.5774 | −44.7202 |
| 49 | 1072.2005 | −45.4715 |
| 50 | 1072.4837 | −45.7294 |
| 51 | 1072.8471 | −45.9136 |
| 52 | 1073.2569 | −45.9926 |
| 53 | 1073.6674 | −45.9500 |
| 54 | 1074.0362 | −45.8024 |
| 55 | 1074.3357 | −45.5757 |
| 56 | 1074.5811 | −45.2585 |
| 57 | 1074.7419 | −44.8694 |
| 58 | 1074.7850 | −44.4479 |

TABLE 6-continued

| N | X | Y |
|---|---|---|
| 59 | 1074.7138 | −44.0424 |
| 60 | 1074.5521 | −43.6928 |
| Fourth Stage Vane LE and TE at Z = 40% | | |
| 1 | 942.8949 | 40.3010 |
| 2 | 937.4696 | 38.4685 |
| 3 | 934.2262 | 37.1160 |
| 4 | 929.9271 | 34.9817 |
| 5 | 927.4348 | 33.5346 |
| 6 | 924.2482 | 31.3918 |
| 7 | 921.7354 | 29.3191 |
| 8 | 920.4401 | 28.0013 |
| 9 | 919.0564 | 26.1757 |
| 10 | 918.5244 | 25.0917 |
| 11 | 918.3143 | 24.4829 |
| 12 | 918.1951 | 23.9278 |
| 13 | 918.1484 | 23.3702 |
| 14 | 918.1817 | 22.8207 |
| 15 | 918.3189 | 22.2267 |
| 16 | 918.5309 | 21.7336 |
| 17 | 918.8237 | 21.2837 |
| 18 | 919.1883 | 20.8840 |
| 19 | 919.6723 | 20.5033 |
| 20 | 920.1565 | 20.2308 |
| 21 | 920.6781 | 20.0196 |
| 22 | 921.2240 | 19.8682 |
| 23 | 922.8182 | 19.5929 |
| 24 | 924.9387 | 19.3672 |
| 25 | 926.6345 | 19.2262 |
| 26 | 929.5970 | 19.0139 |
| 27 | 933.0600 | 18.7960 |
| 28 | 935.6451 | 18.6457 |
| 29 | 939.9341 | 18.4061 |
| 30 | 943.0655 | 18.2300 |
| 31 | 1078.2240 | −51.5951 |
| 32 | 1077.2091 | −50.0619 |
| 33 | 1075.8746 | −48.0604 |
| 34 | 1074.8052 | −46.4692 |
| 35 | 1072.9257 | −43.7017 |
| 36 | 1070.7056 | −40.4843 |
| 37 | 1069.0287 | −38.0940 |
| 38 | 1066.2062 | −34.1489 |
| 39 | 1064.1136 | −31.2844 |
| 40 | 1060.6467 | −26.6460 |
| 41 | 1062.9903 | −38.0805 |
| 42 | 1064.9305 | −40.3607 |
| 43 | 1067.5575 | −43.4824 |
| 44 | 1069.1270 | −45.3584 |
| 45 | 1071.2159 | −47.8566 |
| 46 | 1072.9908 | −49.9710 |
| 47 | 1074.0002 | −51.1664 |
| 48 | 1075.2526 | −52.6395 |
| 49 | 1075.9121 | −53.4097 |
| 50 | 1076.1975 | −53.6603 |
| 51 | 1076.5610 | −53.8362 |
| 52 | 1076.9686 | −53.9070 |
| 53 | 1077.3751 | −53.8569 |
| 54 | 1077.7389 | −53.7033 |
| 55 | 1078.0329 | −53.4724 |
| 56 | 1078.2720 | −53.1523 |
| 57 | 1078.4264 | −52.7626 |
| 58 | 1078.4640 | −52.3427 |
| 59 | 1078.3885 | −51.9405 |
| 60 | 1078.2240 | −51.5951 |
| Fourth Stage Vane LE and TE at Z = 50% | | |
| 1 | 940.7092 | 33.8252 |
| 2 | 935.1315 | 32.0235 |
| 3 | 931.7920 | 30.7034 |
| 4 | 927.3415 | 28.6369 |
| 5 | 924.7396 | 27.2444 |
| 6 | 921.3701 | 25.1970 |
| 7 | 918.6468 | 23.2377 |
| 8 | 917.1929 | 22.0007 |
| 9 | 915.5704 | 20.2862 |
| 10 | 914.8744 | 19.2686 |
| 11 | 914.5864 | 18.6708 |
| 12 | 914.4035 | 18.1225 |

TABLE 6-continued

| N | X | Y |
|---|---|---|
| 13 | 914.3006 | 17.5701 |
| 14 | 914.2874 | 17.0247 |
| 15 | 914.3858 | 16.4357 |
| 16 | 914.5762 | 15.9490 |
| 17 | 914.8601 | 15.5083 |
| 18 | 915.2273 | 15.1215 |
| 19 | 915.7272 | 14.7604 |
| 20 | 916.2351 | 14.5104 |
| 21 | 916.7873 | 14.3262 |
| 22 | 917.3681 | 14.2060 |
| 23 | 919.0691 | 13.9942 |
| 24 | 921.2960 | 13.7389 |
| 25 | 923.0730 | 13.5464 |
| 26 | 926.1754 | 13.2334 |
| 27 | 929.7997 | 12.8998 |
| 28 | 932.5045 | 12.6692 |
| 29 | 936.9913 | 12.3127 |
| 30 | 940.2671 | 12.0662 |
| 31 | 1081.8443 | −57.7572 |
| 32 | 1080.7710 | −56.2022 |
| 33 | 1079.3708 | −54.1647 |
| 34 | 1078.2567 | −52.5392 |
| 35 | 1076.3129 | −49.7019 |
| 36 | 1074.0349 | −46.3903 |
| 37 | 1072.3231 | −43.9236 |
| 38 | 1069.4510 | −39.8454 |
| 39 | 1067.3242 | −36.8819 |
| 40 | 1063.7960 | −32.0859 |
| 41 | 1066.1958 | −43.6667 |
| 42 | 1068.1753 | −46.0716 |
| 43 | 1070.8649 | −49.3544 |
| 44 | 1072.4806 | −51.3187 |
| 45 | 1074.6460 | −53.9205 |
| 46 | 1076.5028 | −56.1063 |
| 47 | 1077.5671 | −57.3343 |
| 48 | 1078.8971 | −58.8387 |
| 49 | 1079.6018 | −59.6210 |
| 50 | 1079.8900 | −59.8599 |
| 51 | 1080.2532 | −60.0226 |
| 52 | 1080.6572 | −60.0802 |
| 53 | 1081.0572 | −60.0186 |
| 54 | 1081.4126 | −59.8561 |
| 55 | 1081.6974 | −59.6193 |
| 56 | 1081.9260 | −59.2960 |
| 57 | 1082.0695 | −58.9064 |
| 58 | 1082.0973 | −58.4902 |
| 59 | 1082.0141 | −58.0945 |
| 60 | 1081.8443 | −57.7572 |
| Fourth Stage Vane LE and TE at Z = 60% | | |
| 1 | 938.9244 | 27.9008 |
| 2 | 933.1968 | 26.2768 |
| 3 | 929.7644 | 25.0811 |
| 4 | 925.1566 | 23.1984 |
| 5 | 922.4393 | 21.9150 |
| 6 | 918.8843 | 20.0056 |
| 7 | 915.9581 | 18.1783 |
| 8 | 914.3628 | 17.0321 |
| 9 | 912.5059 | 15.4677 |
| 10 | 911.6175 | 14.5604 |
| 11 | 911.2965 | 14.0977 |
| 12 | 911.0749 | 13.6709 |
| 13 | 910.9220 | 13.2381 |
| 14 | 910.8454 | 12.8080 |
| 15 | 910.8573 | 12.3388 |
| 16 | 910.9594 | 11.9455 |
| 17 | 911.1465 | 11.5828 |
| 18 | 911.4113 | 11.2572 |
| 19 | 911.7927 | 10.9431 |
| 20 | 912.1957 | 10.7150 |
| 21 | 912.6462 | 10.5352 |
| 22 | 913.1316 | 10.4032 |
| 23 | 914.9178 | 10.2070 |
| 24 | 917.2671 | 10.0850 |
| 25 | 919.1347 | 9.9907 |
| 26 | 922.3838 | 9.8105 |
| 27 | 926.1660 | 9.5619 |
| 28 | 928.9814 | 9.3471 |

TABLE 6-continued

| N | X | Y |
|---|---|---|
| 29 | 933.6426 | 8.9405 |
| 30 | 937.0398 | 8.6058 |
| 31 | 1084.9325 | −63.9792 |
| 32 | 1083.7979 | −62.4250 |
| 33 | 1082.3198 | −60.3899 |
| 34 | 1081.1433 | −58.7636 |
| 35 | 1079.0909 | −55.9190 |
| 36 | 1076.6900 | −52.5921 |
| 37 | 1074.8915 | −50.1111 |
| 38 | 1071.8847 | −46.0058 |
| 39 | 1069.6648 | −43.0212 |
| 40 | 1065.9900 | −38.1914 |
| 41 | 1068.3893 | −49.9741 |
| 42 | 1070.5266 | −52.3636 |
| 43 | 1073.4262 | −55.6285 |
| 44 | 1075.1642 | −57.5835 |
| 45 | 1077.4882 | −60.1751 |
| 46 | 1079.4757 | −62.3562 |
| 47 | 1080.6123 | −63.5842 |
| 48 | 1082.0298 | −65.0922 |
| 49 | 1082.7796 | −65.8782 |
| 50 | 1083.0668 | −66.1026 |
| 51 | 1083.4255 | −66.2498 |
| 52 | 1083.8222 | −66.2921 |
| 53 | 1084.2123 | −66.2182 |
| 54 | 1084.5564 | −66.0475 |
| 55 | 1084.8297 | −65.8064 |
| 56 | 1085.0465 | −65.4831 |
| 57 | 1085.1783 | −65.0971 |
| 58 | 1085.1960 | −64.6885 |
| 59 | 1085.1059 | −64.3039 |
| 60 | 1084.9325 | −63.9792 |
| Fourth Stage Vane LE and TE at Z = 70% | | |
| 1 | 937.2070 | 22.8412 |
| 2 | 931.3183 | 21.2761 |
| 3 | 927.7749 | 20.1336 |
| 4 | 922.9875 | 18.3378 |
| 5 | 920.1462 | 17.1098 |
| 6 | 916.4089 | 15.2721 |
| 7 | 913.3069 | 13.5082 |
| 8 | 911.6039 | 12.3973 |
| 9 | 909.6013 | 10.8649 |
| 10 | 908.6477 | 9.9436 |
| 11 | 908.3662 | 9.5810 |
| 12 | 908.1676 | 9.2493 |
| 13 | 908.0222 | 8.9144 |
| 14 | 907.9344 | 8.5817 |
| 15 | 907.9098 | 8.2166 |
| 16 | 907.9586 | 7.9063 |
| 17 | 908.0742 | 7.6143 |
| 18 | 908.2525 | 7.3448 |
| 19 | 908.5228 | 7.0738 |
| 20 | 908.8188 | 6.8649 |
| 21 | 909.1592 | 6.6874 |
| 22 | 909.5359 | 6.5418 |
| 23 | 911.3499 | 6.2726 |
| 24 | 913.7608 | 6.1772 |
| 25 | 915.6816 | 6.1364 |
| 26 | 919.0260 | 6.0766 |
| 27 | 922.9202 | 5.9818 |
| 28 | 925.8182 | 5.8770 |
| 29 | 930.6129 | 5.6265 |
| 30 | 934.1042 | 5.3772 |
| 31 | 1087.3326 | −70.1783 |
| 32 | 1086.1477 | −68.6202 |
| 33 | 1084.5980 | −66.5881 |
| 34 | 1083.3577 | −64.9647 |
| 35 | 1081.1831 | −62.1249 |
| 36 | 1078.6302 | −58.8038 |
| 37 | 1076.7181 | −56.3276 |
| 38 | 1073.5284 | −52.2292 |
| 39 | 1071.1805 | −49.2480 |
| 40 | 1067.3093 | −44.4185 |
| 41 | 1069.6551 | −56.5168 |
| 42 | 1072.0149 | −58.8211 |
| 43 | 1075.2050 | −61.9795 |
| 44 | 1077.1060 | −63.8776 |

TABLE 6-continued

| N | X | Y |
|---|---|---|
| 45 | 1079.6305 | −66.4056 |
| 46 | 1081.7701 | −68.5483 |
| 47 | 1082.9844 | −69.7634 |
| 48 | 1084.4882 | −71.2663 |
| 49 | 1085.2788 | −72.0552 |
| 50 | 1085.5598 | −72.2659 |
| 51 | 1085.9083 | −72.4007 |
| 52 | 1086.2930 | −72.4322 |
| 53 | 1086.6693 | −72.3524 |
| 54 | 1086.9992 | −72.1808 |
| 55 | 1087.2598 | −71.9430 |
| 56 | 1087.4649 | −71.6276 |
| 57 | 1087.5865 | −71.2528 |
| 58 | 1087.5973 | −70.8580 |
| 59 | 1087.5046 | −70.4885 |
| 60 | 1087.3326 | −70.1783 |
| Fourth Stage Vane LE and TE at Z = 80% | | |
| 1 | 935.3480 | 19.1716 |
| 2 | 929.3339 | 17.3621 |
| 3 | 925.6899 | 16.0993 |
| 4 | 920.7589 | 14.1758 |
| 5 | 917.8298 | 12.8984 |
| 6 | 913.9803 | 11.0232 |
| 7 | 910.7953 | 9.2255 |
| 8 | 909.0569 | 8.0738 |
| 9 | 907.0736 | 6.4002 |
| 10 | 906.2604 | 5.2869 |
| 11 | 906.0800 | 4.8905 |
| 12 | 905.9661 | 4.5376 |
| 13 | 905.8979 | 4.1887 |
| 14 | 905.8773 | 3.8480 |
| 15 | 905.9135 | 3.4799 |
| 16 | 906.0007 | 3.1707 |
| 17 | 906.1393 | 2.8824 |
| 18 | 906.3263 | 2.6178 |
| 19 | 906.5910 | 2.3520 |
| 20 | 906.8704 | 2.1465 |
| 21 | 907.1859 | 1.9707 |
| 22 | 907.5324 | 1.8253 |
| 23 | 909.2999 | 1.3689 |
| 24 | 911.6630 | 1.0055 |
| 25 | 913.5666 | 0.8142 |
| 26 | 916.9097 | 0.6097 |
| 27 | 920.8340 | 0.5090 |
| 28 | 923.7688 | 0.4910 |
| 29 | 928.6404 | 0.5073 |
| 30 | 932.1965 | 0.5258 |
| 31 | 1089.2150 | −74.6846 |
| 32 | 1088.0057 | −73.0738 |
| 33 | 1086.4221 | −70.9733 |
| 34 | 1085.1528 | −69.2957 |
| 35 | 1082.9241 | −66.3622 |
| 36 | 1080.3035 | −62.9324 |
| 37 | 1078.3390 | −60.3749 |
| 38 | 1075.0611 | −56.1399 |
| 39 | 1072.6491 | −53.0562 |
| 40 | 1068.6773 | −48.0523 |
| 41 | 1070.8550 | −60.6869 |
| 42 | 1073.3340 | −63.0347 |
| 43 | 1076.6844 | −66.2517 |
| 44 | 1078.6797 | −68.1842 |
| 45 | 1081.3285 | −70.7553 |
| 46 | 1083.5726 | −72.9310 |
| 47 | 1084.8458 | −74.1632 |
| 48 | 1086.4220 | −75.6859 |
| 49 | 1087.2502 | −76.4845 |
| 50 | 1087.5222 | −76.6836 |
| 51 | 1087.8572 | −76.8101 |
| 52 | 1088.2260 | −76.8378 |
| 53 | 1088.5858 | −76.7602 |
| 54 | 1088.9004 | −76.5962 |
| 55 | 1089.1483 | −76.3694 |
| 56 | 1089.3426 | −76.0687 |
| 57 | 1089.4575 | −75.7120 |
| 58 | 1089.4675 | −75.3358 |
| 59 | 1089.3791 | −74.9826 |
| 60 | 1089.2150 | −74.6846 |

TABLE 6-continued

| N | X | Y |
|---|---|---|
| Fourth Stage Vane LE and TE at Z = 90% | | |
| 1 | 933.8471 | 17.2423 |
| 2 | 927.7977 | 15.0955 |
| 3 | 924.1183 | 13.6493 |
| 4 | 919.1572 | 11.5108 |
| 5 | 916.2241 | 10.1330 |
| 6 | 912.3942 | 8.1559 |
| 7 | 909.2577 | 6.2736 |
| 8 | 907.5639 | 5.0584 |
| 9 | 905.6937 | 3.2393 |
| 10 | 905.0361 | 1.9652 |
| 11 | 904.9242 | 1.4962 |
| 12 | 904.8713 | 1.0837 |
| 13 | 904.8637 | 0.6799 |
| 14 | 904.9023 | 0.2888 |
| 15 | 905.0014 | −0.1300 |
| 16 | 905.1389 | −0.4786 |
| 17 | 905.3213 | −0.8010 |
| 18 | 905.5460 | −1.0948 |
| 19 | 905.8456 | −1.3878 |
| 20 | 906.1498 | −1.6131 |
| 21 | 906.4854 | −1.8048 |
| 22 | 906.8483 | −1.9627 |
| 23 | 908.5577 | −2.6050 |
| 24 | 910.8505 | −3.2681 |
| 25 | 912.7149 | −3.6559 |
| 26 | 916.0141 | −4.1103 |
| 27 | 919.9169 | −4.3591 |
| 28 | 922.8510 | −4.3961 |
| 29 | 927.7410 | −4.2676 |
| 30 | 931.3233 | −4.0668 |
| 31 | 1090.7582 | −76.7408 |
| 32 | 1089.5570 | −75.0218 |
| 33 | 1087.9923 | −72.7704 |
| 34 | 1086.7454 | −70.9697 |
| 35 | 1084.5665 | −67.8184 |
| 36 | 1082.0114 | −64.1312 |
| 37 | 1080.0926 | −61.3814 |
| 38 | 1076.8786 | −56.8293 |
| 39 | 1074.5041 | −53.5158 |
| 40 | 1070.5770 | −48.1407 |
| 41 | 1072.4421 | −61.5353 |
| 42 | 1074.8773 | −64.0991 |
| 43 | 1078.1781 | −67.6003 |
| 44 | 1080.1552 | −69.6926 |
| 45 | 1082.8014 | −72.4536 |
| 46 | 1085.0703 | −74.7593 |
| 47 | 1086.3712 | −76.0485 |
| 48 | 1087.9973 | −77.6216 |
| 49 | 1088.8593 | −78.4367 |
| 50 | 1089.1212 | −78.6252 |
| 51 | 1089.4410 | −78.7455 |
| 52 | 1089.7918 | −78.7734 |
| 53 | 1090.1337 | −78.7029 |
| 54 | 1090.4330 | −78.5514 |
| 55 | 1090.6697 | −78.3396 |
| 56 | 1090.8551 | −78.0568 |
| 57 | 1090.9679 | −77.7217 |
| 58 | 1090.9842 | −77.3672 |
| 59 | 1090.9075 | −77.0297 |
| 60 | 1090.7582 | −76.7408 |
| Fourth Stage Vane LE and TE at Z = 100% | | |
| 1 | 933.0516 | 16.8308 |
| 2 | 927.0247 | 14.4095 |
| 3 | 923.3668 | 12.7933 |
| 4 | 918.4665 | 10.4249 |
| 5 | 915.5913 | 8.9147 |
| 6 | 911.8673 | 6.7700 |
| 7 | 908.8484 | 4.7508 |
| 8 | 907.2304 | 3.4618 |
| 9 | 905.4602 | 1.5610 |
| 10 | 904.8476 | 0.2553 |
| 11 | 904.7305 | −0.2529 |
| 12 | 904.6763 | −0.7008 |
| 13 | 904.6704 | −1.1407 |
| 14 | 904.7142 | −1.5680 |

TABLE 6-continued

| N | X | Y |
|---|---|---|
| 15 | 904.8227 | −2.0278 |
| 16 | 904.9714 | −2.4126 |
| 17 | 905.1674 | −2.7706 |
| 18 | 905.4079 | −3.0993 |
| 19 | 905.7279 | −3.4307 |
| 20 | 906.0525 | −3.6889 |
| 21 | 906.4105 | −3.9124 |
| 22 | 906.7978 | −4.1008 |
| 23 | 908.4854 | −4.8229 |
| 24 | 910.7585 | −5.5842 |
| 25 | 912.6090 | −6.0446 |
| 26 | 915.8870 | −6.6142 |
| 27 | 919.7707 | −6.9728 |
| 28 | 922.6946 | −7.0697 |
| 29 | 927.5753 | −6.9935 |
| 30 | 931.1574 | −6.7890 |
| 31 | 1092.0654 | −76.9895 |
| 32 | 1090.9057 | −75.1337 |
| 33 | 1089.4074 | −72.6910 |
| 34 | 1088.2243 | −70.7337 |
| 35 | 1086.1731 | −67.3039 |
| 36 | 1083.7767 | −63.2881 |
| 37 | 1081.9706 | −60.2952 |
| 38 | 1078.9227 | −55.3488 |
| 39 | 1076.6521 | −51.7554 |
| 40 | 1072.8630 | −45.9407 |
| 41 | 1074.2410 | −60.2292 |
| 42 | 1076.5497 | −63.0621 |
| 43 | 1079.6873 | −66.9239 |
| 44 | 1081.5805 | −69.2223 |
| 45 | 1084.1432 | −72.2316 |
| 46 | 1086.3769 | −74.7108 |
| 47 | 1087.6764 | −76.0772 |
| 48 | 1089.3227 | −77.7198 |
| 49 | 1090.2059 | −78.5584 |
| 50 | 1090.4560 | −78.7383 |
| 51 | 1090.7593 | −78.8554 |
| 52 | 1091.0910 | −78.8874 |
| 53 | 1091.4152 | −78.8284 |
| 54 | 1091.7010 | −78.6931 |
| 55 | 1091.9290 | −78.4995 |
| 56 | 1092.1088 | −78.2365 |
| 57 | 1092.2245 | −77.9251 |
| 58 | 1092.2535 | −77.5938 |
| 59 | 1092.1946 | −77.2715 |
| 60 | 1092.0654 | −76.9895 |

TABLE 8

| N | X | Y |
|---|---|---|
| Fourth Stage Blade LE and TE at Z = 0% | | |
| 1 | 1138.0006 | −9.1243 |
| 2 | 1132.3216 | −6.8397 |
| 3 | 1128.9111 | −5.3108 |
| 4 | 1124.3525 | −3.0421 |
| 5 | 1121.6794 | −1.5666 |
| 6 | 1118.2128 | 0.5588 |
| 7 | 1115.3859 | 2.5366 |
| 8 | 1113.8507 | 3.7495 |
| 9 | 1112.0633 | 5.3768 |
| 10 | 1111.2024 | 6.3094 |
| 11 | 1110.8346 | 6.8314 |
| 12 | 1110.5905 | 7.3244 |
| 13 | 1110.4411 | 7.8243 |
| 14 | 1110.3962 | 8.3116 |
| 15 | 1110.4644 | 8.8209 |
| 16 | 1110.6233 | 9.2190 |
| 17 | 1110.8775 | 9.5673 |
| 18 | 1111.2252 | 9.8666 |
| 19 | 1111.7135 | 10.1248 |
| 20 | 1112.2190 | 10.2688 |
| 21 | 1112.7687 | 10.3302 |
| 22 | 1113.3370 | 10.3118 |

TABLE 8-continued

| N | X | Y |
|---|---|---|
| 23 | 1115.1750 | 10.0143 |
| 24 | 1117.5543 | 9.5178 |
| 25 | 1119.4407 | 9.0776 |
| 26 | 1122.7192 | 8.2493 |
| 27 | 1126.5391 | 7.2338 |
| 28 | 1129.3890 | 6.4629 |
| 29 | 1134.1251 | 5.1899 |
| 30 | 1137.5952 | 4.2832 |
| 31 | 1312.0170 | 40.3937 |
| 32 | 1310.4720 | 39.1011 |
| 33 | 1308.4520 | 37.4141 |
| 34 | 1306.8440 | 36.0692 |
| 35 | 1304.0380 | 33.7243 |
| 36 | 1300.7530 | 30.9945 |
| 37 | 1298.2900 | 28.9682 |
| 38 | 1294.1730 | 25.6357 |
| 39 | 1291.1350 | 23.2315 |
| 40 | 1286.1220 | 19.3752 |
| 41 | 1289.7278 | 31.4464 |
| 42 | 1292.6686 | 33.2706 |
| 43 | 1296.6278 | 35.8318 |
| 44 | 1298.9763 | 37.4048 |
| 45 | 1302.0801 | 39.5346 |
| 46 | 1304.6988 | 41.3614 |
| 47 | 1306.1815 | 42.4014 |
| 48 | 1308.0178 | 43.6850 |
| 49 | 1308.9851 | 44.3544 |
| 50 | 1309.5706 | 44.6481 |
| 51 | 1310.2542 | 44.7885 |
| 52 | 1310.9687 | 44.7319 |
| 53 | 1311.6310 | 44.4703 |
| 54 | 1312.1727 | 44.0596 |
| 55 | 1312.5611 | 43.5527 |
| 56 | 1312.8169 | 42.9226 |
| 57 | 1312.8976 | 42.2145 |
| 58 | 1312.7666 | 41.5088 |
| 59 | 1312.4532 | 40.8839 |
| 60 | 1312.0168 | 40.3937 |
| Fourth Stage Blade LE and TE at Z = 10% | | |
| 1 | 1139.0653 | −8.6078 |
| 2 | 1133.4984 | −6.3431 |
| 3 | 1130.1575 | −4.8206 |
| 4 | 1125.7046 | −2.5388 |
| 5 | 1123.1095 | −1.0355 |
| 6 | 1119.7704 | 1.1555 |
| 7 | 1117.0797 | 3.2160 |
| 8 | 1115.6341 | 4.4822 |
| 9 | 1113.9468 | 6.1539 |
| 10 | 1113.1026 | 7.0767 |
| 11 | 1112.8031 | 7.4771 |
| 12 | 1112.6016 | 7.8345 |
| 13 | 1112.4712 | 8.1824 |
| 14 | 1112.4136 | 8.5113 |
| 15 | 1112.4344 | 8.8477 |
| 16 | 1112.5285 | 9.1076 |
| 17 | 1112.6955 | 9.3309 |
| 18 | 1112.9341 | 9.5180 |
| 19 | 1113.2800 | 9.6780 |
| 20 | 1113.6487 | 9.7691 |
| 21 | 1114.0634 | 9.8105 |
| 22 | 1114.5114 | 9.8019 |
| 23 | 1116.3276 | 9.5625 |
| 24 | 1118.6665 | 9.0652 |
| 25 | 1120.5128 | 8.5830 |
| 26 | 1123.7111 | 7.6398 |
| 27 | 1127.4285 | 6.4677 |
| 28 | 1130.2018 | 5.5833 |
| 29 | 1134.8167 | 4.1452 |
| 30 | 1138.2070 | 3.1498 |
| 31 | 1309.9036 | 38.2801 |
| 32 | 1308.6126 | 36.8269 |
| 33 | 1306.8722 | 34.9757 |
| 34 | 1305.4409 | 33.5410 |
| 35 | 1302.8622 | 31.1147 |
| 36 | 1299.7445 | 28.3857 |
| 37 | 1297.3576 | 26.4105 |
| 38 | 1293.3118 | 23.2230 |

TABLE 8-continued

| N | X | Y |
|---|---|---|
| 39 | 1290.3048 | 20.9496 |
| 40 | 1285.3278 | 17.3210 |
| 41 | 1288.3136 | 28.5947 |
| 42 | 1291.2554 | 30.2623 |
| 43 | 1295.2236 | 32.5974 |
| 44 | 1297.5744 | 34.0402 |
| 45 | 1300.6594 | 36.0286 |
| 46 | 1303.2164 | 37.7985 |
| 47 | 1304.6345 | 38.8456 |
| 48 | 1306.3462 | 40.1957 |
| 49 | 1307.2211 | 40.9339 |
| 50 | 1307.6300 | 41.2009 |
| 51 | 1308.1235 | 41.3639 |
| 52 | 1308.6567 | 41.3864 |
| 53 | 1309.1709 | 41.2554 |
| 54 | 1309.6119 | 41.0046 |
| 55 | 1309.9511 | 40.6689 |
| 56 | 1310.2062 | 40.2307 |
| 57 | 1310.3421 | 39.7183 |
| 58 | 1310.3248 | 39.1855 |
| 59 | 1310.1666 | 38.6911 |
| 60 | 1309.9036 | 38.2801 |
| Fourth Stage Blade LE and TE at Z = 20% | | |
| 1 | 1142.2787 | −6.5175 |
| 2 | 1137.0133 | −4.3357 |
| 3 | 1133.8426 | −2.9043 |
| 4 | 1129.5905 | −0.8128 |
| 5 | 1127.0889 | 0.5326 |
| 6 | 1123.8299 | 2.4553 |
| 7 | 1121.1583 | 4.2396 |
| 8 | 1119.7069 | 5.3435 |
| 9 | 1118.0780 | 6.9044 |
| 10 | 1117.5170 | 7.9288 |
| 11 | 1117.4740 | 8.1074 |
| 12 | 1117.4539 | 8.2683 |
| 13 | 1117.4525 | 8.4286 |
| 14 | 1117.4702 | 8.5857 |
| 15 | 1117.5128 | 8.7556 |
| 16 | 1117.5705 | 8.8980 |
| 17 | 1117.6468 | 9.0315 |
| 18 | 1117.7407 | 9.1553 |
| 19 | 1117.8655 | 9.2810 |
| 20 | 1117.9914 | 9.3787 |
| 21 | 1118.1290 | 9.4621 |
| 22 | 1118.2756 | 9.5306 |
| 23 | 1119.9898 | 9.7419 |
| 24 | 1122.2690 | 9.4079 |
| 25 | 1124.0666 | 9.0238 |
| 26 | 1127.1805 | 8.2539 |
| 27 | 1130.7976 | 7.2650 |
| 28 | 1133.4912 | 6.4966 |
| 29 | 1137.9597 | 5.1969 |
| 30 | 1141.2280 | 4.2435 |
| 31 | 1306.5232 | 35.9615 |
| 32 | 1305.1196 | 34.6974 |
| 33 | 1303.2764 | 33.0531 |
| 34 | 1301.7962 | 31.7543 |
| 35 | 1299.1840 | 29.5205 |
| 36 | 1296.0810 | 26.9691 |
| 37 | 1293.7314 | 25.1028 |
| 38 | 1289.7761 | 22.0690 |
| 39 | 1286.8520 | 19.8909 |
| 40 | 1282.0396 | 16.3848 |
| 41 | 1286.0793 | 26.0326 |
| 42 | 1288.8955 | 27.7859 |
| 43 | 1292.7028 | 30.2226 |
| 44 | 1294.9660 | 31.7123 |
| 45 | 1297.9540 | 33.7342 |
| 46 | 1300.4621 | 35.4859 |
| 47 | 1301.8728 | 36.4952 |
| 48 | 1303.6064 | 37.7582 |
| 49 | 1304.5122 | 38.4265 |
| 50 | 1304.8800 | 38.6254 |
| 51 | 1305.3140 | 38.7284 |
| 52 | 1305.7718 | 38.7062 |
| 53 | 1306.2005 | 38.5520 |
| 54 | 1306.5548 | 38.3004 |

TABLE 8-continued

| N | X | Y |
|---|---|---|
| 55 | 1306.8130 | 37.9846 |
| 56 | 1306.9887 | 37.5875 |
| 57 | 1307.0537 | 37.1374 |
| 58 | 1306.9829 | 36.6851 |
| 59 | 1306.7937 | 36.2813 |
| 60 | 1306.5232 | 35.9615 |
| Fourth Stage Blade LE and TE at Z = 30% | | |
| 1 | 1146.8276 | −7.3036 |
| 2 | 1142.0421 | −5.3959 |
| 3 | 1139.1617 | −4.1417 |
| 4 | 1135.3042 | −2.2983 |
| 5 | 1133.0420 | −1.0994 |
| 6 | 1130.1075 | 0.6340 |
| 7 | 1127.7221 | 2.2664 |
| 8 | 1126.4374 | 3.2884 |
| 9 | 1125.0178 | 4.7443 |
| 10 | 1124.5392 | 5.7004 |
| 11 | 1124.5548 | 5.8247 |
| 12 | 1124.5780 | 5.9460 |
| 13 | 1124.6094 | 6.0753 |
| 14 | 1124.6493 | 6.2104 |
| 15 | 1124.7062 | 6.3664 |
| 16 | 1124.7692 | 6.5059 |
| 17 | 1124.8423 | 6.6413 |
| 18 | 1124.9218 | 6.7687 |
| 19 | 1125.0155 | 6.9006 |
| 20 | 1125.0996 | 7.0061 |
| 21 | 1125.1825 | 7.1000 |
| 22 | 1125.2627 | 7.1822 |
| 23 | 1126.8137 | 7.5032 |
| 24 | 1128.8845 | 7.3940 |
| 25 | 1130.5226 | 7.1749 |
| 26 | 1133.3597 | 6.6567 |
| 27 | 1136.6486 | 5.9126 |
| 28 | 1139.0917 | 5.2952 |
| 29 | 1143.1349 | 4.1938 |
| 30 | 1146.0860 | 3.3484 |
| 31 | 1298.3468 | 34.2298 |
| 32 | 1297.0707 | 33.0020 |
| 33 | 1295.4229 | 31.3722 |
| 34 | 1294.1044 | 30.0756 |
| 35 | 1291.7607 | 27.8534 |
| 36 | 1288.9373 | 25.3443 |
| 37 | 1286.7786 | 23.5251 |
| 38 | 1283.1222 | 20.5846 |
| 39 | 1280.4114 | 18.4775 |
| 40 | 1275.9542 | 15.0731 |
| 41 | 1279.1941 | 24.5813 |
| 42 | 1281.7986 | 26.3258 |
| 43 | 1285.3340 | 28.7163 |
| 44 | 1287.4465 | 30.1556 |
| 45 | 1290.2519 | 32.0794 |
| 46 | 1292.6247 | 33.7191 |
| 47 | 1293.9678 | 34.6530 |
| 48 | 1295.6248 | 35.8143 |
| 49 | 1296.4914 | 36.4280 |
| 50 | 1296.8221 | 36.6011 |
| 51 | 1297.2102 | 36.6893 |
| 52 | 1297.6189 | 36.6681 |
| 53 | 1298.0021 | 36.5319 |
| 54 | 1298.3209 | 36.3104 |
| 55 | 1298.5559 | 36.0318 |
| 56 | 1298.7191 | 35.6818 |
| 57 | 1298.7859 | 35.2843 |
| 58 | 1298.7341 | 34.8827 |
| 59 | 1298.5774 | 34.5208 |
| 60 | 1298.3468 | 34.2298 |
| Fourth Stage Blade LE and TE at Z = 40% | | |
| 1 | 1154.4195 | −10.4967 |
| 2 | 1150.2173 | −8.9081 |
| 3 | 1147.6956 | −7.8434 |
| 4 | 1144.3263 | −6.2665 |
| 5 | 1142.3534 | −5.2395 |
| 6 | 1139.7972 | −3.7548 |
| 7 | 1137.7249 | −2.3494 |
| 8 | 1136.6161 | −1.4628 |

TABLE 8-continued

| N | X | Y |
|---|---|---|
| 9 | 1135.3544 | −0.2422 |
| 10 | 1134.7689 | 0.4855 |
| 11 | 1134.6530 | 0.7128 |
| 12 | 1134.5817 | 0.9374 |
| 13 | 1134.5446 | 1.1750 |
| 14 | 1134.5447 | 1.4180 |
| 15 | 1134.5923 | 1.6883 |
| 16 | 1134.6788 | 1.9174 |
| 17 | 1134.8059 | 2.1280 |
| 18 | 1134.9675 | 2.3139 |
| 19 | 1135.1818 | 2.4866 |
| 20 | 1135.3928 | 2.6026 |
| 21 | 1135.6145 | 2.6826 |
| 22 | 1135.8380 | 2.7273 |
| 23 | 1137.1878 | 2.7114 |
| 24 | 1138.9353 | 2.5027 |
| 25 | 1140.3239 | 2.2596 |
| 26 | 1142.7390 | 1.7506 |
| 27 | 1145.5565 | 1.0718 |
| 28 | 1147.6608 | 0.5304 |
| 29 | 1151.1616 | −0.3995 |
| 30 | 1153.7294 | −1.0830 |
| 31 | 1286.7941 | 33.1268 |
| 32 | 1285.6381 | 32.0146 |
| 33 | 1284.1426 | 30.5451 |
| 34 | 1282.9473 | 29.3774 |
| 35 | 1280.8172 | 27.3871 |
| 36 | 1278.2508 | 25.1489 |
| 37 | 1276.2982 | 23.5203 |
| 38 | 1273.0277 | 20.8537 |
| 39 | 1270.6321 | 18.9134 |
| 40 | 1266.7274 | 15.7455 |
| 41 | 1269.6178 | 24.4164 |
| 42 | 1271.9496 | 25.9527 |
| 43 | 1275.1010 | 28.0923 |
| 44 | 1276.9751 | 29.4004 |
| 45 | 1279.4535 | 31.1711 |
| 46 | 1281.5404 | 32.6975 |
| 47 | 1282.7180 | 33.5727 |
| 48 | 1284.1690 | 34.6636 |
| 49 | 1284.9284 | 35.2394 |
| 50 | 1285.2518 | 35.4199 |
| 51 | 1285.6358 | 35.5181 |
| 52 | 1286.0438 | 35.5080 |
| 53 | 1286.4289 | 35.3826 |
| 54 | 1286.7508 | 35.1709 |
| 55 | 1286.9892 | 34.9010 |
| 56 | 1287.1568 | 34.5588 |
| 57 | 1287.2278 | 34.1678 |
| 58 | 1287.1789 | 33.7714 |
| 59 | 1287.0238 | 33.4138 |
| 60 | 1286.7941 | 33.1268 |
| Fourth Stage Blade LE and TE at Z = 50% | | |
| 1 | 1163.1804 | −13.7540 |
| 2 | 1159.4137 | −12.4322 |
| 3 | 1157.1622 | −11.5255 |
| 4 | 1154.1622 | −10.1671 |
| 5 | 1152.4062 | −9.2817 |
| 6 | 1150.1220 | −8.0139 |
| 7 | 1148.2445 | −6.8416 |
| 8 | 1147.2177 | −6.1164 |
| 9 | 1146.0179 | −5.1176 |
| 10 | 1145.4858 | −4.4824 |
| 11 | 1145.3922 | −4.2935 |
| 12 | 1145.3324 | −4.1058 |
| 13 | 1145.2980 | −3.9055 |
| 14 | 1145.2920 | −3.6984 |
| 15 | 1145.3225 | −3.4645 |
| 16 | 1145.3856 | −3.2624 |
| 17 | 1145.4819 | −3.0736 |
| 18 | 1145.6065 | −2.9041 |
| 19 | 1145.7730 | −2.7410 |
| 20 | 1145.9379 | −2.6242 |
| 21 | 1146.1120 | −2.5351 |
| 22 | 1146.2886 | −2.4741 |
| 23 | 1147.4782 | −2.3717 |
| 24 | 1149.0390 | −2.4769 |

TABLE 8-continued

| N | X | Y |
|---|---|---|
| 25 | 1150.2806 | −2.6300 |
| 26 | 1152.4441 | −2.9685 |
| 27 | 1154.9753 | −3.4312 |
| 28 | 1156.8711 | −3.8002 |
| 29 | 1160.0336 | −4.4312 |
| 30 | 1162.3583 | −4.8940 |
| 31 | 1278.6669 | 33.6789 |
| 32 | 1277.6319 | 32.7066 |
| 33 | 1276.2803 | 31.4352 |
| 34 | 1275.1999 | 30.4259 |
| 35 | 1273.2943 | 28.6867 |
| 36 | 1271.0364 | 26.6909 |
| 37 | 1269.3375 | 25.2168 |
| 38 | 1266.5107 | 22.7791 |
| 39 | 1264.4465 | 20.9970 |
| 40 | 1261.0842 | 18.0859 |
| 41 | 1263.5934 | 25.8218 |
| 42 | 1265.6005 | 27.2578 |
| 43 | 1268.3239 | 29.2374 |
| 44 | 1269.9496 | 30.4371 |
| 45 | 1272.1060 | 32.0500 |
| 46 | 1273.9276 | 33.4311 |
| 47 | 1274.9578 | 34.2194 |
| 48 | 1276.2297 | 35.1984 |
| 49 | 1276.8966 | 35.7134 |
| 50 | 1277.2053 | 35.8879 |
| 51 | 1277.5723 | 35.9829 |
| 52 | 1277.9626 | 35.9733 |
| 53 | 1278.3309 | 35.8518 |
| 54 | 1278.6380 | 35.6469 |
| 55 | 1278.8650 | 35.3862 |
| 56 | 1279.0239 | 35.0559 |
| 57 | 1279.0898 | 34.6786 |
| 58 | 1279.0402 | 34.2967 |
| 59 | 1278.8890 | 33.9533 |
| 60 | 1278.6669 | 33.6789 |
| Fourth Stage Blade LE and TE at Z = 60% | | |
| 1 | 1170.7303 | −17.1334 |
| 2 | 1167.3230 | −16.3534 |
| 3 | 1165.2679 | −15.7807 |
| 4 | 1162.5088 | −14.8678 |
| 5 | 1160.8855 | −14.2371 |
| 6 | 1158.7775 | −13.2830 |
| 7 | 1157.0705 | −12.3403 |
| 8 | 1156.1594 | −11.7319 |
| 9 | 1155.1374 | −10.8534 |
| 10 | 1154.7202 | −10.2609 |
| 11 | 1154.6628 | −10.1102 |
| 12 | 1154.6275 | −9.9645 |
| 13 | 1154.6084 | −9.8113 |
| 14 | 1154.6072 | −9.6539 |
| 15 | 1154.6297 | −9.4761 |
| 16 | 1154.6731 | −9.3209 |
| 17 | 1154.7379 | −9.1734 |
| 18 | 1154.8210 | −9.0377 |
| 19 | 1154.9320 | −8.9019 |
| 20 | 1155.0425 | −8.7984 |
| 21 | 1155.1604 | −8.7120 |
| 22 | 1155.2822 | −8.6433 |
| 23 | 1156.2879 | −8.3640 |
| 24 | 1157.6548 | −8.2178 |
| 25 | 1158.7629 | −8.1673 |
| 26 | 1160.7190 | −8.1738 |
| 27 | 1163.0136 | −8.2834 |
| 28 | 1164.7252 | −8.4091 |
| 29 | 1167.5656 | −8.6644 |
| 30 | 1169.6449 | −8.8676 |
| 31 | 1271.7509 | 34.4016 |
| 32 | 1270.8219 | 33.5150 |
| 33 | 1269.6046 | 32.3591 |
| 34 | 1268.6327 | 31.4395 |
| 35 | 1266.9356 | 29.8361 |
| 36 | 1264.9517 | 27.9646 |
| 37 | 1263.4688 | 26.5698 |
| 38 | 1261.0013 | 24.2609 |
| 39 | 1259.1928 | 22.5797 |
| 40 | 1256.2338 | 19.8484 |

TABLE 8-continued

| N | X | Y |
|---|---|---|
| 41 | 1258.1736 | 26.9471 |
| 42 | 1259.9289 | 28.3545 |
| 43 | 1262.3268 | 30.2678 |
| 44 | 1263.7676 | 31.4122 |
| 45 | 1265.6895 | 32.9337 |
| 46 | 1267.3225 | 34.2227 |
| 47 | 1268.2497 | 34.9534 |
| 48 | 1269.3974 | 35.8570 |
| 49 | 1270.0000 | 36.3314 |
| 50 | 1270.2966 | 36.5043 |
| 51 | 1270.6508 | 36.6016 |
| 52 | 1271.0290 | 36.5983 |
| 53 | 1271.3879 | 36.4875 |
| 54 | 1271.6892 | 36.2955 |
| 55 | 1271.9135 | 36.0484 |
| 56 | 1272.0726 | 35.7327 |
| 57 | 1272.1428 | 35.3706 |
| 58 | 1272.1016 | 35.0026 |
| 59 | 1271.9612 | 34.6696 |
| 60 | 1271.7509 | 34.4016 |
| Fourth Stage Blade LE and TE at Z = 70% | | |
| 1 | 1170.7303 | −17.1334 |
| 2 | 1167.3230 | −16.3534 |
| 3 | 1165.2679 | −15.7807 |
| 4 | 1162.5088 | −14.8678 |
| 5 | 1160.8855 | −14.2371 |
| 6 | 1158.7775 | −13.2830 |
| 7 | 1157.0705 | −12.3403 |
| 8 | 1156.1594 | −11.7319 |
| 9 | 1155.1374 | −10.8534 |
| 10 | 1154.7202 | −10.2609 |
| 11 | 1154.6628 | −10.1102 |
| 12 | 1154.6275 | −9.9645 |
| 13 | 1154.6084 | −9.8113 |
| 14 | 1154.6072 | −9.6539 |
| 15 | 1154.6297 | −9.4761 |
| 16 | 1154.6731 | −9.3209 |
| 17 | 1154.7379 | −9.1734 |
| 18 | 1154.8210 | −9.0377 |
| 19 | 1154.9320 | −8.9019 |
| 20 | 1155.0425 | −8.7984 |
| 21 | 1155.1604 | −8.7120 |
| 22 | 1155.2822 | −8.6433 |
| 23 | 1156.2879 | −8.3640 |
| 24 | 1157.6548 | −8.2178 |
| 25 | 1158.7629 | −8.1673 |
| 26 | 1160.7190 | −8.1738 |
| 27 | 1163.0136 | −8.2834 |
| 28 | 1164.7252 | −8.4091 |
| 29 | 1167.5656 | −8.6644 |
| 30 | 1169.6449 | −8.8676 |
| 31 | 1271.7509 | 34.4016 |
| 32 | 1270.8219 | 33.5150 |
| 33 | 1269.6046 | 32.3591 |
| 34 | 1268.6327 | 31.4395 |
| 35 | 1266.9356 | 29.8361 |
| 36 | 1264.9517 | 27.9646 |
| 37 | 1263.4688 | 26.5698 |
| 38 | 1261.0013 | 24.2609 |
| 39 | 1259.1928 | 22.5797 |
| 40 | 1256.2338 | 19.8484 |
| 41 | 1258.1736 | 26.9471 |
| 42 | 1259.9289 | 28.3545 |
| 43 | 1262.3268 | 30.2678 |
| 44 | 1263.7676 | 31.4122 |
| 45 | 1265.6895 | 32.9337 |
| 46 | 1267.3225 | 34.2227 |
| 47 | 1268.2497 | 34.9534 |
| 48 | 1269.3974 | 35.8570 |
| 49 | 1270.0000 | 36.3314 |
| 50 | 1270.2966 | 36.5043 |
| 51 | 1270.6508 | 36.6016 |
| 52 | 1271.0290 | 36.5983 |
| 53 | 1271.3879 | 36.4875 |
| 54 | 1271.6892 | 36.2955 |
| 55 | 1271.9135 | 36.0484 |
| 56 | 1272.0726 | 35.7327 |

TABLE 8-continued

| N | X | Y |
|---|---|---|
| 57 | 1272.1428 | 35.3706 |
| 58 | 1272.1016 | 35.0026 |
| 59 | 1271.9612 | 34.6696 |
| 60 | 1271.7509 | 34.4016 |
| Fourth Stage Blade LE and TE at Z = 80% | | |
| 1 | 1180.3804 | −24.6815 |
| 2 | 1177.3791 | −24.8914 |
| 3 | 1175.5632 | −24.9172 |
| 4 | 1173.1107 | −24.8344 |
| 5 | 1171.6484 | −24.7197 |
| 6 | 1169.7029 | −24.4878 |
| 7 | 1168.0497 | −24.2029 |
| 8 | 1167.1145 | −23.9783 |
| 9 | 1165.9914 | −23.5681 |
| 10 | 1165.4996 | −23.1717 |
| 11 | 1165.4244 | −23.0387 |
| 12 | 1165.3705 | −22.9108 |
| 13 | 1165.3301 | −22.7761 |
| 14 | 1165.3047 | −22.6368 |
| 15 | 1165.2974 | −22.4764 |
| 16 | 1165.3131 | −22.3321 |
| 17 | 1165.3496 | −22.1906 |
| 18 | 1165.4041 | −22.0560 |
| 19 | 1165.4836 | −21.9148 |
| 20 | 1165.5674 | −21.8002 |
| 21 | 1165.6612 | −21.6971 |
| 22 | 1165.7633 | −21.6067 |
| 23 | 1166.6031 | −21.0773 |
| 24 | 1167.7486 | −20.5349 |
| 25 | 1168.6809 | −20.1816 |
| 26 | 1170.3309 | −19.6699 |
| 27 | 1172.2834 | −19.1856 |
| 28 | 1173.7550 | −18.8770 |
| 29 | 1176.2176 | −18.4199 |
| 30 | 1178.0287 | −18.1035 |
| 31 | 1258.5329 | 37.0949 |
| 32 | 1257.8126 | 36.2685 |
| 33 | 1256.8690 | 35.1904 |
| 34 | 1256.1152 | 34.3329 |
| 35 | 1254.7964 | 32.8401 |
| 36 | 1253.2505 | 31.1018 |
| 37 | 1252.0930 | 29.8078 |
| 38 | 1250.1656 | 27.6659 |
| 39 | 1248.7527 | 26.1054 |
| 40 | 1246.4398 | 23.5688 |
| 41 | 1247.4783 | 29.6580 |
| 42 | 1248.8550 | 31.0119 |
| 43 | 1250.7358 | 32.8550 |
| 44 | 1251.8659 | 33.9586 |
| 45 | 1253.3744 | 35.4264 |
| 46 | 1254.6572 | 36.6697 |
| 47 | 1255.3862 | 37.3741 |
| 48 | 1256.2894 | 38.2446 |
| 49 | 1256.7640 | 38.7012 |
| 50 | 1257.0173 | 38.8835 |
| 51 | 1257.3307 | 39.0019 |
| 52 | 1257.6756 | 39.0310 |
| 53 | 1258.0129 | 38.9601 |
| 54 | 1258.3049 | 38.8103 |
| 55 | 1258.5320 | 38.6041 |
| 56 | 1258.7063 | 38.3305 |
| 57 | 1258.8033 | 38.0071 |
| 58 | 1258.7987 | 37.6689 |
| 59 | 1258.7006 | 37.3549 |
| 60 | 1258.5329 | 37.0949 |
| Fourth Stage Blade LE and TE at Z = 90% | | |
| 1 | 1183.5300 | −27.0726 |
| 2 | 1180.8201 | −27.8239 |
| 3 | 1179.1601 | −28.1657 |
| 4 | 1176.9086 | −28.4664 |
| 5 | 1175.5720 | −28.5444 |
| 6 | 1173.8101 | −28.5025 |
| 7 | 1172.3306 | −28.2950 |
| 8 | 1171.4985 | −28.0849 |
| 9 | 1170.4859 | −27.7072 |
| 10 | 1169.9826 | −27.4368 |

TABLE 8-continued

| N | X | Y |
|---|---|---|
| 11 | 1169.7900 | −27.2919 |
| 12 | 1169.6400 | −27.1363 |
| 13 | 1169.5172 | −26.9597 |
| 14 | 1169.4267 | −26.7673 |
| 15 | 1169.3658 | −26.5415 |
| 16 | 1169.3492 | −26.3407 |
| 17 | 1169.3685 | −26.1392 |
| 18 | 1169.4229 | −25.9373 |
| 19 | 1169.5250 | −25.7195 |
| 20 | 1169.6500 | −25.5423 |
| 21 | 1169.8018 | −25.3862 |
| 22 | 1169.9734 | −25.2553 |
| 23 | 1170.7251 | −24.8640 |
| 24 | 1171.7407 | −24.4185 |
| 25 | 1172.5647 | −24.0990 |
| 26 | 1174.0280 | −23.5913 |
| 27 | 1175.7688 | −23.0463 |
| 28 | 1177.0841 | −22.6540 |
| 29 | 1179.2852 | −21.9942 |
| 30 | 1180.9006 | −21.4855 |
| 31 | 1252.8269 | 37.8733 |
| 32 | 1252.1670 | 37.0609 |
| 33 | 1251.3017 | 36.0018 |
| 34 | 1250.6098 | 35.1600 |
| 35 | 1249.3982 | 33.6956 |
| 36 | 1247.9767 | 31.9917 |
| 37 | 1246.9118 | 30.7243 |
| 38 | 1245.1380 | 28.6283 |
| 39 | 1243.8375 | 27.1022 |
| 40 | 1241.7103 | 24.6225 |
| 41 | 1242.5363 | 30.2245 |
| 42 | 1243.7961 | 31.5850 |
| 43 | 1245.5197 | 33.4370 |
| 44 | 1246.5574 | 34.5455 |
| 45 | 1247.9452 | 36.0189 |
| 46 | 1249.1284 | 37.2656 |
| 47 | 1249.8021 | 37.9712 |
| 48 | 1250.6384 | 38.8424 |
| 49 | 1251.0787 | 39.2988 |
| 50 | 1251.3137 | 39.4823 |
| 51 | 1251.6072 | 39.6074 |
| 52 | 1251.9323 | 39.6481 |
| 53 | 1252.2573 | 39.5980 |
| 54 | 1252.5456 | 39.4749 |
| 55 | 1252.7703 | 39.2919 |
| 56 | 1252.9436 | 39.0387 |
| 57 | 1253.0479 | 38.7388 |
| 58 | 1253.0588 | 38.4241 |
| 59 | 1252.9776 | 38.1256 |
| 60 | 1252.8269 | 37.8733 |
| Fourth Stage Blade LE and TE at Z = 100% | | |
| 1 | 1186.8945 | −24.8858 |
| 2 | 1184.7558 | −26.0712 |
| 3 | 1183.3986 | −26.7029 |
| 4 | 1181.4780 | −27.4113 |
| 5 | 1180.2913 | −27.7290 |
| 6 | 1178.6876 | −27.9847 |
| 7 | 1177.3347 | −27.9953 |
| 8 | 1176.5795 | −27.9069 |
| 9 | 1175.6529 | −27.7292 |
| 10 | 1175.1700 | −27.6076 |
| 11 | 1174.8617 | −27.4945 |
| 12 | 1174.6056 | −27.3444 |
| 13 | 1174.3819 | −27.1513 |
| 14 | 1174.2027 | −26.9221 |
| 15 | 1174.0613 | −26.6377 |
| 16 | 1173.9944 | −26.3765 |
| 17 | 1173.9846 | −26.1062 |
| 18 | 1174.0305 | −25.8284 |
| 19 | 1174.1480 | −25.5254 |
| 20 | 1174.3089 | −25.2806 |
| 21 | 1174.5124 | −25.0687 |
| 22 | 1174.7450 | −24.8976 |
| 23 | 1175.4116 | −24.5032 |
| 24 | 1176.3083 | −24.0351 |
| 25 | 1177.0282 | −23.6712 |
| 26 | 1178.2881 | −23.0422 |

TABLE 8-continued

| N | X | Y |
|---|---|---|
| 27 | 1179.7567 | −22.3015 |
| 28 | 1180.8480 | −21.7394 |
| 29 | 1182.6476 | −20.7833 |
| 30 | 1183.9526 | −20.0628 |
| 31 | 1243.9637 | 33.1655 |
| 32 | 1243.4248 | 32.4447 |
| 33 | 1242.7175 | 31.5061 |
| 34 | 1242.1514 | 30.7608 |
| 35 | 1241.1584 | 29.4667 |
| 36 | 1239.9901 | 27.9654 |
| 37 | 1239.1118 | 26.8524 |
| 38 | 1237.6420 | 25.0198 |
| 39 | 1236.5578 | 23.6930 |
| 40 | 1234.7698 | 21.5526 |
| 41 | 1235.4154 | 26.2150 |
| 42 | 1236.4734 | 27.3943 |
| 43 | 1237.9126 | 29.0105 |
| 44 | 1238.7748 | 29.9837 |
| 45 | 1239.9234 | 31.2842 |
| 46 | 1240.8986 | 32.3908 |
| 47 | 1241.4525 | 33.0196 |
| 48 | 1242.1383 | 33.7986 |
| 49 | 1242.4987 | 34.2078 |
| 50 | 1242.6848 | 34.3691 |
| 51 | 1242.9204 | 34.4872 |
| 52 | 1243.1842 | 34.5392 |
| 53 | 1243.4507 | 34.5182 |
| 54 | 1243.6895 | 34.4365 |
| 55 | 1243.8780 | 34.3027 |
| 56 | 1244.0266 | 34.1093 |
| 57 | 1244.1202 | 33.8743 |
| 58 | 1244.1379 | 33.6219 |
| 59 | 1244.0798 | 33.3771 |
| 60 | 1243.9637 | 33.1655 |

It may be appreciated that the leading and trailing edge sections for the airfoils of the vane 22, blade 24, vane 26 and blade 28, as disclosed in the above Tables 2, 4, 6 and 8, may be scaled up or down geometrically for use in other similar turbine designs. Consequently, the coordinate values set forth in Tables 2, 4, 6 and 8 may be scaled upwardly or downwardly such that the airfoil section shapes remain unchanged. A scaled version of the coordinates in Tables 2, 4, 6 and 8 could be represented by X, Y and Z coordinate values multiplied or divided by the same constant or number.

It is believed that the vane 22, blade 24, vane 26 and blade 28, constructed with the described average angle changes, provide and improved or optimized flow of working gases passing from the turbine section 12 to the diffuser 34, with improved Mach numbers for the flow passing through the third and fourth stages of the turbine. In particular, the design for the airfoil angles of the third and fourth stages are configured provide a better balance between the Mach numbers for the third and fourth stages, which is believed to provide an improved performance through these stages, since losses are generally proportional to the square of the Mach number.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine airfoil assembly for installation in a gas turbine engine having a longitudinal axis, the turbine airfoil assembly including an endwall for defining an inner boundary for an axially extending hot working gas path, and an airfoil extending radially outwardly from the endwall, said airfoil having an outer wall comprising a pressure sidewall and a suction sidewall joined together at chordally spaced apart leading and trailing edges of said airfoil, an airfoil mean line is defined extending chordally and located centrally between said pressure and suction sidewalls, airfoil inlet and exit angles are defined at said airfoil leading and trailing edges that are in accordance with pairs of inlet angle values, α, and exit angle values, β, set forth in one of Tables 1, 3, 5 and 7, where said inlet and exit angle values are defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis, and wherein each pair of inlet and exit angle values is defined with respect to a distance from said endwall corresponding to a Z value that is a percentage of a total span of said airfoil from said endwall, and wherein a predetermined difference between each pair of said airfoil inlet and exit angles is defined by a delta value, Δ, in said one of Tables 1, 3, 5 and 7, and a measured difference between any pair of said airfoil inlet and exit angles varies from the corresponding delta values, Δ, in said one of Tables 1, 3, 5 and 7 by at most 5%.

2. The turbine airfoil assembly of claim 1, wherein said airfoil comprises an airfoil for a third stage vane in a turbine engine, and said one of Tables 1, 3, 5 and 7 defining said airfoil inlet and exit angles is Table 1.

3. The turbine airfoil assembly of claim 1, wherein said airfoil comprises an airfoil for a third stage blade in a turbine engine, and said one of Tables 1, 3, 5 and 7 defining said airfoil inlet and exit angles is Table 3.

4. The turbine airfoil assembly of claim 1, wherein said airfoil comprises an airfoil for a fourth stage vane in a turbine engine, and said one of Tables 1, 3, 5 and 7 defining said airfoil inlet and exit angles is Table 5.

5. The turbine airfoil assembly of claim 1, wherein said airfoil comprises an airfoil for a fourth stage blade in a turbine engine, and said one of Tables 1, 3, 5 and 7 defining said airfoil inlet and exit angles is Table 7.

6. The turbine airfoil assembly of claim 1, including four airfoils comprising, in succession, an airfoil for a third stage vane having said airfoil inlet and exit angles defined by Table 1, an airfoil for a third stage blade having said airfoil inlet and exit angles defined by Table 3, an airfoil for a fourth stage vane having said airfoil inlet and exit angles defined by Table 5 and an airfoil for a fourth stage blade having said airfoil inlet and exit angles defined by Table 7.

7. The turbine airfoil assembly of claim 6, wherein said measured difference between any pair of said airfoil inlet and exit angles varies from the corresponding delta values, Δ, in a respective Table by at most 3%.

8. The turbine airfoil assembly of claim 6, wherein said measured difference between any pair of said airfoil inlet and exit angles varies from the corresponding delta values, Δ, in a respective Table by at most 1%.

9. Third and fourth stage vane and blade airfoil assemblies in a gas turbine engine having a longitudinal axis, each airfoil assembly including:

an endwall for defining an inner boundary for an axially extending hot working gas path, and an airfoil extending radially outwardly from the endwall, said airfoil having an outer wall comprising a pressure sidewall and a suction sidewall joined together at chordally spaced apart leading and trailing edges of said airfoil, an airfoil mean line is defined extending chordally and located centrally between said pressure and suction sidewalls, airfoil inlet and exit angles are defined at said airfoil leading and trailing edges that are in accordance with pairs of inlet angle values, α, and exit angle values, β, where said inlet and exit angle values are defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis, and wherein each pair of inlet and exit angle values is defined with respect to a distance from said endwall corresponding to a Z value that is a percentage of a total span of said airfoil from said endwall, wherein:

a) said pairs of inlet angle values, α, and exit angle values, β, for said third stage vane are as set forth in Table 1;

b) said pairs of inlet angle values, α, and exit angle values, β, for said third stage blade are as set forth in Table 3;

c) said pairs of inlet angle values, α, and exit angle values, β, for said fourth stage vane are as set forth in Table 5;

d) said pairs of inlet angle values, α, and exit angle values, β, for said fourth stage blade are as set forth in Table 7; and wherein a predetermined difference between each pair of said airfoil inlet and exit angles is defined by a delta value, Δ, in said Tables 1, 3, 5 and 7 associated with said third stage vane, said third stage blade, said fourth stage vane, and said fourth stage blade, respectively, and a measured difference between any pair of said airfoil inlet and exit angles varies from the corresponding delta values, Δ, in a respective one of said Tables 1, 3, 5 and 7 by at most 5%.

10. The turbine airfoil assembly of claim 9, wherein said measured difference between any pair of said airfoil inlet and exit angles varies from the corresponding delta values, Δ, in a respective one of said Tables 1, 3, 5 and 7 by at most 3%.

11. The turbine airfoil assembly of claim 9, wherein said measured difference between any pair of said airfoil inlet and exit angles varies from the corresponding delta values, Δ, in a respective one of said Tables 1, 3, 5 and 7 by at most 1%.

12. A turbine airfoil assembly for installation in a gas turbine engine having a longitudinal axis, the turbine airfoil assembly including an endwall for defining an inner boundary for an axially extending hot working gas path, and an airfoil extending radially outwardly from the endwall, said airfoil having an outer wall comprising a pressure sidewall and a suction sidewall joined together at chordally spaced apart leading and trailing edges of said airfoil, an airfoil mean line is defined extending chordally and located centrally between said pressure and suction sidewalls, airfoil exit angles are defined at said airfoil trailing edge that are in accordance with exit angle values, β, set forth in one of Tables 1, 3, 5 and 7, where said exit angle values are defined as angles between a line parallel to the longitudinal axis and the airfoil mean line lying in an X-Y plane of an X, Y, Z Cartesian coordinate system in which Z is a dimension perpendicular to the X-Y plane and extends radially relative to the longitudinal axis, wherein each said exit angle value is defined with respect to a distance from said endwall corresponding to a Z value that is a percentage of a total span of said airfoil from said endwall, and wherein each said airfoil exit angle is within about 1% of a respective value set forth in said one of Tables 1, 3, 5 and 7.

13. The turbine airfoil assembly of claim 12, wherein said airfoil comprises an airfoil for a third stage vane in a turbine engine, and said one of Tables 1, 3, 5 and 7 defining said airfoil exit angles is Table 1.

14. The turbine airfoil assembly of claim 12, wherein said airfoil comprises an airfoil for a third stage blade in a turbine engine, and said one of Tables 1, 3, 5 and 7 defining said airfoil exit angles is Table 3.

15. The turbine airfoil assembly of claim 12, wherein said airfoil comprises an airfoil for a fourth stage vane in a turbine engine, and said one of Tables 1, 3, 5 and 7 defining said airfoil exit angles is Table 5.

16. The turbine airfoil assembly of claim 12, wherein said airfoil comprises an airfoil for a fourth stage blade in a turbine engine, and said one of Tables 1, 3, 5 and 7 defining said airfoil exit angles is Table 7.

17. The turbine airfoil assembly of claim 12, including four of said airfoils comprising, in succession, an airfoil for a third stage vane having airfoil exit angles defined by Table 1, an airfoil for a third stage blade having airfoil exit angles defined by Table 3, an airfoil for a fourth stage vane having airfoil exit angles defined by Table 5 and an airfoil for a fourth stage blade having airfoil exit angles defined by Table 7.

18. The turbine airfoil assembly of claim 12, including at least two of said airfoils comprising, in succession, an airfoil for a third stage blade having airfoil exit angles defined by Table 3, and an airfoil for a fourth stage vane having airfoil exit angles defined by Table 5.

* * * * *